US010738680B2

(12) United States Patent
Tofukuji et al.

(10) Patent No.: US 10,738,680 B2
(45) Date of Patent: Aug. 11, 2020

(54) CYLINDER HEAD OF MULTI-CYLINDER ENGINE

(71) Applicant: TOYOTA JIDOSHA KABUSHIKI KAISHA, Toyota-shi, Aichi-ken (JP)

(72) Inventors: Satoko Tofukuji, Tokyo (JP); Atsunori Kumagai, Shizuoka-ken (JP); Nobuki Kawamoto, Okazaki (JP)

(73) Assignee: TOYOTA JIDOSHA KABUSHIKI KAISHA, Toyota-shi, Aichi-ken (JP)

( * ) Notice: Subject to any disclaimer, the term of this patent is extended or adjusted under 35 U.S.C. 154(b) by 409 days.

(21) Appl. No.: 15/524,280

(22) PCT Filed: Nov. 10, 2015

(86) PCT No.: PCT/IB2015/002085
§ 371 (c)(1),
(2) Date: May 4, 2017

(87) PCT Pub. No.: WO2016/075521
PCT Pub. Date: May 19, 2016

(65) Prior Publication Data

US 2017/0328262 A1 Nov. 16, 2017

(30) Foreign Application Priority Data

Nov. 13, 2014 (JP) ..... 2014-231032

(51) Int. Cl.
*F01P 3/02* (2006.01)
*F02F 1/40* (2006.01)
(Continued)

(52) U.S. Cl.
CPC ..... *F01P 3/02* (2013.01); *F01P 3/14* (2013.01); *F01P 7/026* (2013.01); *F01P 11/04* (2013.01);
(Continued)

(58) Field of Classification Search
CPC .... F01P 3/02; F01P 7/026; F01P 11/04; F01P 3/14; F01P 2003/024; F01P 2050/22; F02F 1/40
See application file for complete search history.

(56) References Cited

U.S. PATENT DOCUMENTS 5,529,027 A 6/1996 Okubo
2002/0100436 A1 8/2002 Kawamoto
(Continued)

FOREIGN PATENT DOCUMENTS

AT 005939 U1 1/2003
CN 102498278 A 6/2012
(Continued)

OTHER PUBLICATIONS

International Search Report and Written Opinion for PCT/IB/2015/002085 dated Feb. 22, 2016.

*Primary Examiner* — Sizo B Vilakazi
(74) *Attorney, Agent, or Firm* — Sughrue Mion, PLLC

(57) ABSTRACT

A first coolant flow passage (31, 32) is provided to extend in a longitudinal direction of a cylinder head (101). In at least one of cross sections perpendicular to the longitudinal direction, the first coolant flow passage (31, 32) is located between a flat plane (S1) including central axes of a plurality of combustion chambers (4) and parallel to the longitudinal direction and a central line plane (S2) including central lines of a plurality of intake ports (2). In at least one of cross sections perpendicular to the longitudinal direction, at least a portion (20*c*) of a second coolant flow passage is located between a cylinder block mating surface (la) of the cylinder head (101) and the intake port central line plane (S2). A coolant at a temperature lower than that of a coolant flowing in the second coolant flow passage (20*c*) flows in the first coolant flow passage (31, 32).

18 Claims, 41 Drawing Sheets

(51) Int. Cl.
*F01P 3/14* (2006.01)
*F01P 7/02* (2006.01)
*F01P 11/04* (2006.01)

(52) U.S. Cl.
CPC ..... *F02F 1/40* (2013.01); *F01P 2003/024* (2013.01); *F01P 2050/22* (2013.01)

(56) References Cited

U.S. PATENT DOCUMENTS

| | | | | |
|---|---|---|---|---|
| 2006/0196453 | A1* | 9/2006 | Yamada | F01P 3/16 123/41.32 |
| 2010/0132639 | A1 | 6/2010 | Pöschl et al. | |
| 2012/0090566 | A1 | 4/2012 | Knollmayr | |
| 2015/0247472 | A1 | 9/2015 | Nomura | |
| 2016/0341099 | A1* | 11/2016 | Utsumi | F01P 3/02 |
| 2016/0341108 | A1* | 11/2016 | Utsumi | F02B 31/08 |
| 2016/0348610 | A1* | 12/2016 | Kodama | F02F 1/40 |

FOREIGN PATENT DOCUMENTS

| | | | |
|---|---|---|---|
| EP | 0787893 | A1 | 8/1997 |
| FR | 2855555 | A1 | 12/2004 |
| FR | 2907503 | A1 | 4/2008 |
| JP | 50-032440 | U | 4/1975 |
| JP | 56-079649 | U | 6/1981 |
| JP | 61-033937 | U | 3/1986 |
| JP | 61-048917 | U | 4/1986 |
| JP | H04-060159 | A | 2/1992 |
| JP | 04-129836 | U | 11/1992 |
| JP | 2003120290 | A | 4/2003 |
| JP | 3461773 | B2 | 10/2003 |
| JP | 2010203350 | A | 9/2010 |
| JP | 2011094523 | A | 5/2011 |
| JP | 2012107573 | A | 6/2012 |
| JP | 2013-133746 | A | 7/2013 |
| JP | 2014148912 | A | 8/2014 |
| WO | 2008/122544 | A1 | 10/2008 |

* cited by examiner

CYLINDER HEAD OF MULTI-CYLINDER ENGINE

CROSS REFERENCE TO RELATED APPLICATIONS

This application is a National Stage of International Application No. PCT/IB2015/002085 filed Nov. 10, 2015, claiming priority based on Japanese Patent Application No. 2014-231032 filed Nov. 13, 2014, the contents of all of which are incorporated herein by reference in their entirety.

BACKGROUND OF THE INVENTION

1. Field of the Invention

The invention relates to a cylinder head of an internal combustion engine (hereinafter referred to as an "engine") and specifically relates to a cylinder head of a multi-cylinder engine having therein flow passages in each of which a coolant flows.

2. Description of Related Art

A cylinder head of an engine is formed with flow passages in each of which a coolant flows. Japanese Patent Application Publication No. 2013-133746 (JP 2013-133746 A) discloses that, in order to sufficiently cool the air in intake ports, a first coolant circuit in which a coolant circulates for cooling portions around the intake ports in a cylinder head is provided independently of a second coolant circuit in which a coolant circulates for cooling a cylinder block and portions around exhaust ports in the cylinder head.

The first coolant circuit includes an intake port coolant passage formed in the cylinder head. The intake port coolant passage is connected to coolant inlet portions provided in an end face in a width direction of the cylinder head. The intake port coolant passage extends from the coolant inlet portions to lower sides of the intake ports, then passes through lateral sides of the intake ports so as to extend to upper sides of the intake ports, and then passes through the upper sides of the intake ports so as to be connected to a coolant outlet portion provided in an end face in a longitudinal direction of the cylinder head. Herein, the lower side of the intake port means a lower side in the vertical direction when the cylinder head is located on an upper side in the vertical direction with respect to the cylinder block, while the upper side of the intake port means an upper side in the vertical direction when the cylinder head is located in the same manner as described above.

In order to achieve stable combustion, a recent engine employs an intake port having a shape that can generate a tumble flow in a cylinder (a tumble flow generating port). When the intake port is a tumble flow generating port, the air flows in a manner to stick to an upper surface side of the intake port. Therefore, in order to cool the air in the intake port, it is more effective to reduce the wall temperature of the intake port on its upper surface side.

On the other hand, according to the structure of the cylinder head disclosed in JP 2013-133746 A, a coolant introduced into the intake port coolant passage is configured to flow in the cylinder head so as to first cool lower surface sides of the intake ports and then cool upper surface sides of the intake ports. While the coolant flows on the lower sides of the intake ports, the temperature of the coolant increases due to heat received from an attaching surface of the cylinder block. Therefore, when the coolant flows on the upper sides of the intake ports, the temperature of the coolant may already be high so that the coolant may not have a sufficient cooling effect for the air in the intake ports.

SUMMARY OF THE INVENTION

In view of the above-mentioned problem, the invention provides a cylinder head of a multi-cylinder engine that can efficiently cool the air flowing in intake ports.

Therefore, according to one aspect of the invention, there is provided a multi-cylinder engine including a cylinder head. The cylinder head includes a plurality of combustion chambers, a plurality of intake ports, a first coolant flow passage, and a second coolant flow passage. The plurality of combustion chambers are provided side by side in a longitudinal direction of the cylinder head. The combustion chamber of the cylinder head represents a portion, on the cylinder head side, which forms a closed space where an air-fuel mixture is combusted. Therefore, in this application, the combustion chamber does not necessarily have a shape recessed from a cylinder block mating surface of the cylinder head and may be flush with the cylinder block mating surface. Generally, a cylinder head of a spark-ignition engine is provided with combustion chambers that are recessed with respect to a cylinder block mating surface, while a cylinder head of a compression self-ignition engine is provided with combustion chambers that are flush with a cylinder block mating surface.

In this application, a longitudinal direction of a cylinder head is defined as a direction of a row of cylinders when the cylinder head is mounted on a cylinder block to form an engine, i.e. an axial direction of a crankshaft. Further, in this application, a direction perpendicular to the longitudinal direction and parallel to a cylinder block mating surface of the cylinder head is defined as a width direction of the cylinder head and a direction perpendicular to the longitudinal direction and perpendicular to the cylinder block mating surface of the cylinder head is defined as a height direction of the cylinder head.

The plurality of intake ports are provided side by side in the longitudinal direction of the cylinder head and respectively communicate with the plurality of combustion chambers. The intake port is provided for each combustion chamber. When the number of intake valves for each cylinder is two or more, each combustion chamber is formed with intake openings corresponding to the number of the intake valves. In this case, one intake port having one air inlet and a plurality of air outlets corresponding to the number of the intake openings may be provided for each combustion chamber or a plurality of intake ports corresponding to the number of the intake openings may be provided for each combustion chamber. The intake port is preferably a tumble flow generating port.

The first coolant flow passage extends in the longitudinal direction of the cylinder head. Further, in at least one of cross sections perpendicular to the longitudinal direction, the first coolant flow passage is located between a flat plane and a central line plane. The flat plane includes central axes of the combustion chambers and parallel to the longitudinal direction (hereinafter, the cylinder head longitudinal direction central flat plane). The central line plane includes central lines of the intake ports. In a cross section including the intake port of the cross sections perpendicular to the longitudinal direction, the first coolant flow passage is provided to be located between the cylinder head longitudinal direction central flat plane and the central line plane. "extend in the longitudinal direction" does not mean that the first coolant flow passage is provided only partially in the longitudinal direction or discretely in the longitudinal direction, but means that the first coolant flow passage is provided continuously in the longitudinal direction along the intake ports disposed side by side in the longitudinal direction. Further, "extend in the longitudinal direction" does not restrictively mean that the first coolant flow passage is straight in the longitudinal direction. The first coolant flow passage does not necessarily have a uniform shape in the width direction or the height direction of the cylinder head if it extends in the longitudinal direction as a whole. The first coolant flow passage may have a meandering shape corresponding to the shape on the cylinder head longitudinal direction central flat plane side of the intake ports disposed side by side in the longitudinal direction.

In at least one of cross sections perpendicular to the longitudinal direction, at least a portion of the second coolant flow passage is located between the cylinder block mating surface and the central line plane. Between the cylinder block mating surface and the central line plane, the second coolant flow passage may be provided only partially in the longitudinal direction, discretely in the longitudinal direction, or continuously in the longitudinal direction along the intake ports disposed side by side in the longitudinal direction. Preferably, in a cross section including the intake port of the cross sections perpendicular to the longitudinal direction, the second coolant flow passage is provided to be located between the cylinder block mating surface and the central line plane. The portion, located between the cylinder block mating surface and the central line plane, of the second coolant flow passage may be opened at the cylinder block mating surface. The portion present between the cylinder block mating surface and the central line plane may be a part or all of the second coolant flow passage spatially extending in the cylinder head. The second coolant flow passage may extend to the peripheries of exhaust ports.

In the cylinder head, a temperature of a coolant flowing in the first coolant flow passage is lower than the temperature of the coolant flowing in the second coolant flow passage.

According to the configuration of the cylinder head of the multi-cylinder engine described above, while suppressing heat transfer from the cylinder block mating surface to the intake ports by the second coolant flow passage, upper surface sides of the intake ports can be cooled by the first coolant flow passage in which the coolant at a temperature lower than that of the coolant flowing in the second coolant flow passage flows, and therefore, it is possible to efficiently cool the air flowing in the intake ports. In this application, assuming that the intake port is divided into two by the central line plane, a surface on the cylinder head longitudinal direction central flat plane side may be called an upper surface of the intake port, while a surface on the cylinder block mating surface side may be called a lower surface of the intake port.

When the cylinder head includes intake valve insertion holes, the first coolant flow passage includes the following modes with respect to the positional relationship between itself and the intake valve insertion holes.

In the multi-cylinder engine, the cylinder head may include intake valve insertion holes and, in a cross section including a central axis of the intake valve insertion hole and perpendicular to the longitudinal direction, the first coolant flow passage may be provided to pass through a region sandwiched between the intake valve insertion hole and the intake port. According to this mode, the first coolant flow passage can be disposed close to upper surfaces of the intake ports.

In the multi-cylinder engine, the cylinder head includes intake valve insertion holes and, in a cross section including a central axis of the intake valve insertion hole and perpendicular to the longitudinal direction, the first coolant flow passage may be provided to pass through a region on a side opposite to a region sandwiched between the intake valve insertion hole and the intake port with respect to the intake valve insertion hole. According to this mode, the first coolant flow passage can be disposed with high degree of freedom. For example, the first coolant flow passage can be disposed at portions, downstream of the intake valve insertion holes, of the intake ports, i.e. can be disposed close to connecting portions, with the combustion chambers, of the intake ports, where the wall temperature of the intake ports becomes highest.

Further, in the multi-cylinder engine, the cylinder head includes intake valve insertion holes and, in a cross section including a central axis of the intake valve insertion hole and perpendicular to the longitudinal direction, the first coolant flow passage may be provided to pass on both sides of the central axis of the intake valve insertion hole. According to this mode, regions to be cooled by the first coolant flow passage can be broadened. In this mode, the first coolant flow passage may include annular passages respectively surrounding the intake valve insertion holes and connecting passages each connecting the adjacent two annular passages to each other. "annular passage" does not mean that its shape is circular or elliptical. "annular passage" is sufficient if it is configured that a flow passage passing on one side of the central axis of the intake valve insertion hole and a flow passage passing on the other side thereof communicate with each other on both upstream and downstream sides. According to this configuration, the first coolant flow passage can be disposed close to both the upper surface of the intake port and the connecting portion, with the combustion chamber, of the intake port.

In the multi-cylinder engine, when the cylinder head includes two intake valve insertion holes for each combustion chamber, the connecting passages each connecting the adjacent two annular passages may include a first connecting passage and a second connecting passage. The first connecting passage passes through a cross section including the central axis of the combustion chamber and perpendicular to the longitudinal direction. The second connecting passage passes through a cross section passing between the adjacent two combustion chambers and perpendicular to the longitudinal direction. With respect to a flat plane including the central axes of the intake valve insertion holes and parallel to the longitudinal direction, the first connecting passage is disposed on one side of the flat plane, while the second connecting passage is disposed on the other side of the flat plane. That is, the first and second connecting passages are disposed alternately in the longitudinal direction in a manner to sandwich the annular passage therebetween. According to this configuration, the coolant is prevented from staying in the annular passages.

The cylinder head may include a head bolt insertion hole that passes between the two intake ports communicating with the adjacent two combustion chambers and that is perpendicular to the cylinder block mating surface. In this case, in a cross section including a central axis of the head bolt insertion hole and perpendicular to the longitudinal direction, the first coolant flow passage may be provided to pass through a region closer to the cylinder head longitudinal direction central flat plane with respect to the head bolt insertion hole. According to this configuration, the first coolant flow passage is prevented from passing at a high position in the height direction of the cylinder head so that no air pocket occurs in the first coolant flow passage.

In the multi-cylinder engine, the first coolant flow passage and the second coolant flow passage may be independent of each other in the cylinder head. "independent of each other in the cylinder head" means that the first coolant flow passage and the second coolant flow passage do not communicate with each other at least in the cylinder head. According to this configuration, the temperature of the coolant flowing in the first coolant flow passage can be made distinctly lower than that of the coolant flowing in the second coolant flow passage. A coolant circulation system including the first coolant flow passage and a coolant circulation system including the second coolant flow passage may be formed as separate systems.

In the multi-cylinder engine, the first coolant flow passage may communicate with a first hole opened in one end face in the longitudinal direction of the cylinder head, and the first coolant flow passage may communicate with a second hole opened in the other end face in the longitudinal direction of the cylinder head. "end face in the longitudinal direction" is a surface forming an end in the longitudinal direction and may be a flat surface or an uneven surface. When the first coolant flow passage is formed by a sand core, holes (sand removing holes) are formed in both end faces in the longitudinal direction by core supports supporting the sand core. The first hole and the second hole can be these holes formed by the core supports. One of the first and second holes can be used as a coolant inlet, while the other can be used as a coolant outlet.

In the multi-cylinder engine, the first coolant flow passage may communicate with a first hole opened in an end face in the longitudinal direction of the cylinder head, and the first coolant flow passage may communicate with a second hole opened in an end face in the width direction of the cylinder head. "end face in the width direction" is a surface forming an end in the width direction and may be a flat surface or an uneven surface. When the first coolant flow passage is formed by a sand core, holes are formed in both end faces in the longitudinal direction by core supports supporting the sand core. One of these holes in both end faces may be left as the first hole, while the other hole may be sealed. One of the first and second holes can be used as a coolant inlet, while the other can be used as a coolant outlet.

In the multi-cylinder engine, the first coolant flow passage may communicate with a first hole opened in an end face in the longitudinal direction of the cylinder head, and the first coolant flow passage may communicate with a second hole opened in the cylinder block mating surface. Holes are formed in both end faces in the longitudinal direction by core supports supporting a sand core. One of these holes in both end faces may be left as the first hole, while the other hole may be sealed. The first coolant flow passage may be connected to the second hole via a communication passage provided between the two intake ports communicating with the adjacent two combustion chambers. The first coolant flow passage may be connected to the second hole via a communication passage provided between at least one of end faces in the longitudinal direction of the cylinder head and the intake port closest to the at least one of end faces. One of the first and second holes can be used as a coolant inlet, while the other can be used as a coolant outlet.

The first coolant flow passage may be configured to communicate with the second coolant flow passage in the cylinder head. In this case, however, it is configured that the coolant having passed through the first coolant flow passage flows into the second coolant flow passage. That is, it is configured that the low-temperature coolant before an increase in temperature due to heat transfer flows in the first coolant flow passage. According to this configuration, the coolant is allowed to flow in the first coolant flow passage and the second coolant flow passage by a single circulation system.

According to the multi-cylinder engine including the cylinder head described above, while suppressing heat transfer from the cylinder block mating surface to the intake ports by the second coolant flow passage located between the cylinder block mating surface and the intake port central line plane, the upper surface sides of the intake ports can be effectively cooled by the first coolant flow passage in which the coolant at a temperature lower than that of the coolant flowing in the second coolant flow passage flows. Accordingly, it is possible to efficiently cool the air flowing in the intake ports.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Figure 1:
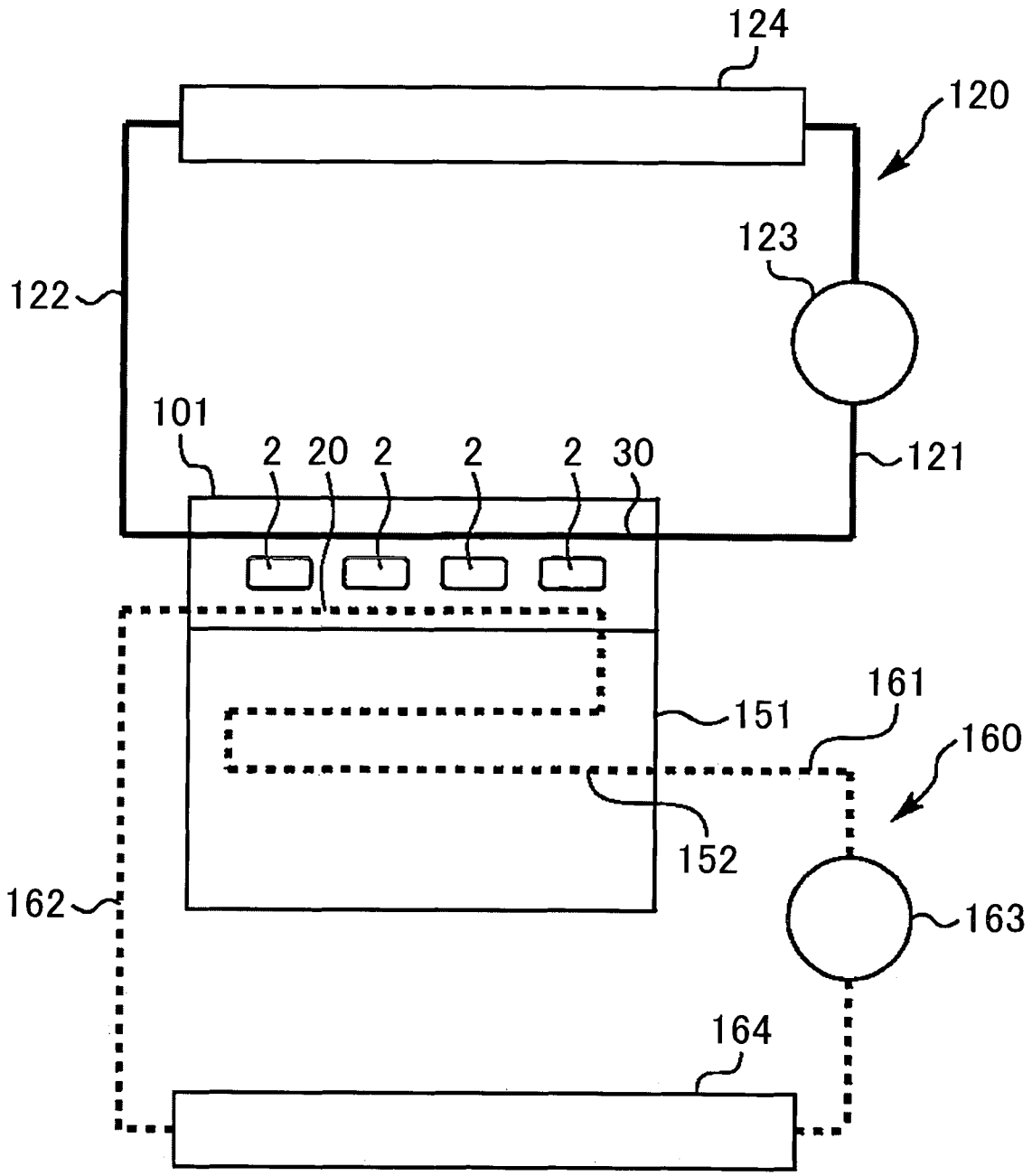
FIG. 1 is a diagram showing a configuration of an engine cooling system according to a first embodiment of the invention.

Referring to the drawings, embodiments of the invention will be described. However, the following embodiments are only intended to show, by way of example, apparatuses and methods for embodying the technical ideas of the invention and, unless otherwise stated, are not intended to limit the structures and arrangements of components, the sequences of processes, and so on to those described below. The invention is not limited to the following embodiments and can be carried out with various changes in a range not departing from its gist.

Hereinbelow, a first embodiment of the invention will be described with reference to the drawings. The premise of the first embodiment is that an engine is a spark-ignition liquid-cooled inline four-cylinder engine. This premise also applies to later-described second to fifth embodiments. However, when applying the invention to an engine, there is no limitation to the number and arrangement of cylinders of the engine and to the ignition system of the engine.

Referring to FIG. 1, the configuration of an engine cooling system according to the first embodiment of the invention will be described. A coolant for cooling an engine is circulated between the engine and a radiator by each of circulation systems. The engine includes a cylinder block 151 and a cylinder head 101 mounted on the cylinder block 151 via a gasket (not shown). The supply of the coolant is carried out for both the cylinder block 151 and the cylinder head 101.

The engine cooling system of the first embodiment includes dual circulation systems 120 and 160. The first circulation system 120 and the second circulation system 160 each form an independent closed loop and each include a radiator 124, 164 and a water pump 123, 163. Each circulation system 120, 160 may further include a liquid temperature sensor and a thermostat for liquid temperature adjustment (neither shown).

The first circulation system 120 includes a first coolant flow passage 30 formed in the cylinder head 101. The cylinder head 101 is formed with a coolant inlet and a coolant outlet each communicating with the first coolant flow passage 30. The coolant inlet of the cylinder head 101 is connected to a coolant outlet of the radiator 124 via a coolant introducing pipe 121, while the coolant outlet of the cylinder head 101 is connected to a coolant inlet of the radiator 124 via a coolant discharge pipe 122. The coolant introducing pipe 121 is provided with the water pump 123.

The second circulation system 160 includes a second coolant flow passage 20 formed in the cylinder head 101 and a third coolant flow passage 152 formed in the cylinder block 151. The third coolant flow passage 152 of the cylinder block 151 includes a water jacket surrounding cylinders. The second coolant flow passage 20 of the cylinder head 101 and the third coolant flow passage 152 of the cylinder block 151 are connected to each other via an opening formed in a mating surface between the cylinder head 101 and the cylinder block 151. The cylinder block 151 is formed with a coolant inlet communicating with the third coolant flow passage 152, while the cylinder head 101 is formed with a coolant outlet communicating with the second coolant flow passage 20. The coolant inlet of the cylinder block 151 is connected to a coolant outlet of the radiator 164 via a coolant introducing pipe 161, while the coolant outlet of the cylinder head 101 is connected to a coolant inlet of the radiator 164 via a coolant discharge pipe 162. The coolant introducing pipe 161 is provided with the water pump 163.

The cylinder head 101 is formed with four intake ports 2 for four cylinders. When the cylinder head 101 is located on an upper side in the vertical direction with respect to the cylinder block 151, the first coolant flow passage 30 is provided to be located on upper sides of the intake ports 2. The second coolant flow passage 20 is provided so that at least part thereof is located on lower sides of the intake ports 2.

In this specification, hereinbelow, unless otherwise stated, the positional relationship between components will be described assuming that the cylinder head 101 is located on the upper side in the vertical direction with respect to the cylinder block 151. This assumption is only for the purpose of facilitating understanding of a description and does not give any limitative meaning to the configuration of a cylinder head according to the invention. The configuration of the cylinder head 101, particularly the configurations of the first coolant flow passage 30 and the second coolant flow passage 20, will be described later.

According to the configuration shown in FIG. 1, liquid temperature adjustments can be carried out independently by the two circulation systems 120 and 160. Specifically, it is set that the temperature of the coolant that flows in the first coolant flow passage 30 is equal to that of the coolant that flows in the second coolant flow passage 20 at the time of cold engine start-up and that as warming-up of the engine progresses, the temperature of the coolant that flows in the first coolant flow passage 30 becomes lower than that of the coolant that flows in the second coolant flow passage 20. Since the coolant that flows in the second coolant flow passage 20 is the coolant having passed through the inside of the cylinder block 151, its temperature has risen higher than that of the coolant at the coolant inlet of the cylinder block 151. Therefore, according to the configuration shown in FIG. 1, even if the temperatures of the coolants when exiting the radiators 124 and 164 are equal to each other, when the coolants have reached the cylinder head 101, the temperature of the coolant that flows in the second coolant flow passage 20 becomes higher than that of the coolant that flows in the first coolant flow passage 30. In other words, the coolant that flows in the first coolant flow passage 30 is maintained at a temperature lower than that of the coolant that flows in the second coolant flow passage 20.

Next, the basic configuration of the cylinder head 101 of the first embodiment will be described. The description will be made using a plan view and cross-sectional views of the cylinder head 101. Herein, the basic configuration is a configuration other than the configurations of the first coolant flow passage 30 and the second coolant flow passage 20 which are one of features of the invention. The configurations of the first coolant flow passage 30 and the second coolant flow passage 20 will be described in detail after clarifying the basic configuration.

Figure 2:
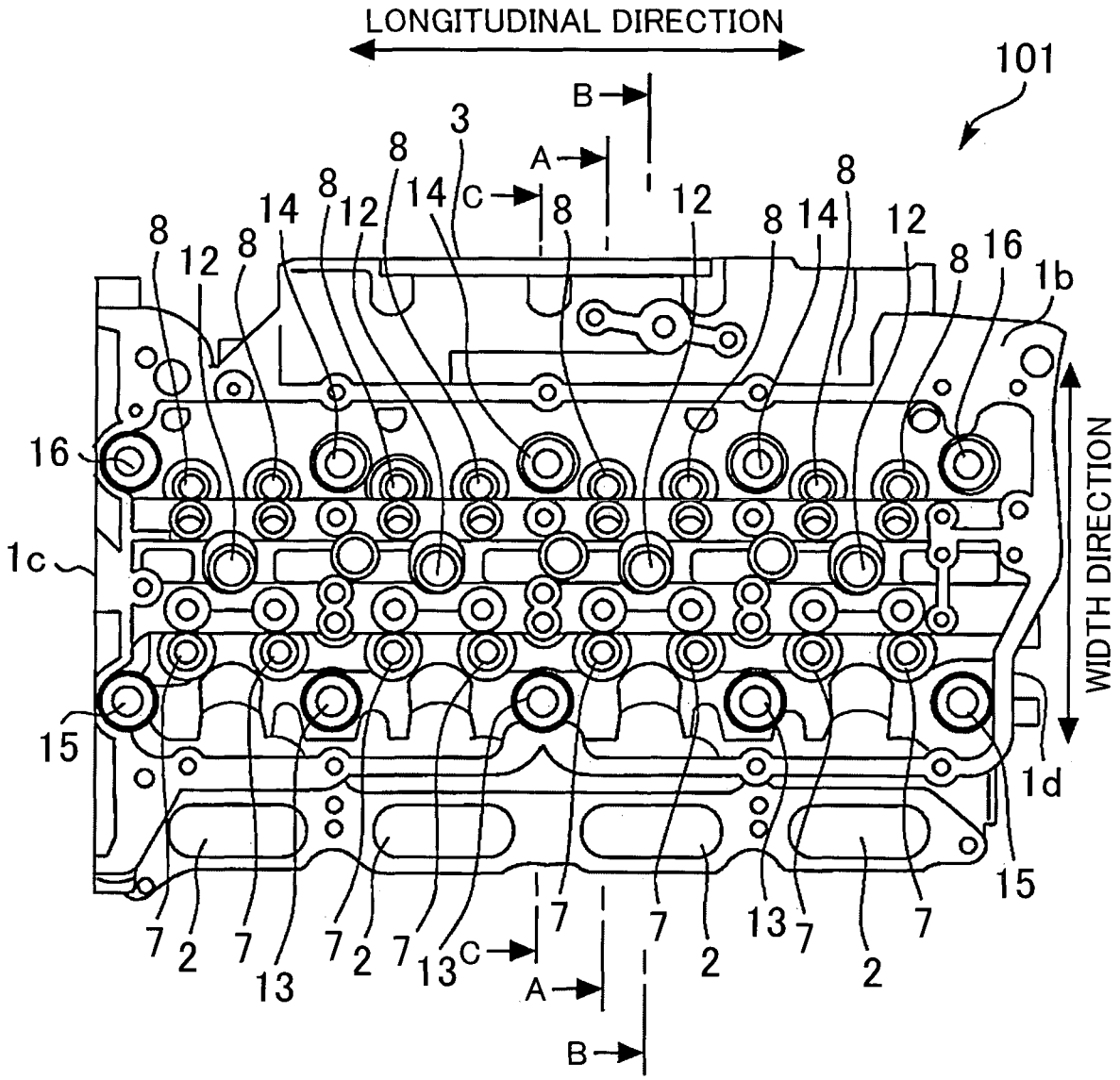
FIG. 2 is a plan view of a cylinder head of the first embodiment of the invention.

Hereinbelow, the basic configuration of the cylinder head of the first embodiment will be described. FIG. 2 is a plan view of the cylinder head 101 of the first embodiment. Specifically, FIG. 2 is a plan view of the cylinder head 101 as seen from the side of its head cover attaching surface 1*b* to which a head cover is attached. Therefore, in FIG. 2, a cylinder block mating surface, as a back surface, of the cylinder head 101 is not seen. In this specification, as described before, an axial direction of a crankshaft is defined as a longitudinal direction of the cylinder head 101, while a direction perpendicular to the longitudinal direction and parallel to the cylinder block mating surface of the cylinder head 101 is defined as a width direction of the cylinder head 101. Of end faces 1*c* and 1*d* in the longitudinal direction, the end face 1*d* on the output end side of the crankshaft will be referred to as a "rear end face", while the end face 1*c* on the opposite side thereof will be referred to as a "front end face".

The cylinder head 101 of the first embodiment is a cylinder head of a spark-ignition inline four-cylinder engine. Although not shown in FIG. 1, four combustion chambers for four cylinders are formed side by side at regular intervals in an inline configuration in the longitudinal direction in the lower surface (the mating surface with the cylinder block) of the cylinder head 101. The cylinder head 101 is formed with spark plug insertion holes 12 for the respective combustion chambers.

The intake ports 2 and exhaust ports 3 are opened at side surfaces of the cylinder head 101. Specifically, the intake ports 2 are opened at the right side surface of the cylinder head 101 as seen from the front end face 1*c* side, while the exhaust ports 3 are opened at the left side surface. Hereinafter, in this specification, the side surface located on the right side as seen from the front end face 1*c* side of the cylinder head 101 will be referred to as a "right side surface" of the cylinder head 101, while the side surface located on the left side will be referred to as a "left side surface" of the cylinder head 101. The intake ports 2 extend from the respective combustion chambers and are independently opened at the right side surface of the cylinder head 101. The exhaust ports 3 are joined into a single exhaust port 3 inside the cylinder head 101 and this collective single exhaust port 3 is opened at the left side surface of the cylinder head 101. In this regard, hereinafter, the exhaust ports 3 along with the collective single exhaust port 3 may be collectively referred to as an "exhaust port 3" where appropriate. Accordingly, in this specification, the right side as seen from the front end face 1*c* side of the cylinder head 101 may be referred to as an "intake side", while the left side may be referred to as an "exhaust side".

The cylinder head 101 of the first embodiment is a cylinder head of a four-valve engine in which two intake valves and two exhaust valves are provided for each cylinder. The cylinder head 101 is formed in its upper surface with two intake valve insertion holes 7 and two exhaust valve insertion holes 8 surrounding each spark plug insertion hole 12. The intake valve insertion holes 7 communicate with the intake ports 2 in the cylinder head 101, while the exhaust valve insertion holes 8 communicate with the exhaust ports 3 in the cylinder head 101.

Head bolt insertion holes 13, 14, 15, and 16 for insertion of head bolts for attaching the cylinder head 101 to the cylinder block are formed on the inner side of the head cover attaching surface 1*b*. The head bolts are provided in the number of 5 on each of the left and right sides with respect to the row of the combustion chambers. On the intake side, each of the head bolt insertion holes 13 is formed between the adjacent two intake ports 2 and the head bolt insertion holes 15 are respectively formed between the front end face 1*c* and the intake port 2 closest thereto and between the rear end face 1*d* and the intake port 2 closest thereto. On the exhaust side, the head bolt insertion holes 14 are respectively formed at the crotches of the exhaust ports 3 branching to the combustion chambers and the head bolt insertion holes 16 are respectively formed between the front end face 1*c* and the exhaust port 3 and between the rear end face 1*d* and the exhaust port 3.

Next, the configuration of the inside of the cylinder head 101 of the first embodiment will be described with reference to the cross-sectional views. Cross sections of the cylinder head 101 to pay attention are a cross section, including a central axis of the intake valve insertion hole 7 and perpendicular to the longitudinal direction, of the cylinder head 101 (A-A cross section of FIG. 2), a cross section, including a central axis of the combustion chamber and perpendicular to the longitudinal direction, of the cylinder head 101 (B-B cross section of FIG. 2), and a cross section, passing between the adjacent two combustion chambers and perpendicular to the longitudinal direction, of the cylinder head 101 (C-C cross section of FIG. 2).

Figure 3:
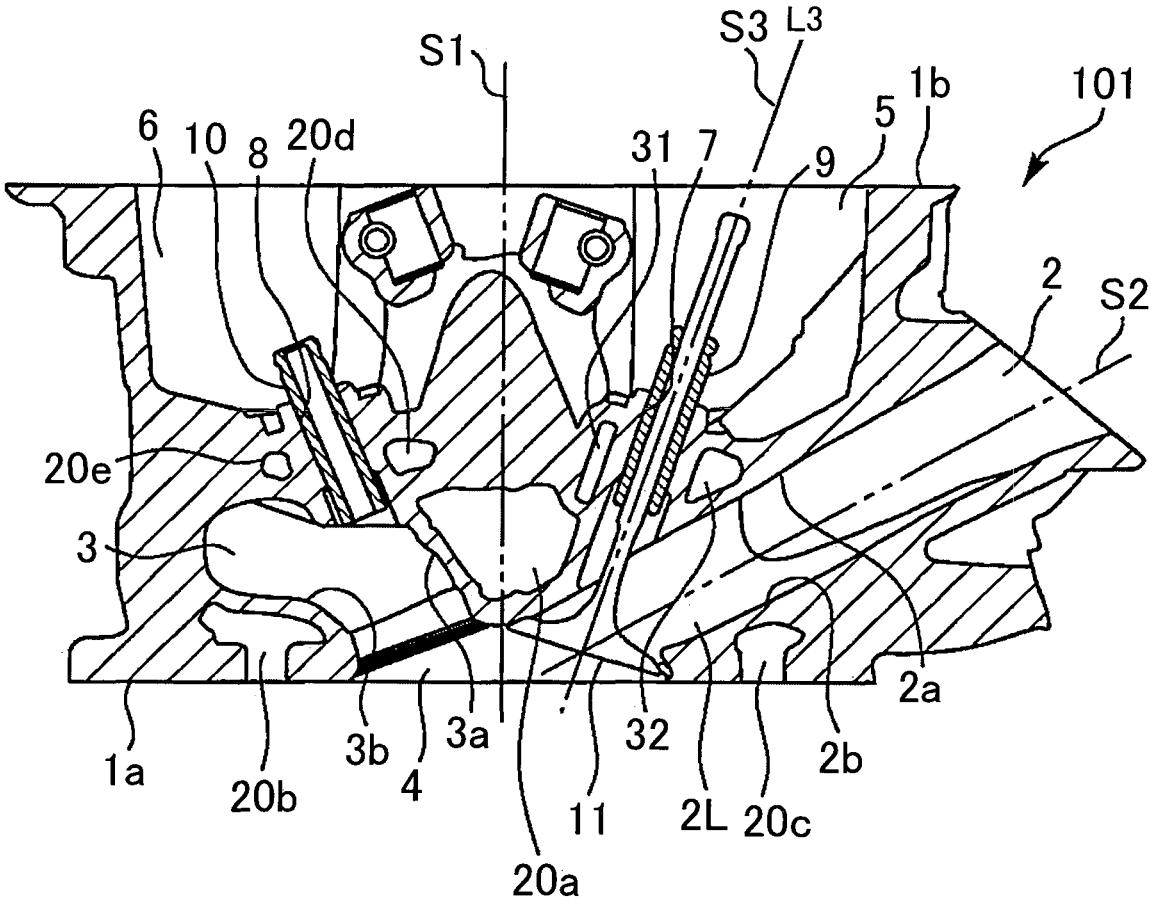
FIG. 3 is a cross-sectional view, taken along line A-A of FIG. 2, showing a cross section, including a central axis of an intake valve insertion hole and perpendicular to a longitudinal direction, of the cylinder head of the first embodiment of the invention.

Hereinbelow, the basic configuration of the cylinder head as seen in the cross section including the central axis of the intake valve insertion hole and perpendicular to the longitudinal direction will be described. FIG. 3 is a cross-sectional view showing a cross section, including a central axis of the intake valve insertion hole 7 and perpendicular to the longitudinal direction, of the cylinder head 101 (A-A cross section of FIG. 2). FIG. 3 shows a state where an intake valve 11 is disposed in the cylinder head 101. As shown in FIG. 3, a cylinder block mating surface 1*a* as a lower surface of the cylinder head 101 is formed with a pent-roof shaped combustion chamber 4. When the cylinder head 101 is mounted on the cylinder block, the combustion chamber 4 closes the cylinder from above to form a closed space. When a closed space sandwiched between the cylinder head 101 and a piston is defined as a combustion chamber, the combustion chamber 4 can be called a combustion chamber ceiling surface.

The intake port 2 is opened at an inclined surface, on the right side as seen from the front end side of the cylinder head 101, of the combustion chamber 4. A connecting portion between the intake port 2 and the combustion chamber 4, i.e. an open end on the combustion chamber side of the intake port 2, serves as an intake opening that is configured to be opened and closed by the intake valve 11. Since two intake valves 11 are provided for each cylinder, each combustion chamber 4 is formed with two intake openings of the intake port 2. An inlet of the intake port 2 is opened in the right side surface of the cylinder head 101. The intake port 2 extends obliquely downward to the left from an opening of the inlet and branches into two ports on the way and these two branch ports respectively communicate with the intake openings formed in the combustion chamber 4. In FIG. 3, there is shown a branch port 2L on the engine front end side in the longitudinal direction. The intake port 2 is a tumble flow generating port that can generate a tumble flow in the cylinder.

The cylinder head 101 is formed with the intake valve insertion hole 7 for passing a stem of the intake valve 11 therethrough. In the upper surface of the cylinder head 101 on the inner side of the head cover attaching surface 1*b*, there is provided an intake-side valve drive mechanism chamber 5 that receives therein a valve drive mechanism configured to drive the intake valves 11. The intake valve insertion hole 7 extends straight obliquely upward to the right from an upper surface, near the combustion chamber 4, of the intake port 2 to the intake-side valve drive mechanism chamber 5. A valve guide 9 for supporting the stem of the intake valve 11 is press-fitted into the intake valve insertion hole 7. A central axis L3 of the intake valve insertion hole 7 is included in the cross section shown in FIG. 3, i.e. in a flat plane perpendicular to the longitudinal direction.

The exhaust port 3 is opened at an inclined surface, on the left side as seen from the front end side of the cylinder head 101, of the combustion chamber 4. A connecting portion between the exhaust port 3 and the combustion chamber 4, i.e. an open end on the combustion chamber side of the exhaust port 3, serves as an exhaust opening that is configured to be opened and closed by an exhaust valve (the exhaust valve is not shown in FIG. 3). Since two exhaust valves are provided for each cylinder, each combustion chamber 4 is formed with two exhaust openings of the exhaust port 3. The exhaust port 3 has a manifold shape having eight inlets (exhaust openings) respectively provided for the exhaust valves of the combustion chambers 4 and one outlet that is opened in the left side surface of the cylinder head 101. The outlet of the exhaust port 3 is not located in the cross section shown in FIG. 3.

The cylinder head 101 is formed with the exhaust valve insertion hole 8 for passing a stem of the exhaust valve therethrough. In the upper surface of the cylinder head 101 on the inner side of the head cover attaching surface 1*b*, there is provided an exhaust-side valve drive mechanism chamber 6 that receives therein a valve drive mechanism configured to drive the exhaust valves. The exhaust valve insertion hole 8 extends straight obliquely upward to the left from an upper surface, near the combustion chamber 4, of the exhaust port 3 to the exhaust-side valve drive mechanism chamber 6. A valve guide 10 for supporting the stem of the exhaust valve is press-fitted into the exhaust valve insertion hole 8.

Figure 4:
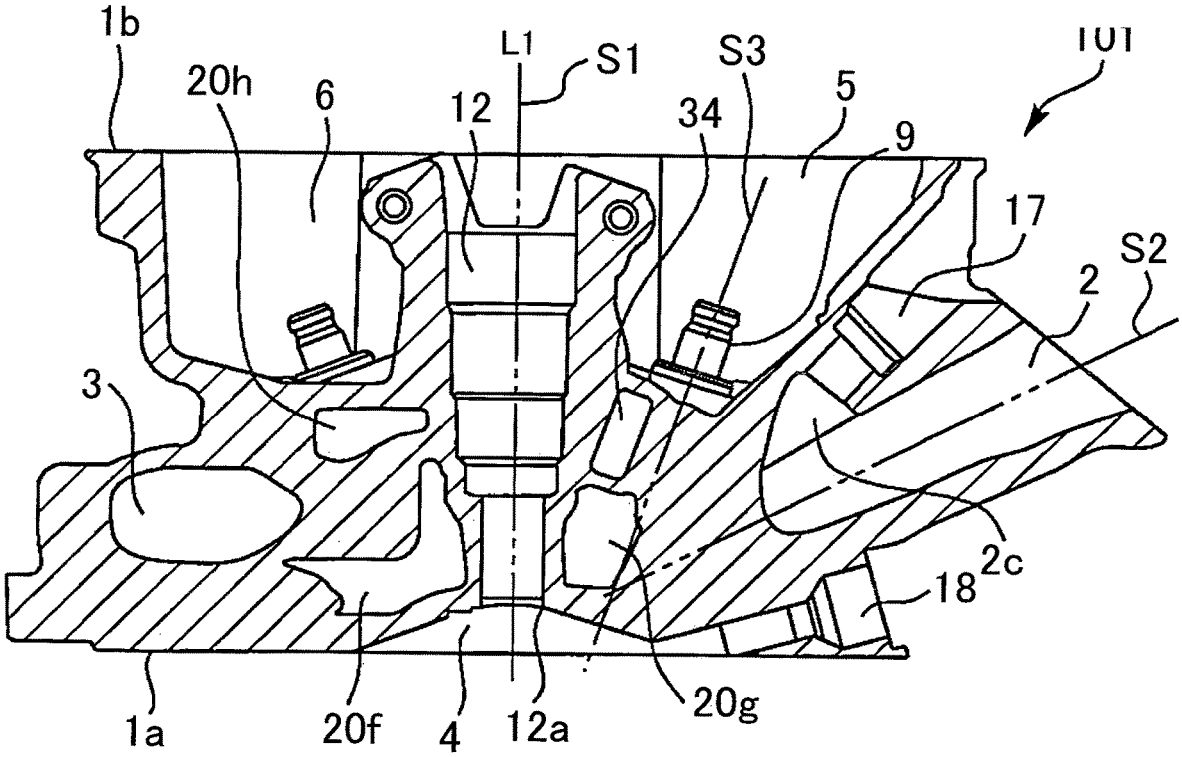
FIG. 4 is a cross-sectional view, taken along line B-B of FIG. 2, showing a cross section, including a central axis of a combustion chamber and perpendicular to the longitudinal direction, of the cylinder head of the first embodiment of the invention.

Next, the basic configuration of the cylinder head as seen in the cross section including the central axis of the combustion chamber and perpendicular to the longitudinal direction will be described. FIG. 4 is a cross-sectional view showing a cross section, including a central axis L1 of the combustion chamber 4 and perpendicular to the longitudinal direction, of the cylinder head 101 (B-B cross section of FIG. 2). The cylinder head 101 is formed with the spark plug insertion hole 12 for attaching a spark plug. The spark plug insertion hole 12 is opened to a top portion of the pent-roof shaped combustion chamber 4. The central axis L1 of the combustion chamber 4 coincides with a central axis of the cylinder when the cylinder head 101 is mounted on the cylinder block.

The intake port 2 shown in FIG. 4 is a portion thereof upstream of its branching portion. The two branch ports downstream of the branching portion are respectively located on both sides of a flat plane including the central axis L1 of the combustion chamber 4 and perpendicular to the longitudinal direction and thus are not included in the cross section shown in FIG. 4. In the cross section shown in FIG. 4, part of the exhaust port 3 having the manifold shape is seen.

A port injector insertion hole 17 for attaching a port injector is formed in the side surface of the cylinder head 101 on an upper side with respect to the intake port 2. A central axis of the port injector insertion hole 17 is located in the flat plane including the central axis L1 of the combustion chamber 4 and perpendicular to the longitudinal direction. The port injector insertion hole 17 crosses the intake port 2 at an acute angle and is opened to a port injector attaching portion 2*c* formed convex upward on an upper surface of the branching portion of the intake port 2. The port injector (not shown) inserted into the port injector insertion hole 17 exposes its nozzle tip from the port injector attaching portion 2*c* and injects fuel into the intake port 2.

An in-cylinder direct-injection injector insertion hole 18 for attaching an in-cylinder direct-injection injector is formed in the side surface of the cylinder head 101 on a lower side with respect to the intake port 2. A central axis of the in-cylinder direct-injection injector insertion hole 18 is located in the flat plane including the central axis L1 of the combustion chamber 4 and perpendicular to the longitudinal direction. The in-cylinder direct-injection injector insertion hole 18 is opened to the combustion chamber 4. The in-cylinder direct-injection injector (not shown) inserted into the in-cylinder direct-injection injector insertion hole 18 injects fuel directly into the cylinder.

Figure 5:
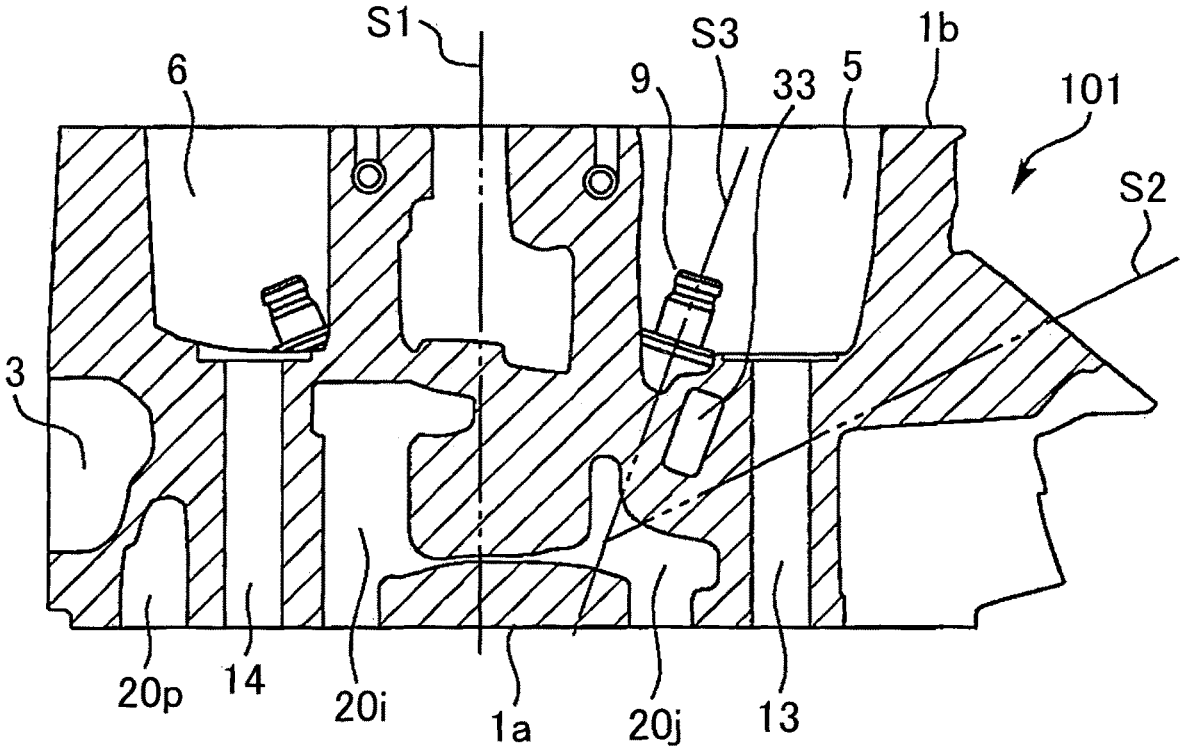
FIG. 5 is a cross-sectional view, taken along line C-C of FIG. 2, showing a cross section, passing between adjacent two combustion chambers and perpendicular to the longitudinal direction, of the cylinder head of the first embodiment of the invention.

Next, the basic configuration of the cylinder head as seen in the cross section passing between the adjacent two combustion chambers and perpendicular to the longitudinal direction will be described. FIG. 5 is a cross-sectional view showing a cross section, passing between the adjacent two combustion chambers and perpendicular to the longitudinal direction, of the cylinder head 101 (C-C cross section of FIG. 2). The cylinder head 101 is formed with the intake-side head bolt insertion hole 13 extending vertically downward from the intake-side valve drive mechanism chamber 5 and is formed with the exhaust-side head bolt insertion hole 14 extending vertically downward from the exhaust-side valve drive mechanism chamber 6. The head bolt insertion holes 13 and 14 are perpendicular to the cylinder block mating surface 1*a* and opened at the cylinder block mating surface 1*a*. The cross section shown in FIG. 5 is a cross section including central axes of the head bolt insertion holes 13 and 14 and perpendicular to the longitudinal direction.

In the cross section shown in FIG. 5, the collective portion of the exhaust port 3 having the manifold shape is seen. The collective portion of the manifold-shaped exhaust port 3 is opened at the left side surface of the cylinder head 101. The exhaust ports 3 are joined into one inside the cylinder head 101 in a manner to avoid the head bolt insertion holes 14.

Next, the configurations of the coolant flow passages of the cylinder head 101 of the first embodiment will be described. The description will be made using the cross-sectional views of the cylinder head 101 and a perspective view showing the coolant flow passage inside the cylinder head 101 in a see-through manner.

Hereinbelow, the configurations of the coolant flow passages of the cylinder head of the first embodiment will be described. First, before describing the configurations of the coolant flow passages of the cylinder head, reference planes of the cylinder head for use in the description will be defined herein. In this specification, four reference planes are defined. The reference planes defined herein also apply to later-described second to fifth embodiments.

1. Cylinder Block Mating Surface (First Reference Plane) The cylinder block mating surface 1*a* shown in FIGS. 3, 4, and 5 is a first reference plane. When the cylinder head 101 is mounted on the cylinder block, the cylinder block mating surface 1*a* is a flat plane perpendicular to the central axes of the cylinders of the cylinder block.

2. Cylinder Head Longitudinal Direction Central Flat Plane (Second Reference Plane) FIG. 4 shows the central axis L1 of the combustion chamber 4. A second reference plane is a virtual flat plane including the central axes L1 of the combustion chambers 4 and parallel to the longitudinal direction. This flat plane will be referred to as a "cylinder head longitudinal direction central flat plane". In FIGS. 3 and 5, a cylinder head longitudinal direction central flat plane S1 is shown by a virtual line. In the cross section shown in FIG. 4, the cylinder head longitudinal direction central flat plane S1 overlaps the central axis L1 of the combustion chamber 4. When the cylinder head 101 is mounted on the cylinder block, the cylinder head longitudinal direction central flat plane S1 is a flat plane including the central axes of the cylinders of the cylinder block.

3. Intake Port Central Line Plane (Third Reference Plane) In FIGS. 3, 4, and 5, there is shown a virtual line denoted by symbol S2. This virtual line represents an intake port central line plane as a third reference plane. The intake port central line plane is a virtual plane defined as a plane including central lines of the intake ports 2. Hereinbelow, referring to FIGS. 8 to 11, the central line of the intake port 2 and the intake port central line plane will be described in detail.

Figure 9:
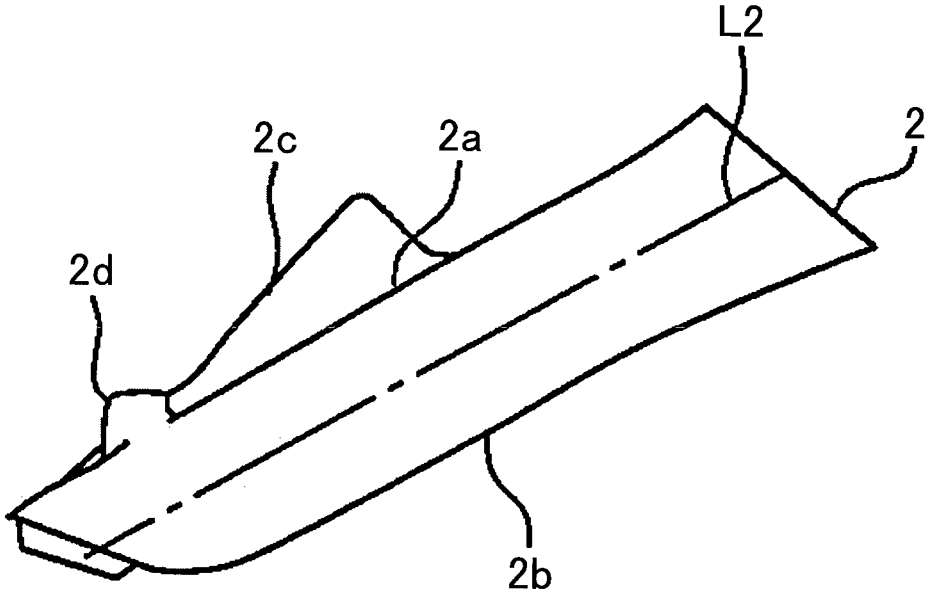
FIG. 9 is a side view showing the intake port of the cylinder head of the first embodiment of the invention and a central line thereof.

FIG. 9 is a side view showing the intake port 2 of the cylinder head of the first embodiment and a central line L2 thereof. FIG. 9 shows the shape of the intake port 2 when seen from the front end side of the cylinder head assuming the inside of the cylinder head to be transparent. The central line L2 is defined as a line passing through the centers of cross sections each taken perpendicular to a flow direction of the intake port 2. Accordingly, in FIG. 9, the distance from an upper surface 2*a* of the intake port 2 to the central line L2 is equal to the distance from a lower surface 2*b* of the intake port 2 to the central line L2. In the first embodiment, since the intake port 2 extends substantially straight from its inlet to its intake openings, the central line L2 is also shown in a straight line in a projection plane (flat plane perpendicular to the longitudinal direction of the cylinder head). The port injector attaching portion 2*c* for attaching the port injector and an intake valve insertion portion 2*d* into which the stem of the intake valve is inserted are formed convex upward on the upper surface 2*a* of the intake port 2. These convex portions do not need to be taken into account when calculating the position of the central line L2.

Figure 8:
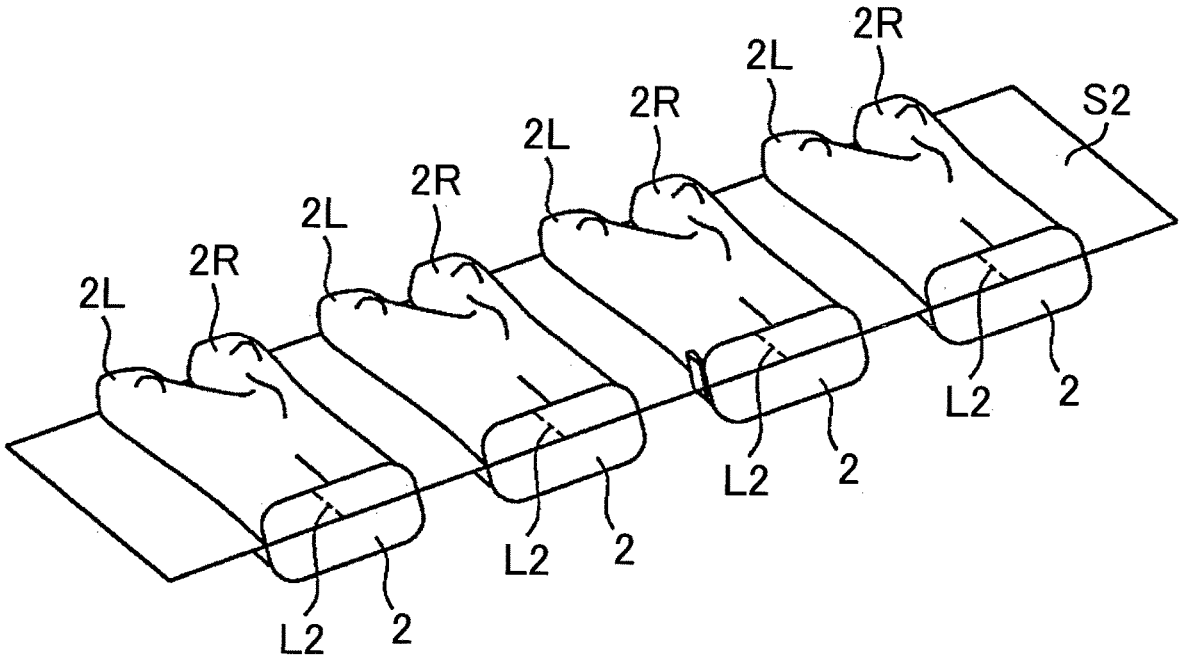
FIG. 8 is a perspective view showing the intake ports of the cylinder head of the first embodiment of the invention and an intake port central line plane thereof.

FIG. 8 is a perspective view showing the intake ports 2 of the cylinder head of the first embodiment and the intake port central line plane S2 thereof. FIG. 8 shows the shape of the intake ports 2 and the positional relationship between the intake ports 2 and the intake port central line plane S2 when seen assuming the inside of the cylinder head to be transparent. From FIG. 8, it is seen that the intake port 2 branches into two branch ports 2L and 2R on the way. Although not shown, the central line L2 also branches into two central lines inside the intake port 2 and these two branched central lines respectively pass through the centers of cross sections of the branch ports 2L and 2R. The central lines L2 become a straight line when projected on the flat plane perpendicular to the longitudinal direction of the cylinder head. Accordingly, the intake port central line plane S2 including those central lines L2 is given by a flat plane that is perpendicular to the flat plane perpendicular to the longitudinal direction of the cylinder head. Of a wall surface forming the intake port 2, a surface located on the cylinder head longitudinal direction central flat plane S1 side with respect to the intake port central line plane S2 will be referred to as an "upper surface", while a surface located on the cylinder block mating surface 1*a* side with respect to the intake port central line plane S2 will be referred to as a "lower surface".

Figure 11:
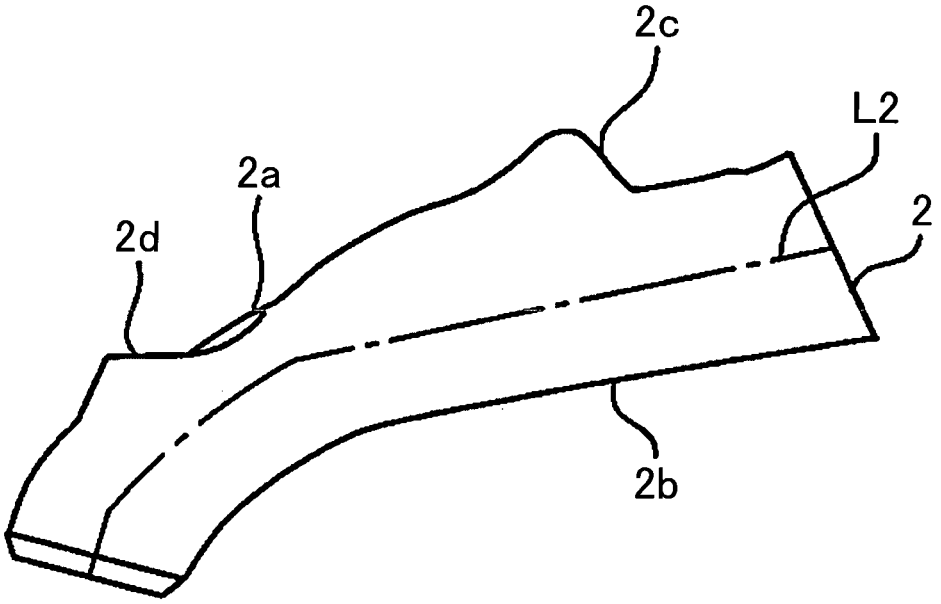
FIG. 11 is a side view showing the modification of the intake port and a central line thereof.

FIG. 11 is a side view showing a modification of the intake port 2 and a central line L2 thereof. The same symbols as those in the first embodiment are assigned to respective portions of the modification. In this modification, the intake port 2 has a shape that extends straight from its inlet to part of the way and then gradually curves vertically downward toward its intake openings. Accordingly, in a projection plane (flat plane perpendicular to the longitudinal direction of the cylinder head), the central line L2 is shown in a straight line from the inlet of the intake port 2 to part of the way and then in a curved line that gradually curves vertically downward toward the intake openings of the intake port 2.

Figure 10:
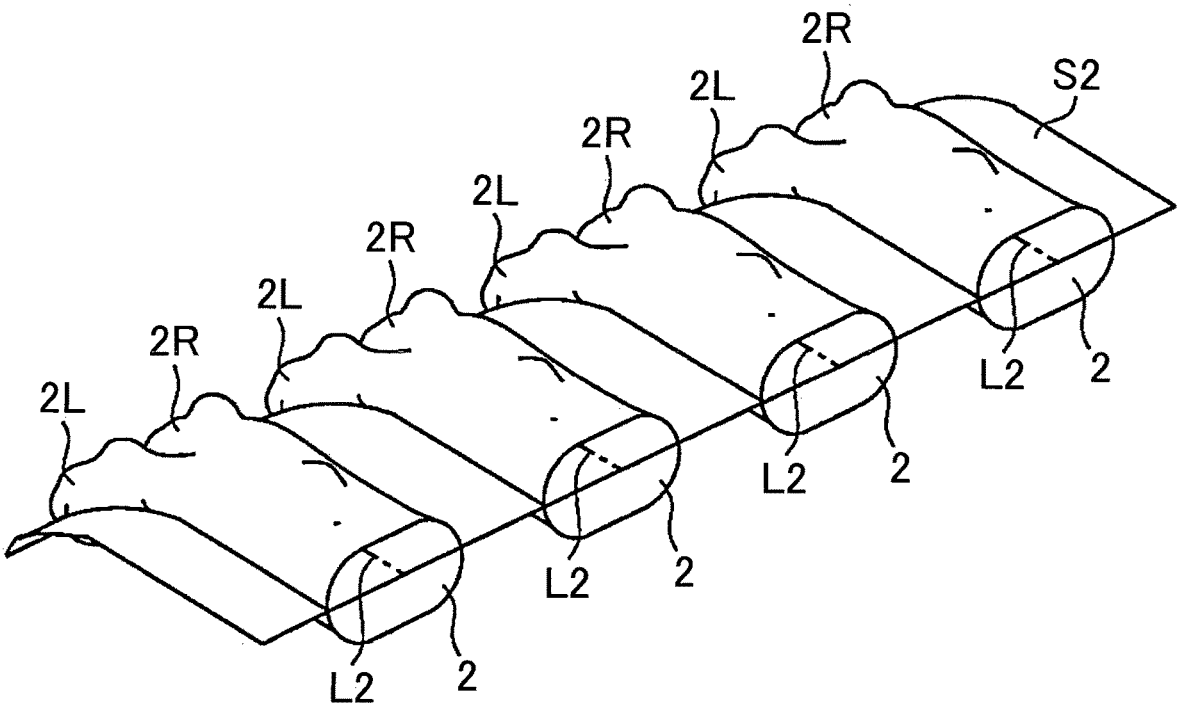
FIG. 10 is a perspective view showing a modification of the intake ports and an intake port central line plane thereof.

FIG. 10 is a perspective view showing the modification of the intake ports 2 and an intake port central line plane S2 thereof. From FIG. 10, it is seen that the intake port 2 has a straight shape until it branches into two branch ports 2L and 2R on the way, and then curves at the respective branch ports 2L and 2R. The intake port central line plane S2 in this modification is given by a flat plane and a curved plane corresponding to the shape of the intake ports 2. Accordingly, the intake port central line plane S2 is not necessarily a flat plane and may be given by a plane in a combination of a flat plane and a curved plane or by a plurality of curved planes with different curvatures depending on the shape of the intake ports 2.

4. Intake Valve Insertion Hole Central Axis Plane (Fourth Reference Plane) FIG. 3 shows the central axis L3 of the intake valve insertion hole 7. The central axis L3 of the intake valve insertion hole 7 is also a central axis of the intake valve 11. A fourth reference plane is a virtual flat plane including the central axes L3 of the intake valve insertion holes 7 and parallel to the longitudinal direction. This flat plane will be referred to as an "intake valve insertion hole central axis plane". In FIGS. 4 and 5, an intake valve insertion hole central axis plane S3 is shown by a virtual line. In the cross section shown in FIG. 3, the intake valve insertion hole central axis plane S3 overlaps the central axis L3 of the intake valve insertion hole 7.

Figure 13:
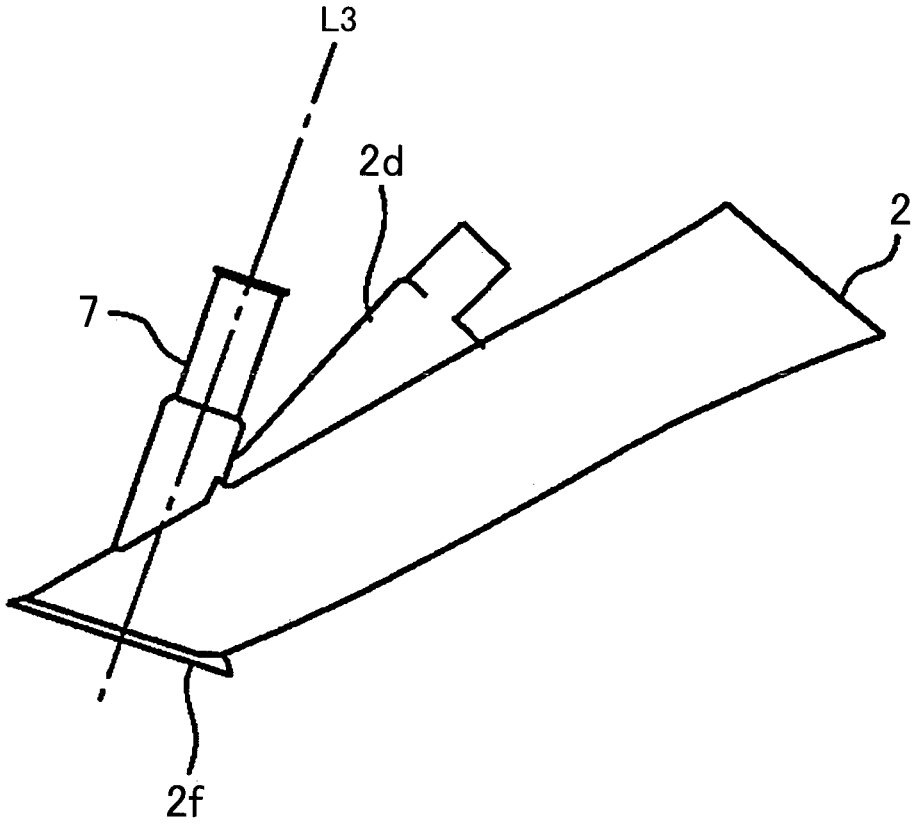
FIG. 13 is a side view showing the intake port and the intake valve insertion hole along with its central axis of the cylinder head of the first embodiment of the invention.

FIG. 13 is a side view showing the intake port 2 and the intake valve insertion hole 7 along with its central axis L3 of the cylinder head of the first embodiment. FIG. 13 shows the shapes of the intake port 2 and the intake valve insertion hole 7 when seen from the front end side of the cylinder head assuming the inside of the cylinder head to be transparent. A ring-shaped valve seat 2*f* is press-fitted into the intake opening of the intake port 2. The central axis L3 of the intake valve insertion hole 7 coincides with a central axis of the valve seat 2*f*.

Figure 12:
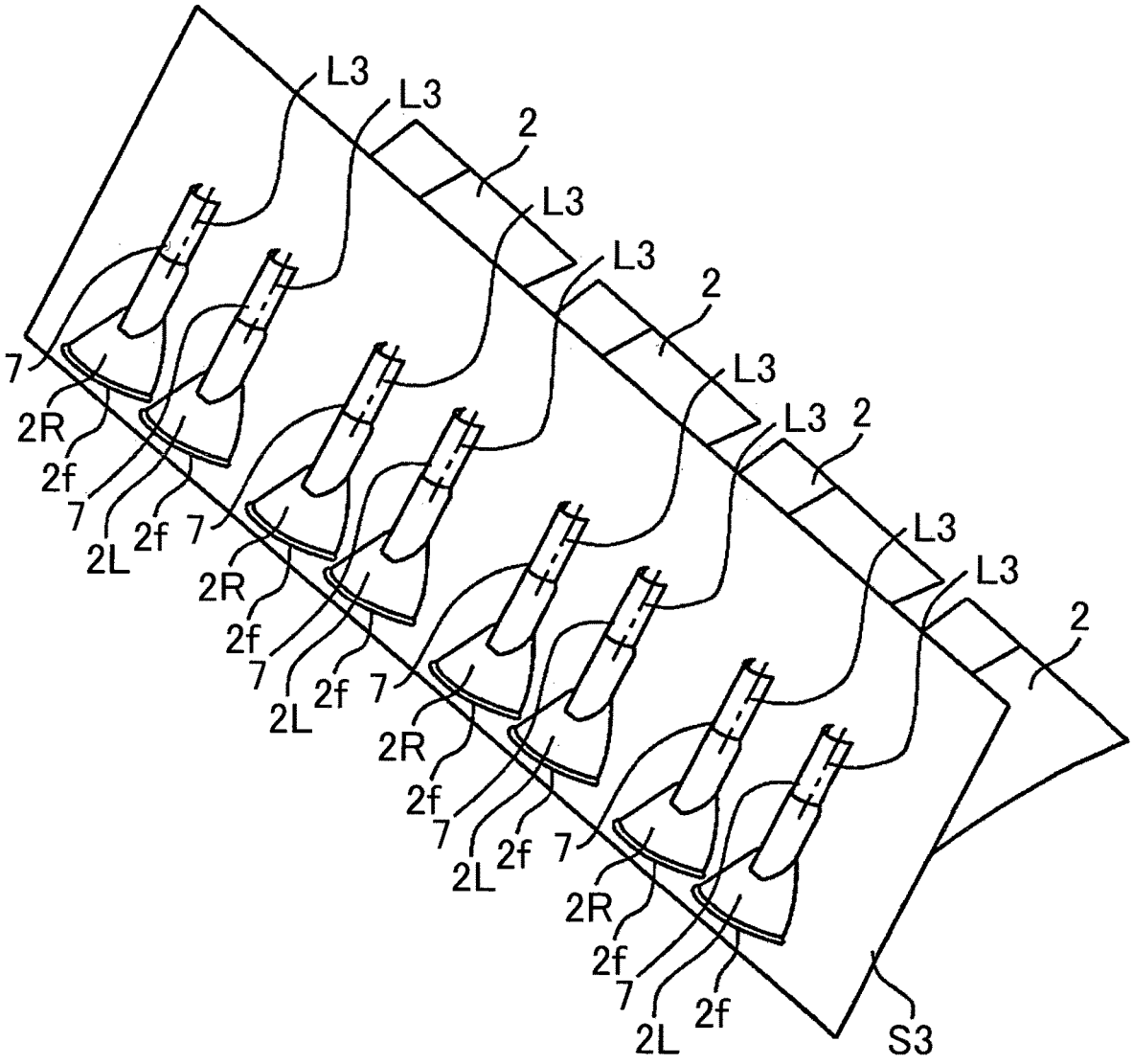
FIG. 12 is a perspective view showing the intake ports and intake valve insertion holes along with an intake valve insertion hole central axis plane thereof of the cylinder head of the first embodiment of the invention.

FIG. 12 is a perspective view showing the intake ports 2 and the intake valve insertion holes 7 along with the intake valve insertion hole central axis plane S3 thereof of the cylinder head of the first embodiment. FIG. 12 shows the shape of forward end portions of the intake ports 2 and the positional relationship between the intake valve insertion holes 7 and the intake valve insertion hole central axis plane S3 when seen assuming the inside of the cylinder head to be transparent. The intake valve insertion hole central axis plane S3 is a flat plane in which the central axes L3 of the intake valve insertion holes 7 of the intake ports 2 are arranged in parallel to each other.

Figure 6:
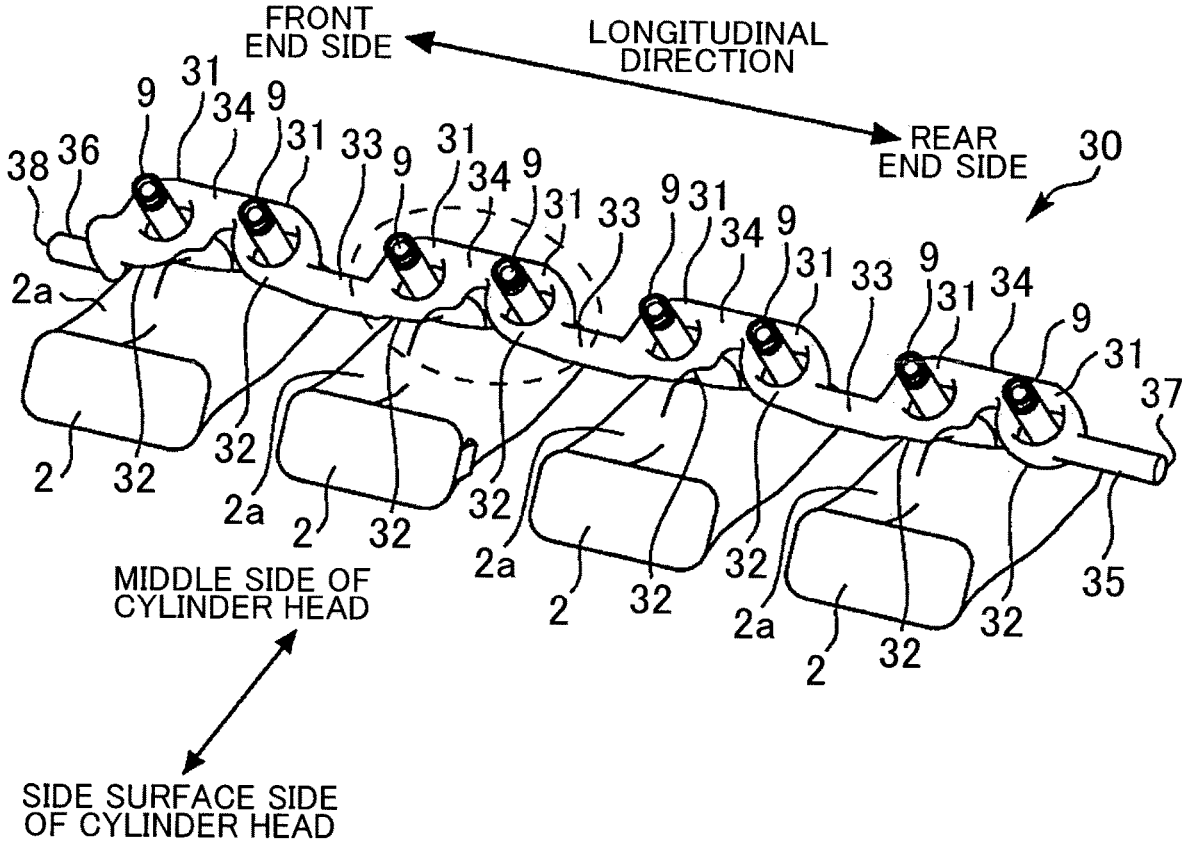
FIG. 6 is a perspective view showing, in a see-through manner, intake ports and a first coolant flow passage of the cylinder head of the first embodiment of the invention.

Next, of the dual coolant flow passages provided in the cylinder head of the first embodiment, the shape of the first coolant flow passage in which the low-temperature coolant flows will be described with reference to FIGS. 6 and 7. FIG. 6 is a perspective view showing, in a see-through manner, the intake ports 2 and the first coolant flow passage 30 of the cylinder head of the first embodiment. FIG. 6 shows the shape of the first coolant flow passage 30 and the positional relationship between the first coolant flow passage 30, the intake ports 2, and the valve guides 9 when seen assuming the inside of the cylinder head to be transparent.

The first coolant flow passage 30 is provided on the upper side of the row of the intake ports 2 in the cylinder head. The first coolant flow passage 30 extends in a direction of the row of the intake ports 2, i.e. in the longitudinal direction of the cylinder head, along the upper surfaces 2*a* of the intake ports 2.

The first coolant flow passage 30 has a unit structure for each intake port 2. In FIG. 6, the structure of a portion encircled by a dotted line is the unit structure of the first coolant flow passage 30. The unit structure includes a pair of annular passages respectively disposed around the left and right valve guides 9 (to be exact, the intake valve insertion holes) of the intake port 2. Each annular passage includes an inner flow passage 31 located on the cylinder head longitudinal direction central flat plane side with respect to the valve guide 9 and an outer flow passage 32 located on the side surface side of the cylinder head with respect to the valve guide 9. The inner flow passage 31 and the outer flow passage 32 are each a flow passage curved in an arc and are axially symmetric with respect to the valve guide 9. Further, the inner flow passage 31 and the outer flow passage 32 have substantially the same flow passage cross-sectional area.

The unit structure includes a first connecting passage 34 connecting the left and right annular passages each including the inner flow passage 31 and the outer flow passage 32. The first connecting passage 34 is located above a space between the left and right branch ports of the intake port 2 on the middle side of the cylinder head with respect to the valve guides 9. The first connecting passage 34 is a flow passage extending in the longitudinal direction and continuously communicates with the left and right inner flow passages 31. "continuously communicate" means that a direction of flow in the inner flow passage 31 and a direction of flow in the first connecting passage 34 coincide with each other at a connecting position between the inner flow passage 31 and the first connecting passage 34. The outer flow passage 32 communicates with the connecting position between the inner flow passage 31 and the first connecting passage 34.

The first coolant flow passage 30 includes second connecting passages 33 each connecting the adjacent two unit structures. The second connecting passage 33 is located above a space between the adjacent two intake ports 2 on the side surface side of the cylinder head with respect to the valve guides 9. The second connecting passage 33 is a flow passage extending in the longitudinal direction and continuously communicates with the outer flow passages 32 of the adjacent two unit structures. The inner flow passage 31 communicates with a connecting position between the outer flow passage 32 and the second connecting passage 33. In the first coolant flow passage 30, the first connecting passages 34 located on the middle side of the cylinder head with respect to the valve guides 9 and the second connecting passages 33 located on the side surface side of the cylinder head with respect to the valve guides 9 are arranged alternately in the longitudinal direction in a manner to sandwich therebetween the annular passages each including the inner flow passage 31 and the outer flow passage 32.

An inlet flow passage 35 and an outlet flow passage 36 are respectively provided at both end portions in the longitudinal direction of the first coolant flow passage 30. The inlet flow passage 35 extends straight in the longitudinal direction from the annular passage closest to the rear end of the cylinder head to the rear end face of the cylinder head and communicates with a first hole 37 opened in the rear end face. The first hole 37 is the coolant inlet formed in the cylinder head and the coolant introducing pipe of the first circulation system is connected to the first hole 37. The outlet flow passage 36 extends straight in the longitudinal direction from the annular passage closest to the front end of the cylinder head to the front end face of the cylinder head and communicates with a second hole 38 opened in the front end face. The second hole 38 is the coolant outlet formed in the cylinder head and the coolant discharge pipe of the first circulation system is connected to the second hole 38. It may alternatively be configured that the second hole 38 is used as a coolant inlet, while the first hole 37 is used as a coolant outlet, thereby introducing the coolant from the front end side of the cylinder head and discharging the coolant from the rear end side of the cylinder head.

The first coolant flow passage 30 is formed in the cylinder head using a sand core when casting the cylinder head. The sand core for forming the first coolant flow passage 30 is different from a sand core for forming the second coolant flow passage. The inlet flow passage 35 and the outlet flow passage 36 are flow passages that are formed by core supports supporting the sand core from both sides, while the first hole 37 and the second hole 38 are sand removing holes that are formed by removing the core supports. That is, in the cylinder head of the first embodiment, the sand removing holes that are formed when forming the first coolant flow passage 30 by the sand core are used as the coolant inlet and the coolant outlet.

The coolant enters the first coolant flow passage 30 from the first hole 37 as the coolant inlet, passes through the first coolant flow passage 30, and then exits the first coolant flow passage 30 from the second hole 38 as the coolant outlet. On the way, the coolant flows through the annular passages respectively surrounding the valve guides 9 (to be exact, the intake valve insertion holes). The flow passage cross-sectional areas of the inner flow passage 31 and the outer flow passage 32 forming each annular passage are substantially equal to each other and the flow passage lengths from the first connecting passage 34 (or the second connecting passage 33) to the second connecting passage 33 (or the first connecting passage 34) are substantially equal to each other when passing through the inner flow passage 31 and when passing through the outer flow passage 32. Consequently, the coolant flows uniformly through the inner flow passage 31 and the outer flow passage 32 in each annular passage so that the coolant is prevented from staying in the first coolant flow passage 30.

Figure 7:
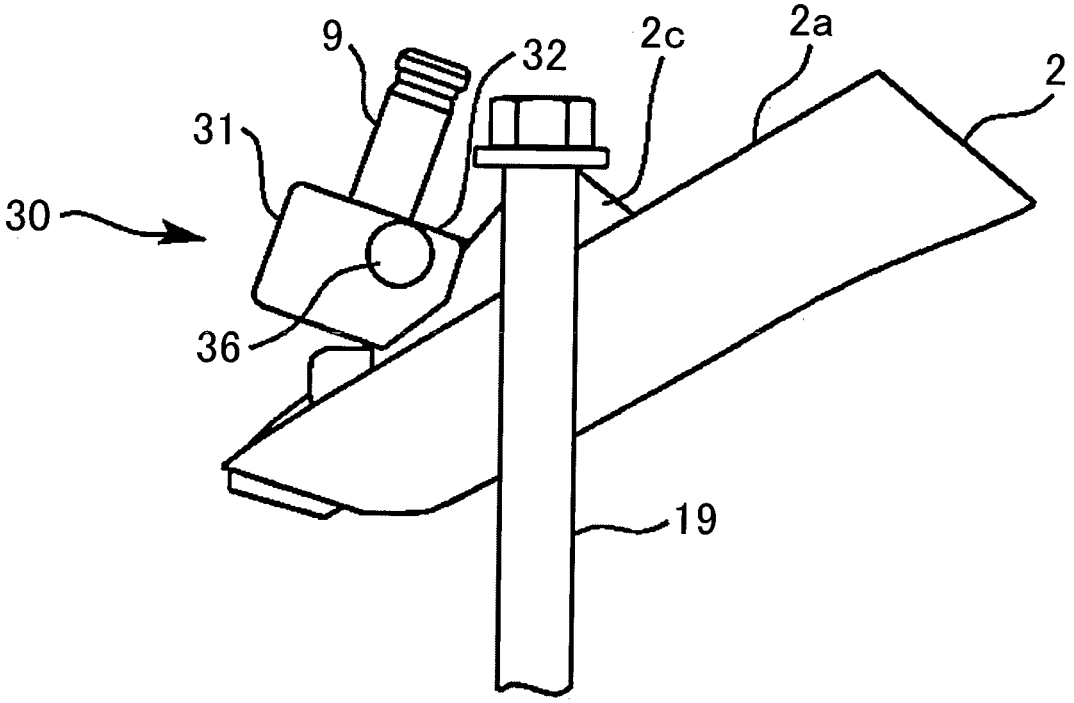
FIG. 7 is a diagram showing the positional relationship between the intake port, a head bolt, and the first coolant flow passage in the cylinder head of the first embodiment of the invention.

FIG. 7 is a diagram showing the positional relationship between the intake port 2, a head bolt 19, and the first coolant flow passage 30 in the cylinder head of the first embodiment. FIG. 7 shows the shape of the first coolant flow passage 30 around the valve guide 9 and the positional relationship between the intake port 2, the first coolant flow passage 30, and the head bolt 19 when seen from the front end side of the cylinder head assuming the inside of the cylinder head to be transparent. The head bolt 19 shown in FIG. 7 is a head bolt disposed between the front end face of the cylinder head and the intake port closest thereto. The first coolant flow passage 30 passes on the middle side of the cylinder head with respect to the head bolt 19.

The same applies to the positional relationship between head bolts each disposed between the adjacent two intake ports 2 and the first coolant flow passage 30. The first coolant flow passage 30 is disposed so as to pass through regions closer to the middle of the cylinder head with respect to the head bolts. If it is assumed that the first coolant flow passage 30 passes on the side surface side of the cylinder head with respect to the head bolts, since the intake ports 2 extend obliquely upward toward the side surface of the cylinder head, there is no alternative but to pass the first coolant flow passage 30 at high positions in a height direction of the cylinder head. With this configuration, air pockets may occur in the first coolant flow passage 30 to impede the circulation of the coolant. In this connection, since the height of the upper surfaces 2*a* of the intake ports 2 is set low in the regions closer to the middle of the cylinder head with respect to the head bolts, it is possible to pass the first coolant flow passage 30 substantially straight in the longitudinal direction without locally forming those portions that pass at the high positions.

Next, the configurations of the coolant flow passages, including the first coolant flow passage, of the cylinder head, particularly the positional relationship between the first coolant flow passage and the other components, including the second coolant flow passage, of the cylinder head, will be described with reference to the cross-sectional views.

Hereinbelow, the configurations of the coolant flow passages of the cylinder head as seen in the cross section including the central axis of the intake valve insertion hole and perpendicular to the longitudinal direction will be described. FIG. 3 shows the cross-sectional shapes of the first coolant flow passage and the second coolant flow passage of the cylinder head 101 in the cross section including the central axis L3 of the intake valve insertion hole 7 and perpendicular to the longitudinal direction. Further, FIG. 3 shows the positional relationship between the first coolant flow passage and the other components, including the second coolant flow passage, of the cylinder head 101. In the cross section shown in FIG. 3, regions denoted by symbols 20*a*, 20*b*, 20*c*, 20*d*, and 20*e* are cross sections of portions of the second coolant flow passage. Hereinafter, for example, when referring to the region denoted by symbol 20*a*, it will be referred to as a "portion 20*a*" of the second coolant flow passage or a "second coolant flow passage 20*a*". Although the portions 20*a*, 20*b*, 20*c*, 20*d*, and 20*e* of the second coolant flow passage are separated from each other in the cross section shown in FIG. 3, these portions are joined into one inside the cylinder head 101.

In the cross section shown in FIG. 3, near a top portion of the pent roof of the combustion chamber 4, the portion 20*a* of the second coolant flow passage is disposed in a region sandwiched between an upper surface 3*a* near the exhaust opening of the exhaust port 3 and the upper surface 2*a* near the intake opening of the intake port 2. The portion 20*b* of the second coolant flow passage is disposed between a lower surface 3*b* of the exhaust port 3 and the cylinder block mating surface 1*a*. The portion 20*b* of the second coolant flow passage is opened at the cylinder block mating surface 1*a* and communicates with the coolant flow passage on the cylinder block side. The portion 20*d* and the portion 20*e* of the second coolant flow passage are respectively disposed on both sides of a central axis of the exhaust valve insertion hole 8. The portions 20*a*, 20*b*, 20*d*, and 20*e* of the second coolant flow passage form a water jacket surrounding the exhaust port 3 so as to cool the exhaust port 3 and the exhaust valve. Further, the portion 20*a* of the second coolant flow passage cools the periphery of the combustion chamber 4 that rises to a high temperature.

In the cross section shown in FIG. 3, the portion 20*c* of the second coolant flow passage is disposed between the intake port central line plane S2 and the cylinder block mating surface 1*a*, more specifically, between the lower surface 2*b* of the intake port 2 and the cylinder block mating surface 1*a*. Near the branching portion of the intake port 2, the portion 20*c* of the second coolant flow passage is located approximately opposite to the outer flow passage 32 of the first coolant flow passage with the intake port 2 interposed therebetween. The portion 20*c* of the second coolant flow passage is opened at the cylinder block mating surface 1*a*. This opening of the cylinder block mating surface 1*a* communicates with the coolant flow passage on the cylinder block side. The coolant having passed through the inside of the cylinder block is introduced into the portion 20*c* of the second coolant flow passage via the opening of the cylinder block mating surface 1*a*.

In the cross section shown in FIG. 3, the inner flow passage 31 and the outer flow passage 32 of the first coolant flow passage are located between the intake port central line plane S2 and the cylinder head longitudinal direction central flat plane S1. More specifically, the inner flow passage 31 of the first coolant flow passage is located on the cylinder head longitudinal direction central flat plane S1 side with respect to the intake valve insertion hole central axis plane S3, while the outer flow passage 32 of the first coolant flow passage is located on the intake port central line plane S2 side with respect to the intake valve insertion hole central axis plane S3. The inner flow passage 31 is located on the side opposite to the top portion of the pent roof of the combustion chamber 4 with the portion 20*a* of the second coolant flow passage interposed therebetween. The inner flow passage 31 has an elongated cross-sectional shape extending in a direction of the central axis L3 of the intake valve insertion hole 7 and is disposed close to a wall surface of the intake valve insertion hole 7. The outer flow passage 32 is located near the branching portion of the intake port 2 upstream of the intake valve insertion hole 7. The outer flow passage 32 has a cross-sectional shape close to a triangle having a side parallel to the upper surface 2*a* of the intake port 2 and a side parallel to the wall surface of the intake valve insertion hole 7 and is disposed close to both the wall surface of the intake valve insertion hole 7 and the upper surface 2*a* of the intake port 2.

According to the above-described configuration shown in FIG. 3, the upper surface 2*a* of the intake port 2, particularly the upper surface 2*a* upstream of the intake valve insertion hole 7, can be effectively cooled by the outer flow passage 32 and the inner flow passage 31 of the first coolant flow passage in which the coolant flows, which is at a temperature lower than that of the coolant flowing in the second coolant flow passage cooling the exhaust port 3. In the intake port 2 being the tumble flow generating port, the air flows in a manner to stick to the upper surface 2*a* side of the intake port 2. Therefore, the air flowing in the intake port 2 can be efficiently cooled by cooling the upper surface 2*a* of the intake port 2 with the low-temperature coolant.

The portion 20*a* of the second coolant flow passage is located between the top portion of the pent roof of the combustion chamber 4 and the inner flow passage 31 of the first coolant flow passage. Since the heat generated from the combustion chamber 4 is absorbed by the portion 20*a* of the second coolant flow passage, it is suppressed that the heat is directly transferred to the inner flow passage 31 from the combustion chamber 4. Accordingly, it is avoided that the coolant in the inner flow passage 31 is heated by the heat generated from the combustion chamber 4, resulting in a reduction in cooling efficiency for the air flowing in the intake port 2.

Heat transfer from the cylinder block mating surface 1*a* to the lower surface 2*b* of the intake port 2 can be suppressed by the portion 20*c* of the second coolant flow passage. The temperature of the coolant cooling the lower surface 2*b* side of the intake port 2 is higher than that of the coolant cooling the upper surface 2*a* side of the intake port 2 and thus does not excessively reduce the temperature of the lower surface 2*b*, where adhesion of fuel injected from the port injector is large in amount, of the intake port 2. That is, by the portion 20*c* of the second coolant flow passage, the lower surface 2*b* of the intake port 2 can be moderately cooled to a degree that does not inhibit evaporation of fuel.

Next, the configurations of the coolant flow passages of the cylinder head as seen in the cross section including the central axis of the combustion chamber and perpendicular to the longitudinal direction will be described. FIG. 4 shows the cross-sectional shapes of the first coolant flow passage and the second coolant flow passage of the cylinder head 101 in the cross section including the central axis L1 of the combustion chamber 4 and perpendicular to the longitudinal direction. Further, FIG. 4 shows the positional relationship between the first coolant flow passage and the other components, including the second coolant flow passage, of the cylinder head 101. In the cross section shown in FIG. 4, regions denoted by symbols 20*f*, 20*g*, and 20*h* are cross sections of portions of the second coolant flow passage. Although the portions 20*f*, 20*g*, and 20*h* of the second coolant flow passage are separated from each other in the cross section shown in FIG. 4, these portions are joined into one with the portions 20*a*, 20*b*, 20*c*, 20*d*, and 20*e* shown in FIG. 3 inside the cylinder head 101.

In the cross section shown in FIG. 4, near an open end 12*a* of the spark plug insertion hole 12, the portion 20*g* of the second coolant flow passage is disposed on the intake side with respect to the cylinder head longitudinal direction central flat plane S1. The portion 20*g* of the second coolant flow passage is disposed close to an intake-side wall surface of a forward end portion of the spark plug insertion hole 12 between the cylinder head longitudinal direction central flat plane S1 and the intake valve insertion hole central axis plane S3. Near the open end 12*a* of the spark plug insertion hole 12, the portion 20*f* of the second coolant flow passage is disposed on the exhaust side with respect to the cylinder head longitudinal direction central flat plane S1. The portion 20*f* of the second coolant flow passage is disposed along both an exhaust-side wall surface of the forward end portion of the spark plug insertion hole 12 and an exhaust-side wall surface of the combustion chamber 4. The portion 20*h* of the second coolant flow passage is disposed above the portion 20*f* of the second coolant flow passage. The portions 20*f* and 20*h* of the second coolant flow passage form a water jacket surrounding the exhaust port 3 jointly with the portions 20*a*, 20*b*, 20*d*, and 20*e* shown in FIG. 3. The portion 20*g* of the second coolant flow passage cools the periphery of the combustion chamber 4 that rises to a high temperature, particularly the periphery of the spark plug insertion hole 12.

In the cross section shown in FIG. 4, the first connecting passage 34 of the first coolant flow passage is located between the cylinder head longitudinal direction central flat plane S1 and the intake valve insertion hole central axis plane S3. The first connecting passage 34 has an elongated rounded rectangular cross-sectional shape substantially parallel to the intake valve insertion hole central axis plane S3 and has a flow passage cross-sectional area substantially equal to the sum of the flow passage cross-sectional areas of the outer flow passage 32 and the inner flow passage 31 shown in FIG. 3. The first connecting passage 34 is located on the side opposite to the top portion of the combustion chamber 4, more specifically, on the side opposite to the open end 12*a* of the spark plug insertion hole 12, with the portion 20*g* of the second coolant flow passage interposed therebetween.

According to the above-described configuration shown in FIG. 4, the heat generated from the combustion chamber 4 is absorbed by the portion 20*g* of the second coolant flow passage located between the first connecting passage 34 of the first coolant flow passage and the top portion of the combustion chamber 4. Therefore, it is suppressed that the heat is directly transferred to the first connecting passage 34 from the combustion chamber 4. Accordingly, it is avoided that the temperature of the coolant flowing in the first coolant flow passage increases to cause a reduction in cooling efficiency for the air flowing in the intake port 2.

Next, the configurations of the coolant flow passages of the cylinder head as seen in the cross section passing between the adjacent two combustion chambers and perpendicular to the longitudinal direction will be described. FIG. 5 shows the cross-sectional shapes of the first coolant flow passage and the second coolant flow passage of the cylinder head 101 in the cross section passing between the adjacent two combustion chambers and perpendicular to the longitudinal direction. Further, FIG. 5 shows the positional relationship between the first coolant flow passage and the other components, including the second coolant flow passage, of the cylinder head 101. In the cross section shown in FIG. 5, regions denoted by symbols 20*i*, 20*j*, and 20*p* are cross sections of portions of the second coolant flow passage. Although the portions 20*i*, 20*j*, and 20*p* of the second coolant flow passage are separated from each other in the cross section shown in FIG. 5, these portions are joined into one with the portions 20*a*, 20*b*, 20*c*, 20*d*, and 20*e* shown in FIG. 3 and the portions 20*f*, 20*g*, and 20*h* shown in FIG. 4 inside the cylinder head 101.

In the cross section shown in FIG. 5, the portion 20*i* of the second coolant flow passage is disposed between the cylinder head longitudinal direction central flat plane S1 and the exhaust-side head bolt insertion hole 14. The portion 20*j* of the second coolant flow passage is disposed between the cylinder head longitudinal direction central flat plane S1 and the intake-side head bolt insertion hole 13. The portion 20*i* and the portion 20*j* of the second coolant flow passage are both opened at the cylinder block mating surface 1*a*. Further, the portion 20*i* and the portion 20*j* of the second coolant flow passage communicate with each other in the middle of the cylinder head 101. The portion 20*p* of the second coolant flow passage is disposed between the exhaust-side head bolt insertion hole 14 and the exhaust port 3. The portion 20*p* of the second coolant flow passage is opened at the cylinder block mating surface 1*a*. The portions 20*i* and 20*p* of the second coolant flow passage form a water jacket surrounding the exhaust port 3 jointly with the portions 20*a*, 20*b*, 20*d*, and 20*e* shown in FIG. 3 and the portions 20*f*, 20*g* and 20*h* shown in FIG. 4. The portion 20*j* of the second coolant flow passage cools a portion between the forward end portions of the adjacent two intake ports.

In the cross section shown in FIG. 5, the second connecting passage 33 of the first coolant flow passage is located between the intake port central line plane S2 and the intake valve insertion hole central axis plane S3. The second connecting passage 33 has an elongated rounded rectangular cross-sectional shape substantially parallel to the intake valve insertion hole central axis plane S3 and has a flow passage cross-sectional area substantially equal to the sum of the flow passage cross-sectional areas of the outer flow passage 32 and the inner flow passage 31 shown in FIG. 3. The second connecting passage 33 is located on the side opposite to the cylinder block mating surface 1*a* with the portion 20*j* of the second coolant flow passage interposed therebetween.

According to the above-described configuration shown in FIG. 5, the heat transferred from the cylinder block mating surface 1*a* is absorbed by the portion 20*j* of the second coolant flow passage located between the cylinder block mating surface 1*a* and the second connecting passage 33 of the first coolant flow passage. Therefore, it is suppressed that the heat is directly transferred to the second connecting passage 33 from the cylinder block mating surface 1*a*. Accordingly, it is avoided that the temperature of the coolant flowing in the first coolant flow passage increases to cause a reduction in cooling efficiency for the air flowing in the intake port 2.

In the cross section shown in FIG. 5, the second connecting passage 33 of the first coolant flow passage is located in a region closer to the middle of the cylinder head 101 with respect to the intake-side head bolt insertion hole 13. If it is assumed that the second connecting passage 33 is located on the side surface side of the cylinder head with respect to the head bolt insertion hole 13, the position in the cylinder head height direction of the second connecting passage 33 has to be high. With this configuration, there is a possibility that the air staying in the second connecting passage 33 is not released, thereby impeding the circulation of the coolant. In this connection, according to the positional relationship shown in FIG. 5, since it is possible to pass the first coolant flow passage substantially straight in the longitudinal direction, it is possible to prevent the air from staying in the first coolant flow passage.

Next, a description will be given of specific application examples of the engine cooling system, including the cylinder head 101, of the first embodiment configured as described above.

Figure 14:
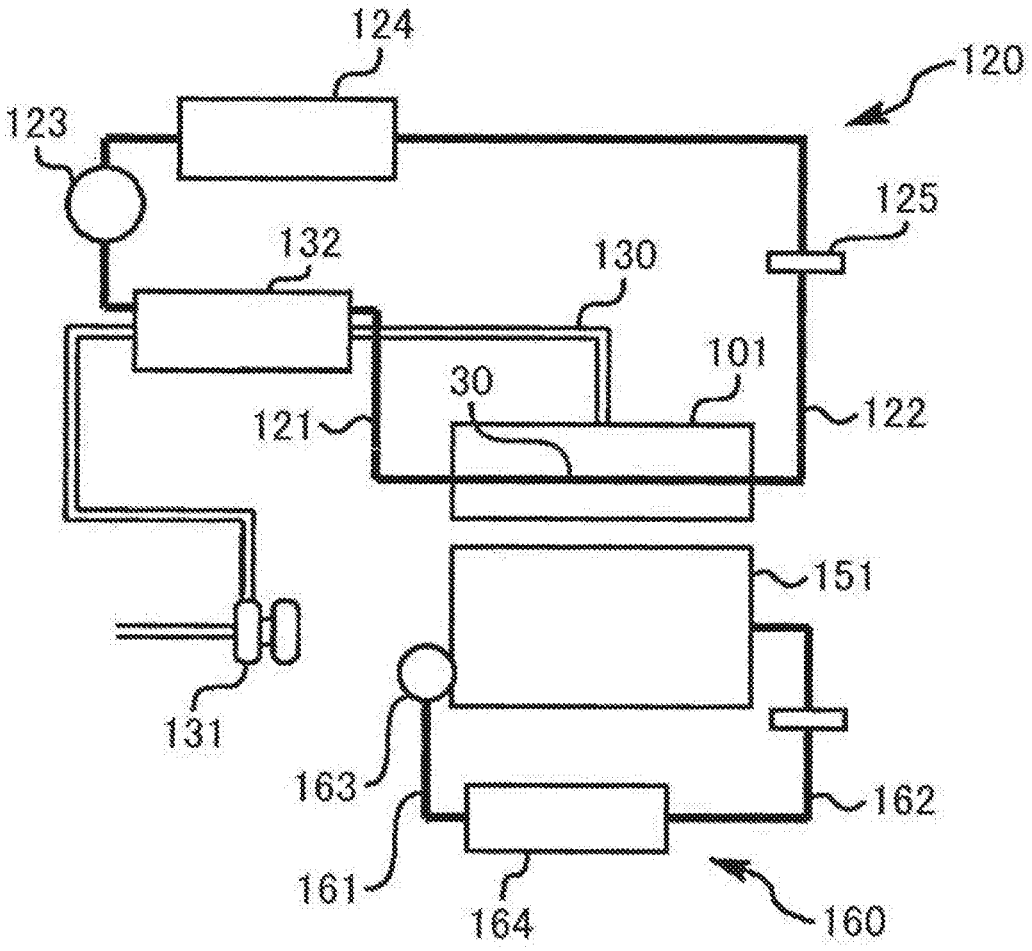
FIG. 14 is a diagram showing application example 1 in which the engine cooling system of the first embodiment of the invention is applied to a supercharged engine system.

First, application example 1 of the first embodiment will be described. FIG. 14 shows application example 1 in which the engine cooling system of the first embodiment is applied to a supercharged engine system. The configuration of an engine cooling system itself is equivalent to the basic configuration of the engine cooling system shown in FIG. 1. Accordingly, in FIG. 14, components equivalent to those of the engine cooling system shown in FIG. 1 are assigned the same symbols. An overlapping description of those equivalent components will be omitted or simplified.

In the supercharged engine system, a turbo compressor 131 is attached to an intake passage 130 communicating with a cylinder head 101 and a liquid-cooled intercooler 132 is disposed downstream of the turbo compressor 131. In application example 1 shown in FIG. 14, the intercooler 132 is incorporated in a first circulation system 120 and a low-temperature coolant flowing in the first circulation system 120 is used for heat exchange with the air in the intercooler 132. More specifically, the intercooler 132 is disposed in a coolant introducing pipe 121 and the coolant used for heat exchange in the intercooler 132 is introduced into a first coolant flow passage 30 provided in the cylinder head 101. In application example 1 shown in FIG. 14, a liquid temperature sensor 125 is disposed in a coolant discharge pipe 122 and the temperature of the coolant having passed through the first coolant flow passage 30 is measured by the liquid temperature sensor 125. The measured liquid temperature is used as information for controlling the rotational speed of a water pump 123.

Figure 15:
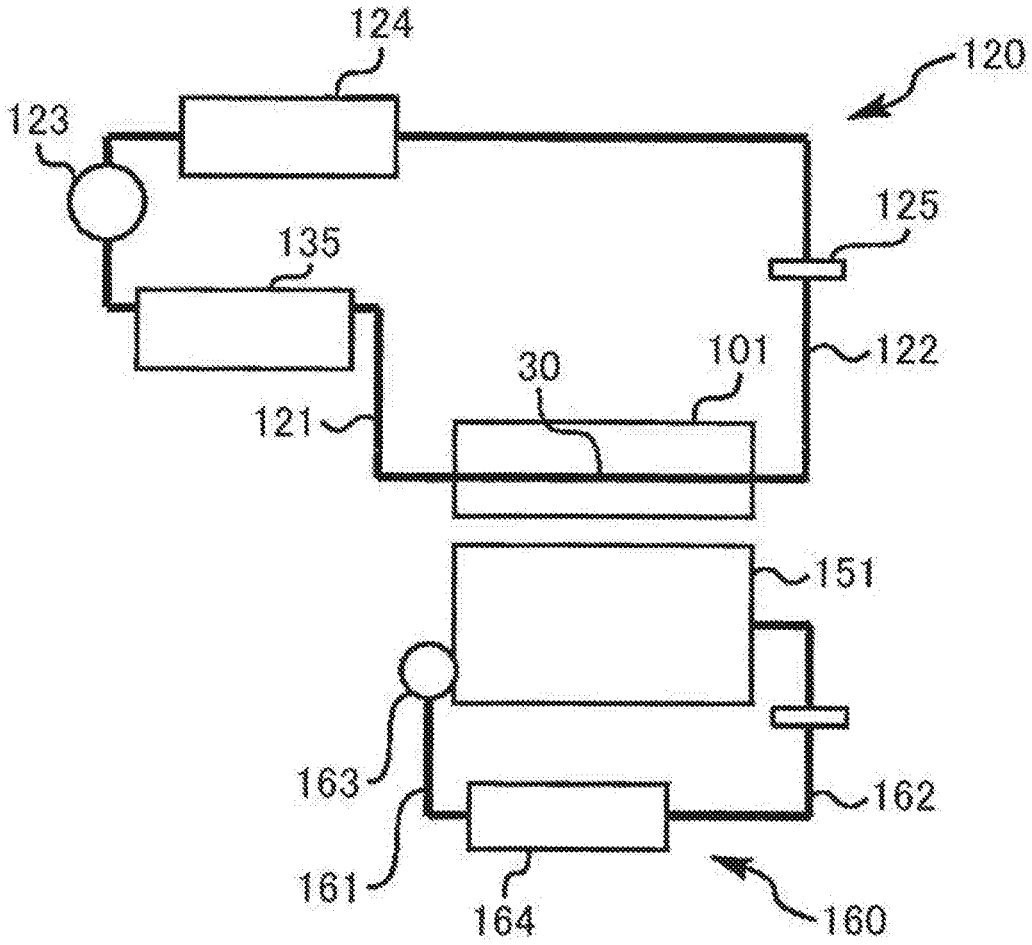
FIG. 15 is a diagram showing application example 2 in which the engine cooling system of the first embodiment of the invention is applied to a hybrid system.

Next, application example 2 of the first embodiment will be described. FIG. 15 shows application example 2 in which the engine cooling system of the first embodiment is applied to a hybrid system. The configuration of an engine cooling system itself is equivalent to the basic configuration of the engine cooling system shown in FIG. 1. Accordingly, in FIG. 15, components equivalent to those of the engine cooling system shown in FIG. 1 are assigned the same symbols. An overlapping description of those equivalent components will be omitted or simplified.

The hybrid system, in which an engine and a motor are combined, includes an inverter 135. In application example 2 shown in FIG. 15, the inverter 135 is incorporated in a first circulation system 120 and a low-temperature coolant flowing in the first circulation system 120 is used for cooling the inverter 135. More specifically, the inverter 135 is disposed in a coolant introducing pipe 121 and the coolant used for cooling the inverter 135 is introduced into a first coolant flow passage 30 provided in a cylinder head 101. Also in application example 2 shown in FIG. 15, a liquid temperature sensor 125 is disposed in a coolant discharge pipe 122.

Next, a second embodiment of the invention will be described with reference to the drawings. The basic configuration of a cylinder head of the second embodiment is the same as that of the cylinder head of the first embodiment. Accordingly, the description of the basic configuration of the cylinder head of the first embodiment is incorporated herein in its entirety for the basic configuration of the cylinder head of the second embodiment, thereby omitting an overlapping description thereof.

The cylinder head of the second embodiment includes dual coolant flow passages connected to independent and separate circulation systems. The temperature of a coolant flowing in the first coolant flow passage is equal to that of a coolant flowing in the second coolant flow passage at the time of cold engine start-up and, as warming-up of the engine progresses, the coolant at a temperature lower than that of the coolant flowing in the second coolant flow passage flows in the first coolant flow passage. The cylinder head of the second embodiment differs from the cylinder head of the first embodiment in the configuration of the first coolant flow passage. Hereinbelow, the configuration of the first coolant flow passage of the cylinder head of the second embodiment will be described. The description will be made using cross-sectional views of the cylinder head and a perspective view showing the coolant flow passage inside the cylinder head in a see-through manner. In the figures, components equivalent to those of the first embodiment are assigned the same symbols. The configuration of the second coolant flow passage is the same as that of the cylinder head of the first embodiment. Accordingly, the description of the configuration of the second coolant flow passage of the cylinder head of the first embodiment is incorporated herein in its entirety for the configuration of the second coolant flow passage of the cylinder head of the second embodiment, thereby omitting an overlapping description thereof.

Figure 19:
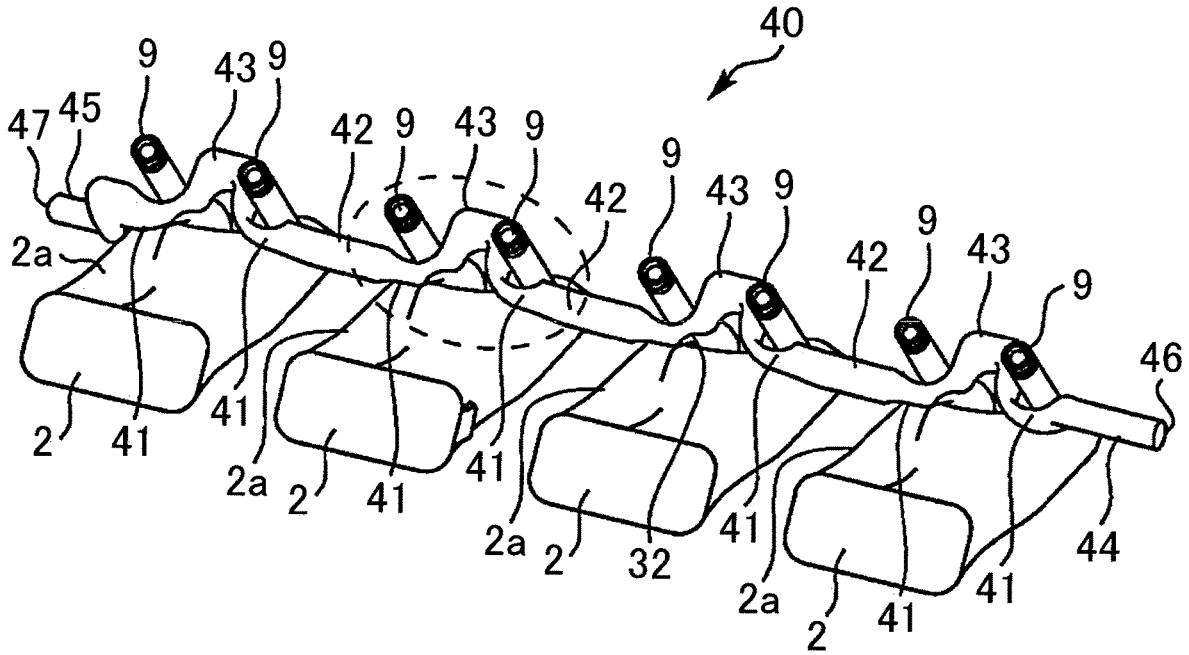
FIG. 19 is a perspective view showing, in a see-through manner, intake ports and a first coolant flow passage inside the cylinder head of the second embodiment of the invention.

Hereinbelow, the configurations of the coolant flow passages of the cylinder head of the second embodiment will be described. Of the dual coolant flow passages provided in the cylinder head of the second embodiment, the shape of the first coolant flow passage in which the low-temperature coolant flows will be described with reference to FIG. 19. FIG. 19 is a perspective view showing, in a see-through manner, intake ports 2 and a first coolant flow passage 40 of the cylinder head of the second embodiment. FIG. 19 shows the shape of the first coolant flow passage 40 and the positional relationship between the first coolant flow passage 40, the intake ports 2, and valve guides 9 when seen assuming the inside of the cylinder head to be transparent.

The first coolant flow passage 40 is provided on the upper side of the row of the intake ports 2 in the cylinder head. The first coolant flow passage 40 extends in a direction of the row of the intake ports 2, i.e. in a longitudinal direction of the cylinder head, along upper surfaces 2*a* of the intake ports 2.

The first coolant flow passage 40 has a unit structure for each intake port 2. In FIG. 19, the structure of a portion encircled by a dotted line is the unit structure of the first coolant flow passage 40. The unit structure includes a pair of arc-shaped flow passages 41 respectively disposed around the left and right valve guides 9 (to be exact, intake valve insertion holes) of the intake port 2. The arc-shaped flow passages 41 are each a flow passage curved in an arc along the periphery of the valve guide 9 and respectively extend between the left and right valve guides 9 from the side surface side of the cylinder head to the middle side of the cylinder head with respect to the valve guides 9. The left and right arc-shaped flow passages 41 are plane-symmetric with respect to a flat plane dividing the intake port 2 into left and right parts (a flat plane including a central axis of a combustion chamber and perpendicular to the longitudinal direction of the cylinder head).

The unit structure includes a first connecting passage 43 connecting the left and right arc-shaped flow passages 41. The first connecting passage 43 is located above a space between left and right branch ports of the intake port 2 on the middle side of the cylinder head with respect to the valve guides 9. The first connecting passage 43 is a flow passage curved convex to the middle side of the cylinder head and continuously communicates with the left and right arc-shaped flow passages 41.

The first coolant flow passage 40 includes second connecting passages 42 each connecting the adjacent two unit structures. The second connecting passage 42 is located above a space between the adjacent two intake ports 2 on the side surface side of the cylinder head with respect to the valve guides 9. The second connecting passage 42 is a flow passage extending in the longitudinal direction of the cylinder head and continuously communicates with the arc-shaped flow passages 41 of the adjacent two unit structures.

An inlet flow passage 44 and an outlet flow passage 45 are respectively provided at both end portions in the longitudinal direction of the first coolant flow passage 40. The inlet flow passage 44 extends straight in the longitudinal direction to a first hole 46 opened in a rear end face of the cylinder head. The outlet flow passage 45 extends straight in the longitudinal direction to a second hole 47 opened in a front end face of the cylinder head. The inlet flow passage 44 and the outlet flow passage 45 are flow passages that are formed by core supports supporting a sand core, for forming the first coolant flow passage 40, from both sides, while the first hole 46 and the second hole 47 are sand removing holes that are formed by removing the core supports. The first hole 46 is used as a coolant inlet, while the second hole 47 is used as a coolant outlet. Alternatively, the second hole 47 may be used as a coolant inlet, while the first hole 46 may be used as a coolant outlet.

Next, the positional relationship between the first coolant flow passage and the other components, including the second coolant flow passage, of the cylinder head will be described with reference to cross-sectional views.

Figure 16:
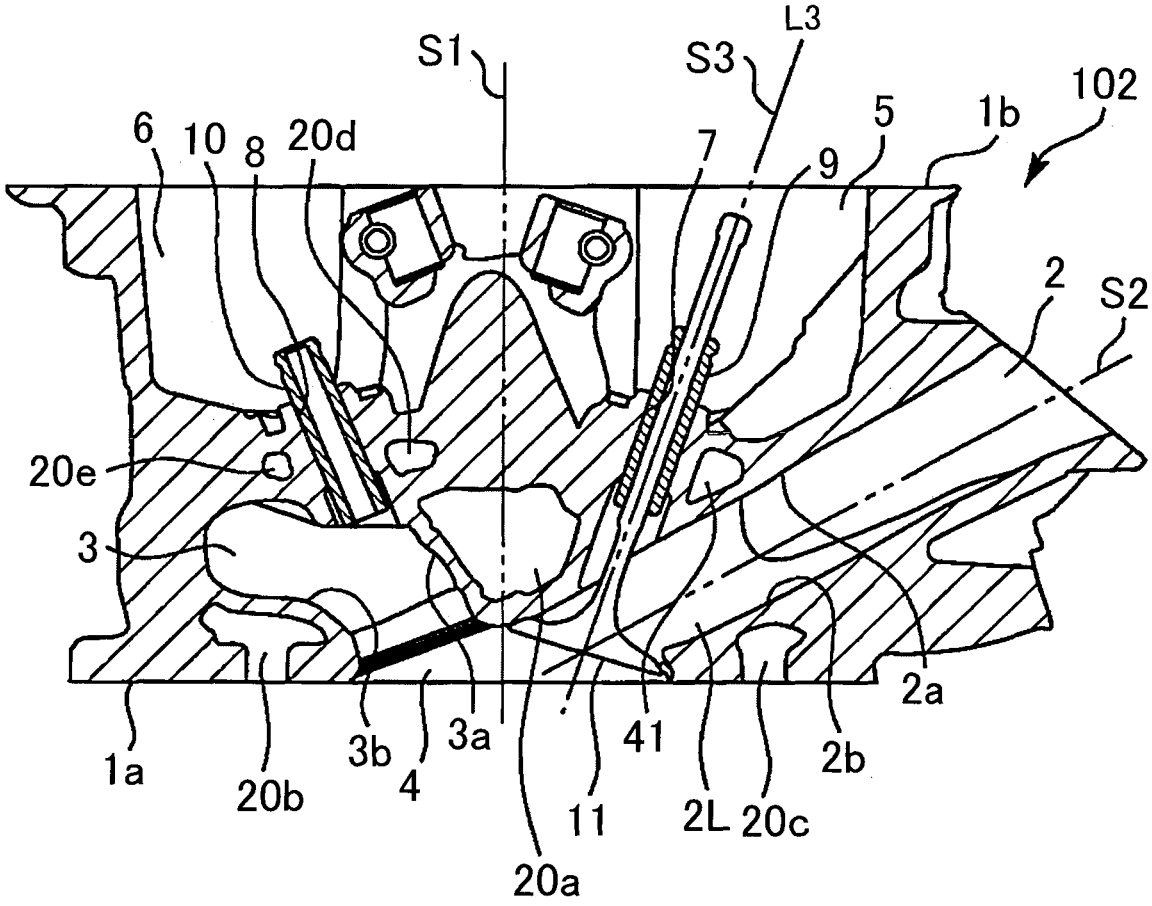
FIG. 16 is a cross-sectional view showing a cross section, including a central axis of an intake valve insertion hole and perpendicular to a longitudinal direction, of a cylinder head of a second embodiment of the invention, i.e. a cross section corresponding to the A-A cross section of FIG. 2.

Hereinbelow, the configurations of the coolant flow passages of the cylinder head as seen in a cross section including a central axis of an intake valve insertion hole and perpendicular to the longitudinal direction will be described. FIG. 16 is a cross-sectional view showing a cross section, including a central axis L3 of an intake valve insertion hole 7 and perpendicular to the longitudinal direction, of the cylinder head of the second embodiment. FIG. 16 shows the cross-sectional shapes of the first coolant flow passage and the second coolant flow passage in the cross section described above. Further, FIG. 16 shows the positional relationship between the first coolant flow passage and the other components, including the second coolant flow passage, of the cylinder head 102.

In the cross section shown in FIG. 16, the arc-shaped flow passage 41 of the first coolant flow passage is located between an intake port central line plane S2 and a cylinder head longitudinal direction central flat plane S1 on the intake port central line plane S2 side with respect to an intake valve insertion hole central axis plane S3. The arc-shaped flow passage 41 is located near a branching portion of the intake port 2 upstream of the intake valve insertion hole 7. The arc-shaped flow passage 41 has a cross-sectional shape close to a triangle having a side parallel to the upper surface 2*a* of the intake port 2 and a side parallel to a wall surface of the intake valve insertion hole 7 and is disposed close to both the wall surface of the intake valve insertion hole 7 and the upper surface 2*a* of the intake port 2.

According to the above-described configuration shown in FIG. 16, the upper surface 2*a* of the intake port 2, particularly the upper surface 2*a* upstream of the intake valve insertion hole 7, can be effectively cooled by the arc-shaped flow passage 41 of the first coolant flow passage in which the coolant flows, which is at a temperature lower than that of the coolant flowing in the second coolant flow passage cooling an exhaust port 3. Accordingly, it is possible to efficiently cool the air flowing in the intake port 2.

Figure 17:
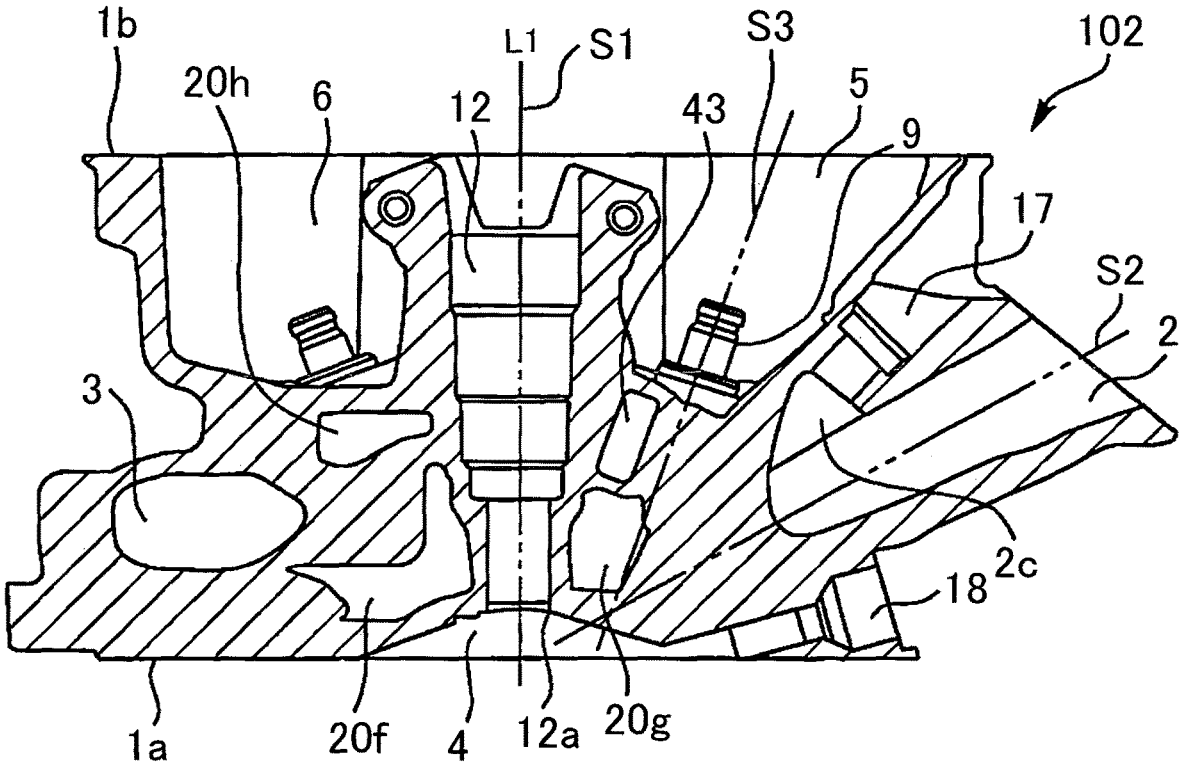
FIG. 17 is a cross-sectional view showing a cross section, including a central axis of a combustion chamber and perpendicular to the longitudinal direction, of the cylinder head of the second embodiment of the invention, i.e. a cross section corresponding to the B-B cross section of FIG. 2.

Next, the configurations of the coolant flow passages of the cylinder head as seen in a cross section including a central axis of a combustion chamber and perpendicular to the longitudinal direction will be described. FIG. 17 is a cross-sectional view showing a cross section, including a central axis L1 of a combustion chamber 4 and perpendicular to the longitudinal direction, of the cylinder head of the second embodiment. FIG. 17 shows the cross-sectional shapes of the first coolant flow passage and the second coolant flow passage in the cross section described above. Further, FIG. 17 shows the positional relationship between the first coolant flow passage and the other components, including the second coolant flow passage, of the cylinder head 102.

In the cross section shown in FIG. 17, the first connecting passage 43 of the first coolant flow passage is located between the cylinder head longitudinal direction central flat plane S1 and the intake valve insertion hole central axis plane S3. The first connecting passage 43 has an elongated rounded rectangular cross-sectional shape substantially parallel to the intake valve insertion hole central axis plane S3. The first connecting passage 43 is located on the side opposite to a top portion of the combustion chamber 4, more specifically, on the side opposite to an open end 12*a* of a spark plug insertion hole 12, with a portion 20*g* of the second coolant flow passage interposed therebetween.

According to the above-described configuration shown in FIG. 17, the heat generated from the combustion chamber 4 is absorbed by the portion 20*g* of the second coolant flow passage located between the first connecting passage 43 of the first coolant flow passage and the top portion of the combustion chamber 4. Therefore, it is suppressed that the heat is directly transferred to the first connecting passage 43 from the combustion chamber 4. Accordingly, it is avoided that the temperature of the coolant flowing in the first coolant flow passage increases to cause a reduction in cooling efficiency for the air flowing in the intake port 2.

Figure 18:
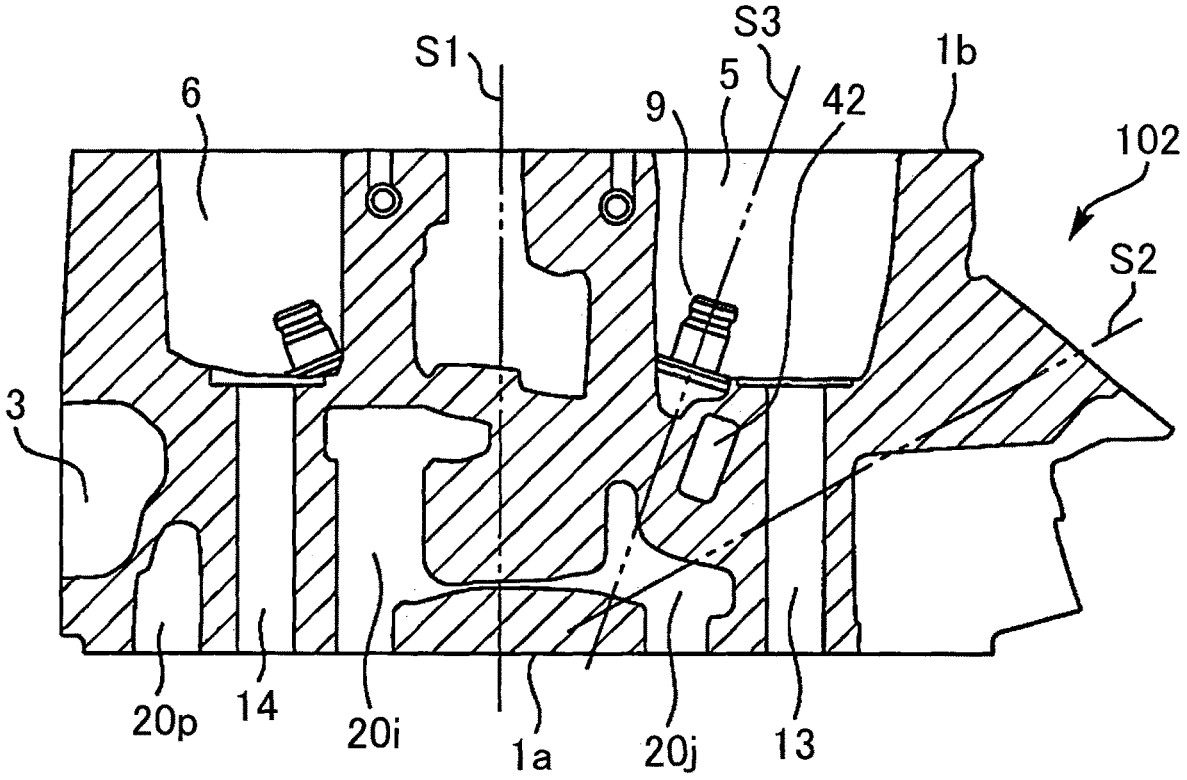
FIG. 18 is a cross-sectional view showing a cross section, passing between adjacent two combustion chambers and perpendicular to the longitudinal direction, of the cylinder head of the second embodiment of the invention, i.e. a cross section corresponding to the C-C cross section of FIG. 2.

Next, the configurations of the coolant flow passages of the cylinder head as seen in a cross section passing between the adjacent two combustion chambers and perpendicular to the longitudinal direction will be described. FIG. 18 is a cross-sectional view showing a cross section, passing between the adjacent two combustion chambers and perpendicular to the longitudinal direction, of the cylinder head of the second embodiment, specifically, a cross section including central axes of head bolt insertion holes 13 and 14 and perpendicular to the longitudinal direction. FIG. 18 shows the cross-sectional shapes of the first coolant flow passage and the second coolant flow passage in the cross section described above. Further, FIG. 18 shows the positional relationship between the first coolant flow passage and the other components, including the second coolant flow passage, of the cylinder head 102.

In the cross section shown in FIG. 18, the second connecting passage 42 of the first coolant flow passage is located between the intake port central line plane S2 and the intake valve insertion hole central axis plane S3 in a region closer to the middle of the cylinder head 102 with respect to the intake-side head bolt insertion hole 13. The second connecting passage 42 has an elongated rounded rectangular cross-sectional shape substantially parallel to the intake valve insertion hole central axis plane S3. The second connecting passage 42 is located on the side opposite to a cylinder block mating surface 1*a* with a portion 20*j* of the second coolant flow passage interposed therebetween.

According to the above-described configuration shown in FIG. 18, the heat transferred from the cylinder block mating surface 1*a* is absorbed by the portion 20*j* of the second coolant flow passage located between the cylinder block mating surface 1*a* and the second connecting passage 42 of the first coolant flow passage. Therefore, it is suppressed that the heat is directly transferred to the second connecting passage 42 from the cylinder block mating surface 1*a*. Accordingly, it is avoided that the temperature of the coolant flowing in the first coolant flow passage increases to cause a reduction in cooling efficiency for the air flowing in the intake port 2.

Next, a third embodiment of the invention will be described with reference to the drawings. The basic configuration of a cylinder head of the third embodiment is the same as that of the cylinder head of the first embodiment. Accordingly, the description of the basic configuration of the cylinder head of the first embodiment is incorporated herein in its entirety for the basic configuration of the cylinder head of the third embodiment, thereby omitting an overlapping description thereof.

The cylinder head of the third embodiment includes dual coolant flow passages connected to independent and separate circulation systems. The temperature of a coolant flowing in the first coolant flow passage is equal to that of a coolant flowing in the second coolant flow passage at the time of cold engine start-up and, as warming-up of the engine progresses, the coolant at a temperature lower than that of the coolant flowing in the second coolant flow passage flows in the first coolant flow passage. The cylinder head of the third embodiment differs from the cylinder head of the first embodiment in the configuration of the first coolant flow passage. Hereinbelow, the configuration of the first coolant flow passage of the cylinder head of the third embodiment will be described. The description will be made using cross-sectional views of the cylinder head and a perspective view showing the coolant flow passage inside the cylinder head in a see-through manner. In the figures, components equivalent to those of the first embodiment are assigned the same symbols. The configuration of the second coolant flow passage is the same as that of the cylinder head of the first embodiment. Accordingly, the description of the configuration of the second coolant flow passage of the cylinder head of the first embodiment is incorporated herein in its entirety for the configuration of the second coolant flow passage of the cylinder head of the third embodiment, thereby omitting an overlapping description thereof.

Figure 23:
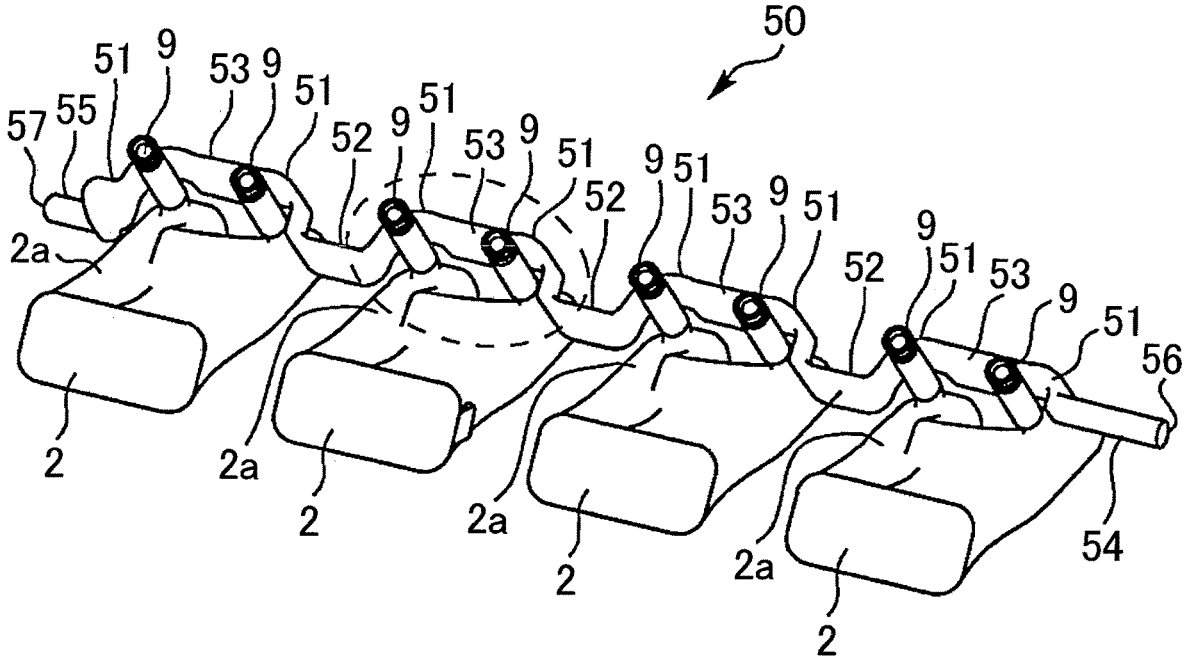
FIG. 23 is a perspective view showing, in a see-through manner, intake ports and a first coolant flow passage inside the cylinder head of the third embodiment of the invention.

Hereinbelow, the configurations of the coolant flow passages of the cylinder head of the third embodiment will be described. Of the dual coolant flow passages provided in the cylinder head of the third embodiment, the shape of the first coolant flow passage in which the low-temperature coolant flows will be described with reference to FIG. 23. FIG. 23 is a perspective view showing, in a see-through manner, intake ports 2 and a first coolant flow passage 50 of the cylinder head of the third embodiment. FIG. 23 shows the shape of the first coolant flow passage 50 and the positional relationship between the first coolant flow passage 50, the intake ports 2, and valve guides 9 when seen assuming the inside of the cylinder head to be transparent.

The first coolant flow passage 50 is provided on the upper side of the row of the intake ports 2 in the cylinder head. The first coolant flow passage 50 extends in a direction of the row of the intake ports 2, i.e. in a longitudinal direction of the cylinder head, along upper surfaces 2*a* of the intake ports 2.

The first coolant flow passage 50 has a unit structure for each intake port 2. In FIG. 23, the structure of a portion encircled by a dotted line is the unit structure of the first coolant flow passage 50. The unit structure includes a pair of arc-shaped flow passages 51 respectively disposed around the left and right valve guides 9 (to be exact, intake valve insertion holes) of the intake port 2. The arc-shaped flow passages 51 are each a flow passage curved in an arc along the periphery of the valve guide 9 and respectively extend on the outer sides of the left and right valve guides 9 from the side surface side of the cylinder head to the middle side of the cylinder head with respect to the valve guides 9. The left and right arc-shaped flow passages 51 are plane-symmetric with respect to a flat plane dividing the intake port 2 into left and right parts (a flat plane including a central axis of a combustion chamber and perpendicular to the longitudinal direction of the cylinder head).

The unit structure includes a first connecting passage 53 connecting the left and right arc-shaped flow passages 51. The first connecting passage 53 is located above a space between left and right branch ports of the intake port 2 on the middle side of the cylinder head with respect to the valve guides 9. The first connecting passage 53 is a flow passage extending in the longitudinal direction of the cylinder head and continuously communicates with the left and right arc-shaped flow passages 51.

The first coolant flow passage 50 includes second connecting passages 52 each connecting the adjacent two unit structures. The second connecting passage 52 is located above a space between the adjacent two intake ports 2 on the side surface side of the cylinder head with respect to the valve guides 9. The second connecting passage 52 is a flow passage curved convex to the side surface side of the cylinder head and continuously communicates with the arc-shaped flow passages 51 of the adjacent two unit structures.

An inlet flow passage 54 and an outlet flow passage 55 are respectively provided at both end portions in the longitudinal direction of the first coolant flow passage 50. The inlet flow passage 54 extends straight in the longitudinal direction to a first hole 56 opened in a rear end face of the cylinder head. The outlet flow passage 55 extends straight in the longitudinal direction to a second hole 57 opened in a front end face of the cylinder head. The inlet flow passage 54 and the outlet flow passage 55 are flow passages that are formed by core supports supporting a sand core, for forming the first coolant flow passage 50, from both sides, while the first hole 56 and the second hole 57 are sand removing holes that are formed by removing the core supports. The first hole 56 is used as a coolant inlet, while the second hole 57 is used as a coolant outlet. Alternatively, the second hole 57 may be used as a coolant inlet, while the first hole 56 may be used as a coolant outlet.

Next, the positional relationship between the first coolant flow passage and the other components, including the second coolant flow passage, of the cylinder head will be described with reference to cross-sectional views.

Figure 20:
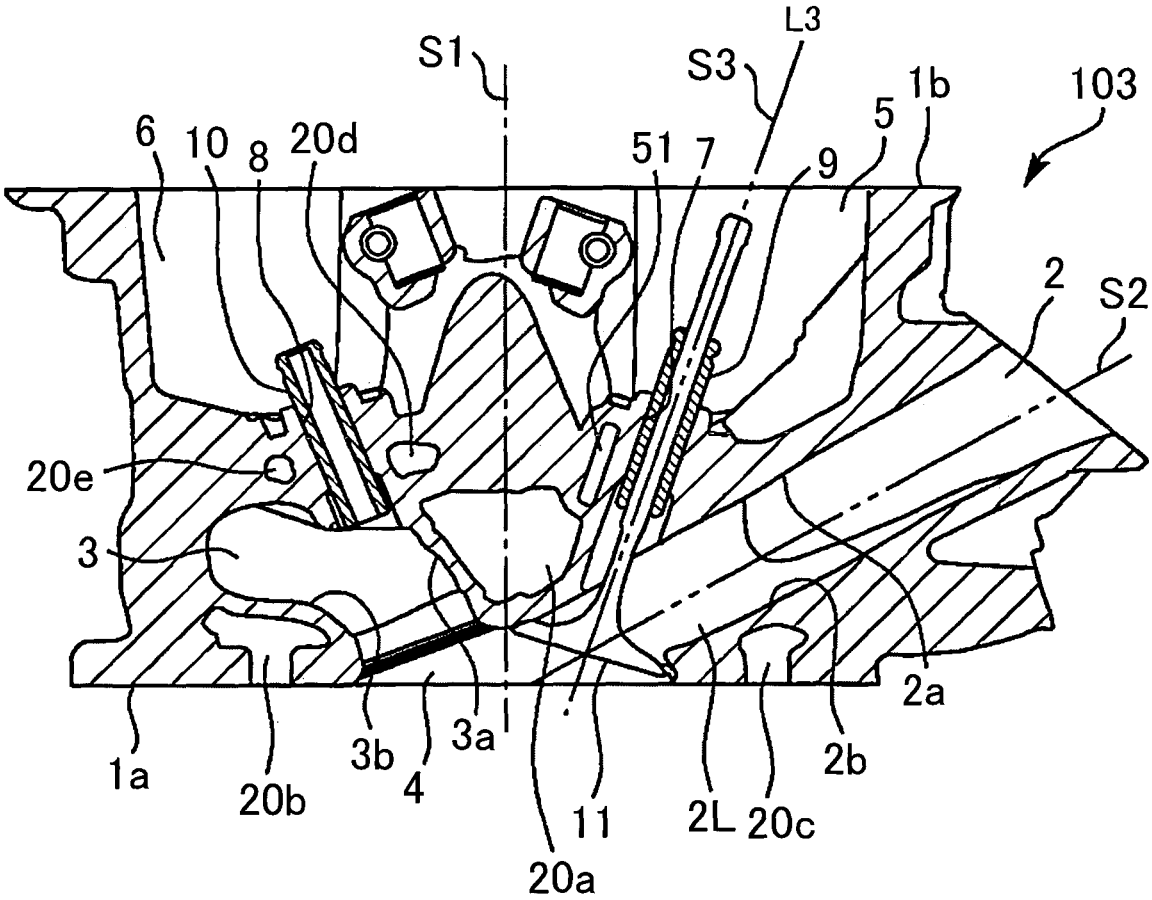
FIG. 20 is a cross-sectional view showing a cross section, including a central axis of an intake valve insertion hole and perpendicular to a longitudinal direction, of a cylinder head of a third embodiment of the invention, i.e. a cross section corresponding to the A-A cross section of FIG. 2.

Hereinbelow, the configurations of the coolant flow passages of the cylinder head as seen in a cross section including a central axis of an intake valve insertion hole and perpendicular to the longitudinal direction will be described. FIG. 20 is a cross-sectional view showing a cross section, including a central axis L3 of an intake valve insertion hole 7 and perpendicular to the longitudinal direction, of the cylinder head of the third embodiment. FIG. 20 shows the cross-sectional shapes of the first coolant flow passage and the second coolant flow passage in the cross section described above. Further, FIG. 20 shows the positional relationship between the first coolant flow passage and the other components, including the second coolant flow passage, of the cylinder head 103.

In the cross section shown in FIG. 20, the arc-shaped flow passage 51 of the first coolant flow passage is located between an intake port central line plane S2 and a cylinder head longitudinal direction central flat plane S1 on the cylinder head longitudinal direction central flat plane S1 side with respect to an intake valve insertion hole central axis plane S3. The arc-shaped flow passage 51 is located on the side opposite to a top portion of a pent roof of a combustion chamber 4 with a portion 20*a* of the second coolant flow passage interposed therebetween. The arc-shaped flow passage 51 has an elongated cross-sectional shape extending in a direction of the central axis L3 of the intake valve insertion hole 7 and is disposed close to a wall surface of the intake valve insertion hole 7.

According to the above-described configuration shown in FIG. 20, not only the upper surface 2*a* of the intake port 2 but also the valve guide 9 can be cooled by the arc-shaped flow passage 51 of the first coolant flow passage. By cooling the valve guide 9, the temperature of an intake valve 11 can be reduced. By cooling the upper surface 2*a* of the intake port 2 and the intake valve 11 with the low-temperature coolant flowing in the first coolant flow passage, it is possible to efficiently cool the air flowing in the intake port 2.

Figure 21:
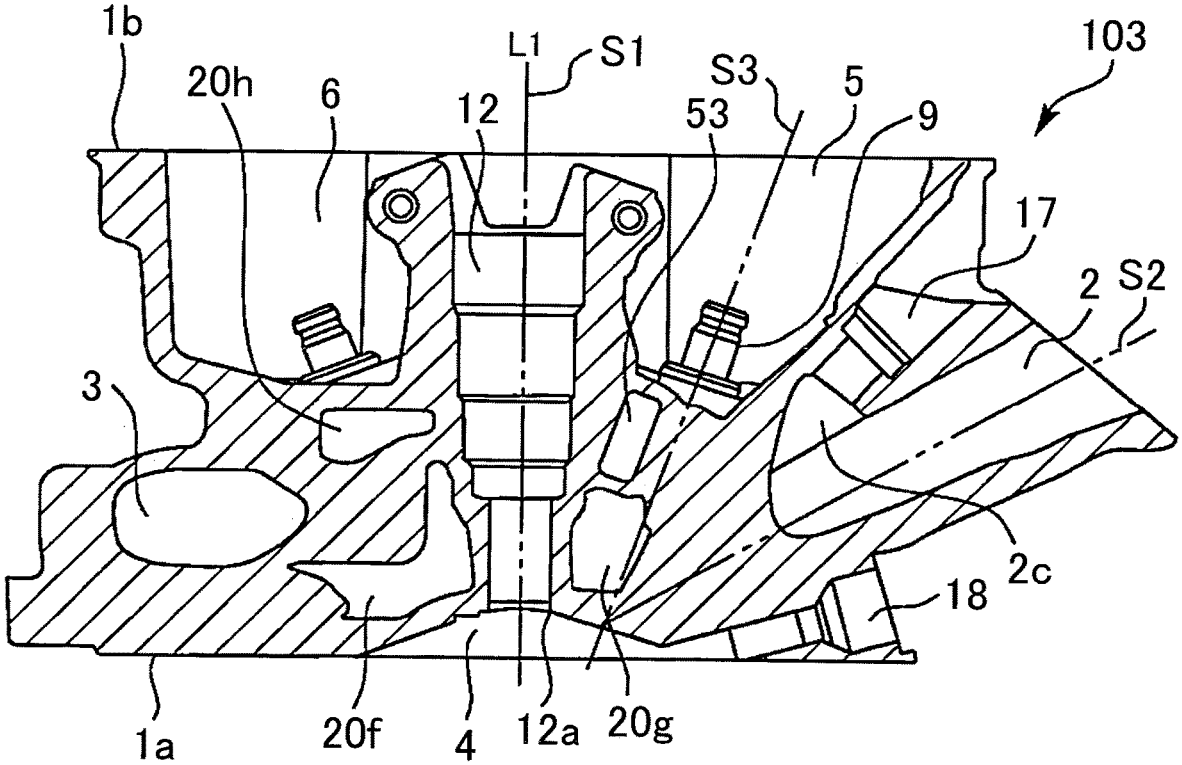
FIG. 21 is a cross-sectional view showing a cross section, including a central axis of a combustion chamber and perpendicular to the longitudinal direction, of the cylinder head of the third embodiment of the invention, i.e. a cross section corresponding to the B-B cross section of FIG. 2.

Next, the configurations of the coolant flow passages of the cylinder head as seen in a cross section including a central axis of the combustion chamber and perpendicular to the longitudinal direction will be described. FIG. 21 is a cross-sectional view showing a cross section, including a central axis L1 of the combustion chamber 4 and perpendicular to the longitudinal direction, of the cylinder head of the third embodiment. FIG. 21 shows the cross-sectional shapes of the first coolant flow passage and the second coolant flow passage in the cross section described above. Further, FIG. 21 shows the positional relationship between the first coolant flow passage and the other components, including the second coolant flow passage, of the cylinder head 103.

In the cross section shown in FIG. 21, the first connecting passage 53 of the first coolant flow passage is located between the cylinder head longitudinal direction central flat plane S1 and the intake valve insertion hole central axis plane S3. The first connecting passage 53 has an elongated rounded rectangular cross-sectional shape substantially parallel to the intake valve insertion hole central axis plane S3. The first connecting passage 53 is located on the side opposite to the top portion of the combustion chamber 4, more specifically, on the side opposite to an open end 12*a* of a spark plug insertion hole 12, with a portion 20*g* of the second coolant flow passage interposed therebetween.

According to the above-described configuration shown in FIG. 21, the heat generated from the combustion chamber 4 is absorbed by the portion 20*g* of the second coolant flow passage located between the first connecting passage 53 of the first coolant flow passage and the top portion of the combustion chamber 4. Therefore, it is suppressed that the heat is directly transferred to the first connecting passage 53 from the combustion chamber 4. Accordingly, it is avoided that the temperature of the coolant flowing in the first coolant flow passage increases to cause a reduction in cooling efficiency for the air flowing in the intake port 2.

Figure 22:
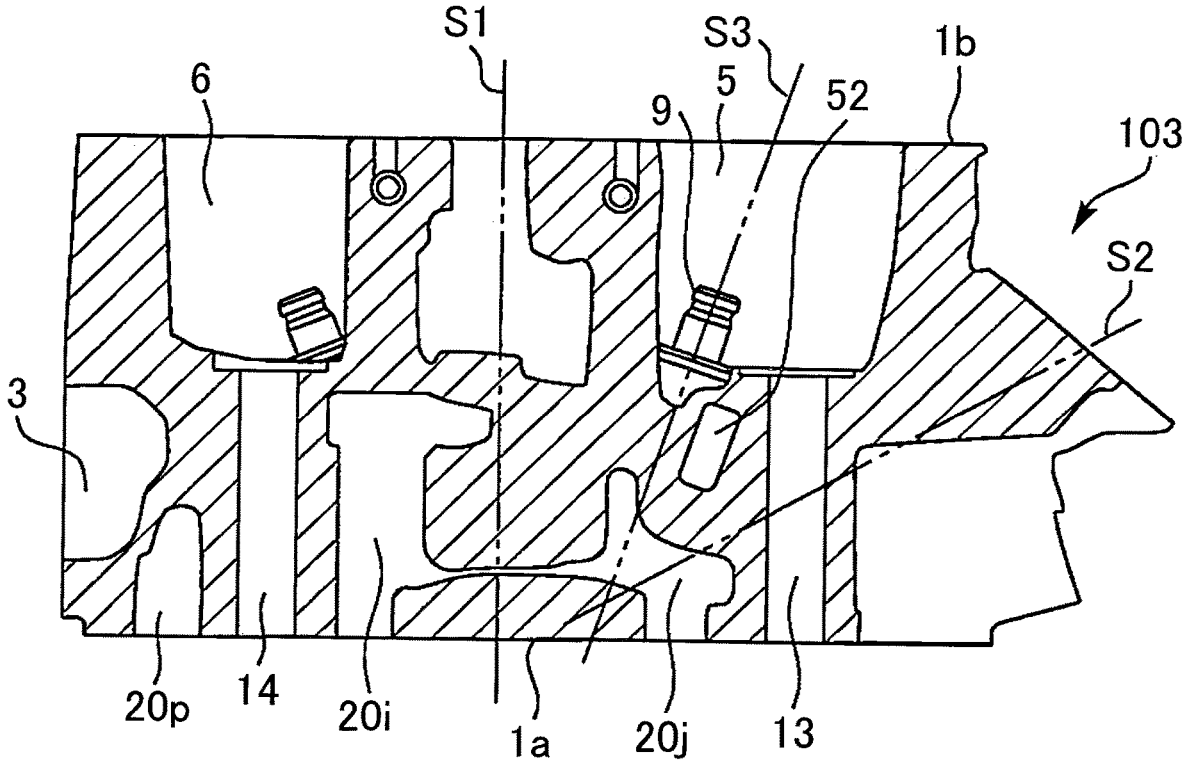
FIG. 22 is a cross-sectional view showing a cross section, passing between adjacent two combustion chambers and perpendicular to the longitudinal direction, of the cylinder head of the third embodiment of the invention, i.e. a cross section corresponding to the C-C cross section of FIG. 2.

Next, the configurations of the coolant flow passages of the cylinder head as seen in a cross section passing between the adjacent two combustion chambers and perpendicular to the longitudinal direction will be described. FIG. 22 is a cross-sectional view showing a cross section, passing between the adjacent two combustion chambers and perpendicular to the longitudinal direction, of the cylinder head of the third embodiment, specifically, a cross section including central axes of head bolt insertion holes 13 and 14 and perpendicular to the longitudinal direction. FIG. 22 shows the cross-sectional shapes of the first coolant flow passage and the second coolant flow passage in the cross section described above. Further, FIG. 22 shows the positional relationship between the first coolant flow passage and the other components, including the second coolant flow passage, of the cylinder head 103.

In the cross section shown in FIG. 22, the second connecting passage 52 of the first coolant flow passage is located between the intake port central line plane S2 and the intake valve insertion hole central axis plane S3 in a region closer to the middle of the cylinder head 103 with respect to the intake-side head bolt insertion hole 13. The second connecting passage 52 has an elongated rounded rectangular cross-sectional shape substantially parallel to the intake valve insertion hole central axis plane S3. The second connecting passage 52 is located on the side opposite to a cylinder block mating surface 1*a* with a portion 20*j* of the second coolant flow passage interposed therebetween.

According to the above-described configuration shown in FIG. 22, the heat transferred from the cylinder block mating surface 1*a* is absorbed by the portion 20*j* of the second coolant flow passage located between the cylinder block mating surface 1*a* and the second connecting passage 52 of the first coolant flow passage. Therefore, it is suppressed that the heat is directly transferred to the second connecting passage 52 from the cylinder block mating surface 1*a*. Accordingly, it is avoided that the temperature of the coolant flowing in the first coolant flow passage increases to cause a reduction in cooling efficiency for the air flowing in the intake port 2.

Next, a fourth embodiment of the invention will be described with reference to the drawings. The basic configuration of a cylinder head of the fourth embodiment is the same as that of the cylinder head of the first embodiment. Accordingly, the description of the basic configuration of the cylinder head of the first embodiment is incorporated herein in its entirety for the basic configuration of the cylinder head of the fourth embodiment, thereby omitting an overlapping description thereof.

The cylinder head of the fourth embodiment includes dual coolant flow passages connected to independent and separate circulation systems. The temperature of a coolant flowing in the first coolant flow passage is equal to that of a coolant flowing in the second coolant flow passage at the time of cold engine start-up and, as warming-up of the engine progresses, the coolant at a temperature lower than that of the coolant flowing in the second coolant flow passage flows in the first coolant flow passage. The cylinder head of the fourth embodiment differs from the cylinder head of the first embodiment in the configuration of the first coolant flow passage. Hereinbelow, the configuration of the first coolant flow passage of the cylinder head of the fourth embodiment will be described. The description will be made using cross-sectional views of the cylinder head and a perspective view showing the coolant flow passage inside the cylinder head in a see-through manner. In the figures, components equivalent to those of the first embodiment are assigned the same symbols.

Figure 27:
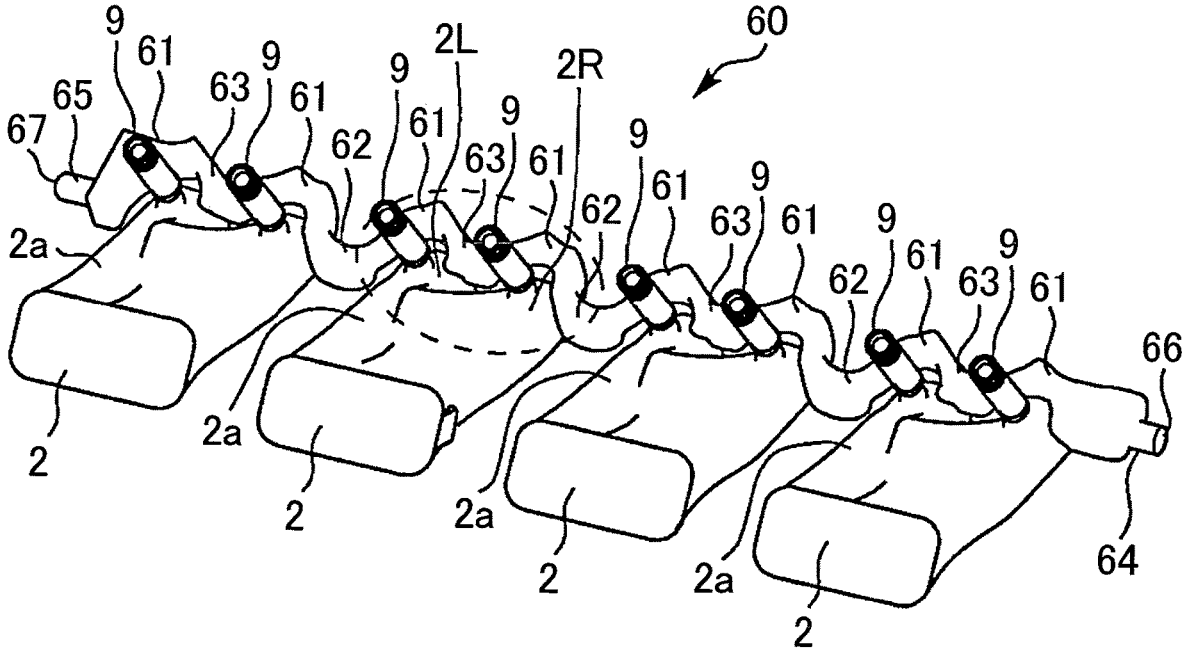
FIG. 27 is a perspective view showing, in a see-through manner, intake ports and a first coolant flow passage inside the cylinder head of the fourth embodiment of the invention.

Hereinbelow, the configurations of the coolant flow passages of the cylinder head of the fourth embodiment will be described. Of the dual coolant flow passages provided in the cylinder head of the fourth embodiment, the shape of the first coolant flow passage in which the low-temperature coolant flows will be described with reference to FIG. 27. FIG. 27 is a perspective view showing, in a see-through manner, intake ports 2 and a first coolant flow passage 60 of the cylinder head of the fourth embodiment. FIG. 27 shows the shape of the first coolant flow passage 60 and the positional relationship between the first coolant flow passage 60, the intake ports 2, and valve guides 9 when seen assuming the inside of the cylinder head to be transparent.

The first coolant flow passage 60 is provided on the upper side of the row of the intake ports 2 in the cylinder head. The first coolant flow passage 60 extends in a direction of the row of the intake ports 2, i.e. in a longitudinal direction of the cylinder head, along upper surfaces 2*a* of branch ports 2L and 2R of the intake ports 2.

The first coolant flow passage 60 has a unit structure for each intake port 2. In FIG. 27, the structure of a portion encircled by a dotted line is the unit structure of the first coolant flow passage 60. The unit structure includes a pair of arc-shaped flow passages 61 respectively disposed around the left and right branch ports 2L and 2R of the intake port 2. The arc-shaped flow passages 61 are each a flow passage that is curved in an arc so as to be wound over the branch port 2L, 2R from the middle side of the cylinder head. Of both ends of the arc-shaped flow passage 61, the end located on the middle side of the intake port 2 when seeing the arc-shaped flow passage 61 from the middle side of the cylinder head extends to between the left and right branch ports 2L and 2R, while the end located on the outer side of the intake port 2 extends to the side surface side of the cylinder head with respect to an axis of the valve guide 9. The left and right arc-shaped flow passages 61 are plane-symmetric with respect to a flat plane dividing the intake port 2 into left and right parts (a flat plane including a central axis of a combustion chamber and perpendicular to the longitudinal direction of the cylinder head).

The unit structure includes a first connecting passage 63 connecting the left and right arc-shaped flow passages 61. The first connecting passage 63 is located between the left and right branch ports 2L and 2R of the intake port 2. The first connecting passage 63 continuously communicates with the left and right arc-shaped flow passages 61.

The first coolant flow passage 60 includes second connecting passages 62 each connecting the adjacent two unit structures. The second connecting passage 62 is located in a space between the adjacent two intake ports 2 on the side surface side of the cylinder head with respect to the axis of the valve guide 9. The second connecting passage 62 is a flow passage curved convex to the side surface side of the cylinder head and continuously communicates with the arc-shaped flow passages 61 of the adjacent two unit structures.

An inlet flow passage 64 and an outlet flow passage 65 are respectively provided at both end portions in the longitudinal direction of the first coolant flow passage 60. The inlet flow passage 64 extends straight in the longitudinal direction to a first hole 66 opened in a rear end face of the cylinder head. The outlet flow passage 65 extends straight in the longitudinal direction to a second hole 67 opened in a front end face of the cylinder head. The inlet flow passage 64 and the outlet flow passage 65 are flow passages that are formed by core supports supporting a sand core, for forming the first coolant flow passage 60, from both sides, while the first hole 66 and the second hole 67 are sand removing holes that are formed by removing the core supports. The first hole 66 is used as a coolant inlet, while the second hole 67 is used as a coolant outlet. Alternatively, the second hole 67 may be used as a coolant inlet, while the first hole 66 may be used as a coolant outlet.

Figure 28:
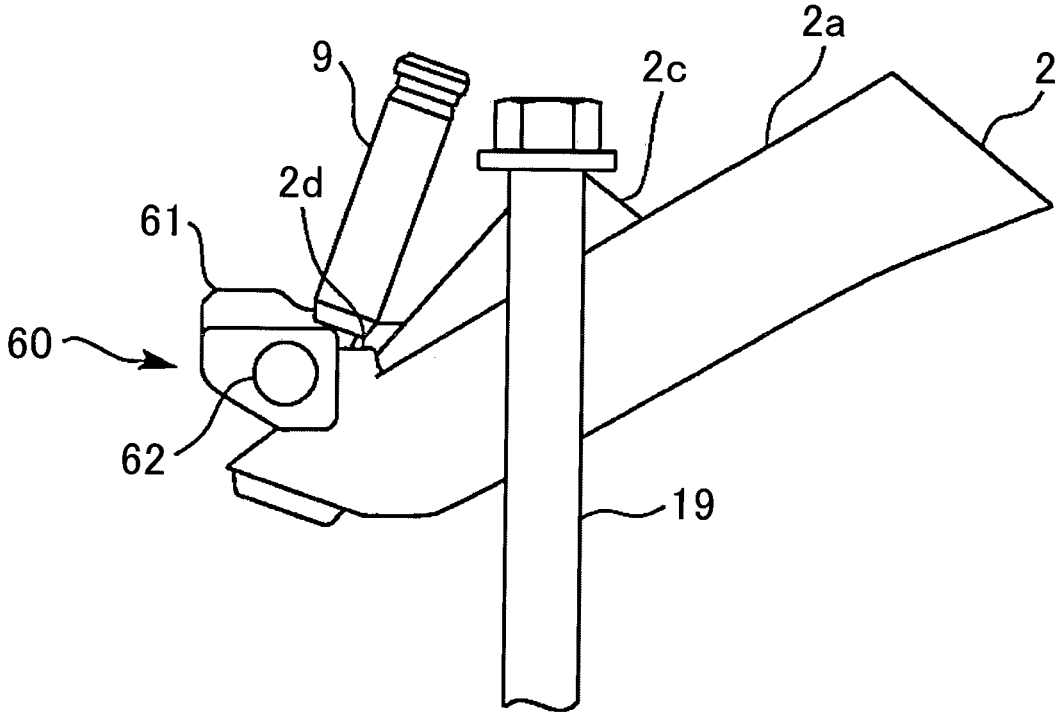
FIG. 28 is a diagram showing the positional relationship between the intake port, a head bolt, and the first coolant flow passage in the cylinder head of the fourth embodiment of the invention.

FIG. 28 is a diagram showing the positional relationship between the intake port 2, a head bolt 19, and the first coolant flow passage 60 in the cylinder head of the fourth embodiment. FIG. 28 shows the shape of the first coolant flow passage 60 around the valve guide 9 and the positional relationship between the intake port 2, the first coolant flow passage 60, and the head bolt 19 when seen from the front end side of the cylinder head assuming the inside of the cylinder head to be transparent. The first coolant flow passage 60 passes on the middle side of the cylinder head with respect to the head bolt 19. More specifically, the first coolant flow passage 60 passes near an intake valve insertion portion 2*d* formed at a forward end portion of the intake port 2.

Next, the positional relationship between the first coolant flow passage and the other components, including the second coolant flow passage, of the cylinder head will be described with reference to cross-sectional views.

Figure 24:
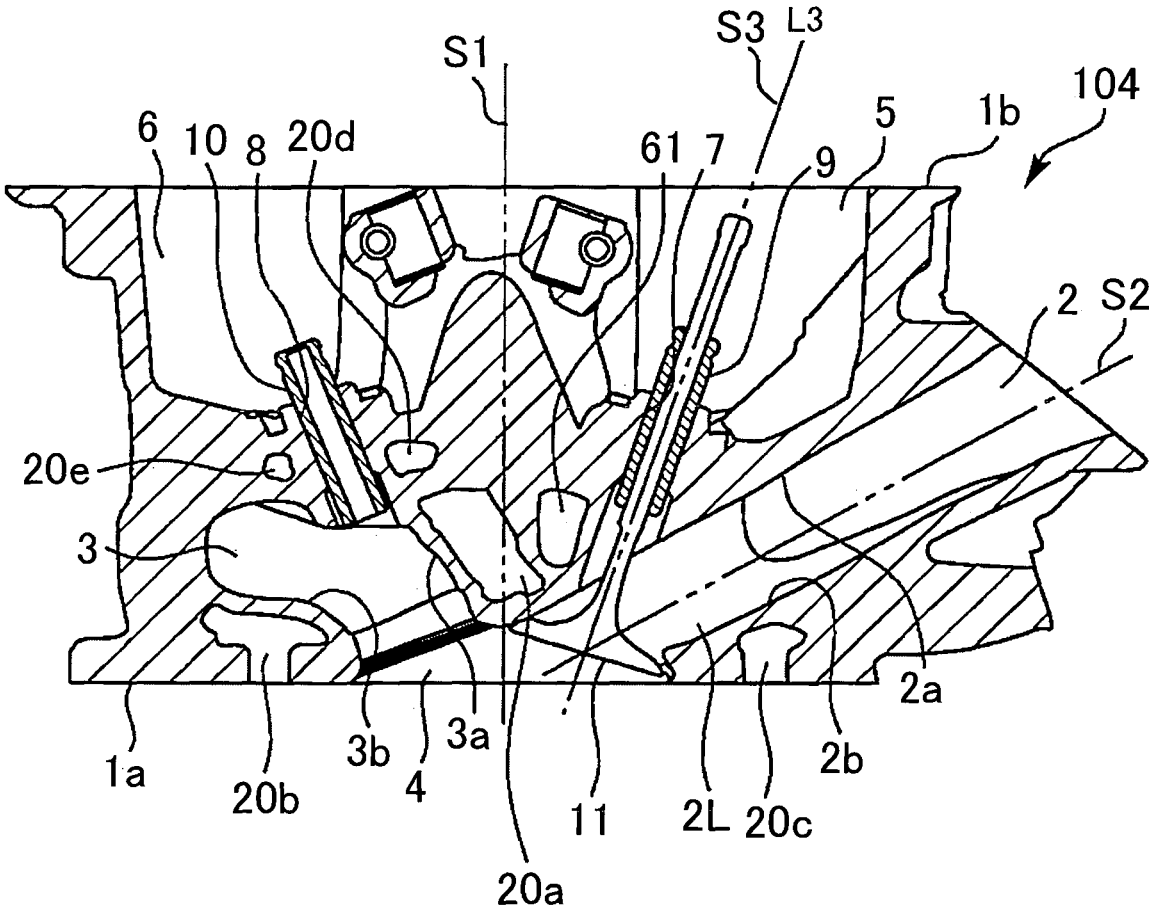
FIG. 24 is a cross-sectional view showing a cross section, including a central axis of an intake valve insertion hole and perpendicular to a longitudinal direction, of a cylinder head of a fourth embodiment of the invention, i.e. a cross section corresponding to the A-A cross section of FIG. 2.

Hereinbelow, the configurations of the coolant flow passages of the cylinder head as seen in a cross section including a central axis of an intake valve insertion hole and perpendicular to the longitudinal direction will be described. FIG. 24 is a cross-sectional view showing a cross section, including a central axis L3 of an intake valve insertion hole 7 and perpendicular to the longitudinal direction, of the cylinder head of the fourth embodiment. FIG. 24 shows the cross-sectional shapes of the first coolant flow passage and the second coolant flow passage in the cross section described above. Further, FIG. 24 shows the positional relationship between the first coolant flow passage and the other components, including the second coolant flow passage, of the cylinder head 104.

In the cross section shown in FIG. 24, near a top portion of a pent roof of a combustion chamber 4, a portion 20*k* of the second coolant flow passage is disposed in a region sandwiched between an upper surface 3*a* near an exhaust opening of an exhaust port 3 and the upper surface 2*a* near an intake opening of the intake port 2. The portion 20*k* of the second coolant flow passage, jointly with other portions 20*b*, 20*d*, and 20*e*, forms a water jacket surrounding the exhaust port 3 so as to cool the exhaust port 3 and an exhaust valve. Further, the portion 20*k* of the second coolant flow passage cools the periphery of the combustion chamber 4 that rises to a high temperature.

In the cross section shown in FIG. 24, the arc-shaped flow passage 61 of the first coolant flow passage is located in a region sandwiched between a cylinder head longitudinal direction central flat plane S1 and an intake valve insertion hole central axis plane S3. More specifically, the arc-shaped flow passage 61 is located in a region sandwiched between the portion 20*k* of the second coolant flow passage and the intake valve insertion hole 7. The arc-shaped flow passage 61 is disposed close to a root portion of the intake valve insertion hole 7. Further, the arc-shaped flow passage 61 is located on the side opposite to the top portion of the pent roof of the combustion chamber 4 with the portion 20*k* of the second coolant flow passage interposed therebetween.

According to the above-described configuration shown in FIG. 24, the upper surface 2*a* of the intake port 2, particularly the upper surface 2*a* downstream of the intake valve insertion hole 7, can be effectively cooled by the arc-shaped flow passage 61 of the first coolant flow passage. By cooling the upper surface 2*a* of the intake port 2 with the low-temperature coolant flowing in the first coolant flow passage, it is possible to efficiently cool the air flowing in the intake port 2. Further, the heat generated from the combustion chamber 4 is absorbed by the portion 20*k* of the second coolant flow passage located between the arc-shaped flow passage 61 and the top portion of the combustion chamber 4. Therefore, it is suppressed that the heat is directly transferred to the arc-shaped flow passage 61 from the combustion chamber 4. Accordingly, it is avoided that the temperature of the coolant flowing in the first coolant flow passage increases to cause a reduction in cooling efficiency for the air flowing in the intake port 2.

Figure 25:
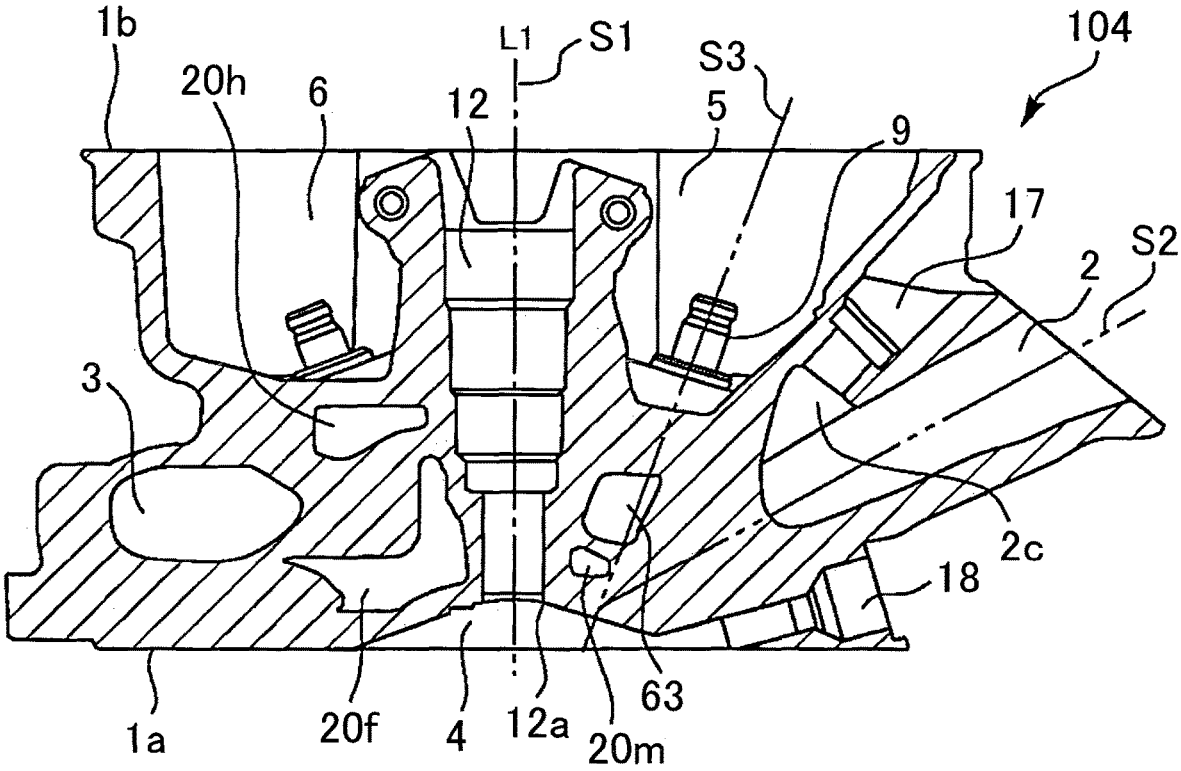
FIG. 25 is a cross-sectional view showing a cross section, including a central axis of a combustion chamber and perpendicular to the longitudinal direction, of the cylinder head of the fourth embodiment of the invention, i.e. a cross section corresponding to the B-B cross section of FIG. 2.

Next, the configurations of the coolant flow passages of the cylinder head as seen in a cross section including a central axis of the combustion chamber and perpendicular to the longitudinal direction will be described. FIG. 25 is a cross-sectional view showing a cross section, including a central axis L1 of the combustion chamber 4 and perpendicular to the longitudinal direction, of the cylinder head of the fourth embodiment. FIG. 25 shows the cross-sectional shapes of the first coolant flow passage and the second coolant flow passage in the cross section described above. Further, FIG. 25 shows the positional relationship between the first coolant flow passage and the other components, including the second coolant flow passage, of the cylinder head 104.

In the cross section shown in FIG. 25, near an open end 12*a* of a spark plug insertion hole 12, a portion 20*m* of the second coolant flow passage is disposed on the intake side with respect to the cylinder head longitudinal direction central flat plane S1. The portion 20*m* of the second coolant flow passage is disposed between the cylinder head longitudinal direction central flat plane S1 and the intake valve insertion hole central axis plane S3. The portion 20*m* of the second coolant flow passage cools the periphery of the combustion chamber 4 that rises to a high temperature, particularly the periphery of the spark plug insertion hole 12.

In the cross section shown in FIG. 25, the first connecting passage 63 of the first coolant flow passage is disposed at a position overlapping the intake valve insertion hole central axis plane S3. The first connecting passage 63 is located on the side opposite to the top portion of the combustion chamber 4, more specifically, on the side opposite to the open end 12*a* of the spark plug insertion hole 12, with the portion 20*m* of the second coolant flow passage interposed therebetween.

According to the above-described configuration shown in FIG. 25, the heat generated from the combustion chamber 4 is absorbed by the portion 20*m* of the second coolant flow passage located between the first connecting passage 63 of the first coolant flow passage and the top portion of the combustion chamber 4. Therefore, it is suppressed that the heat is directly transferred to the first connecting passage 63 from the combustion chamber 4. Accordingly, it is avoided that the temperature of the coolant flowing in the first coolant flow passage increases to cause a reduction in cooling efficiency for the air flowing in the intake port 2.

Figure 26:
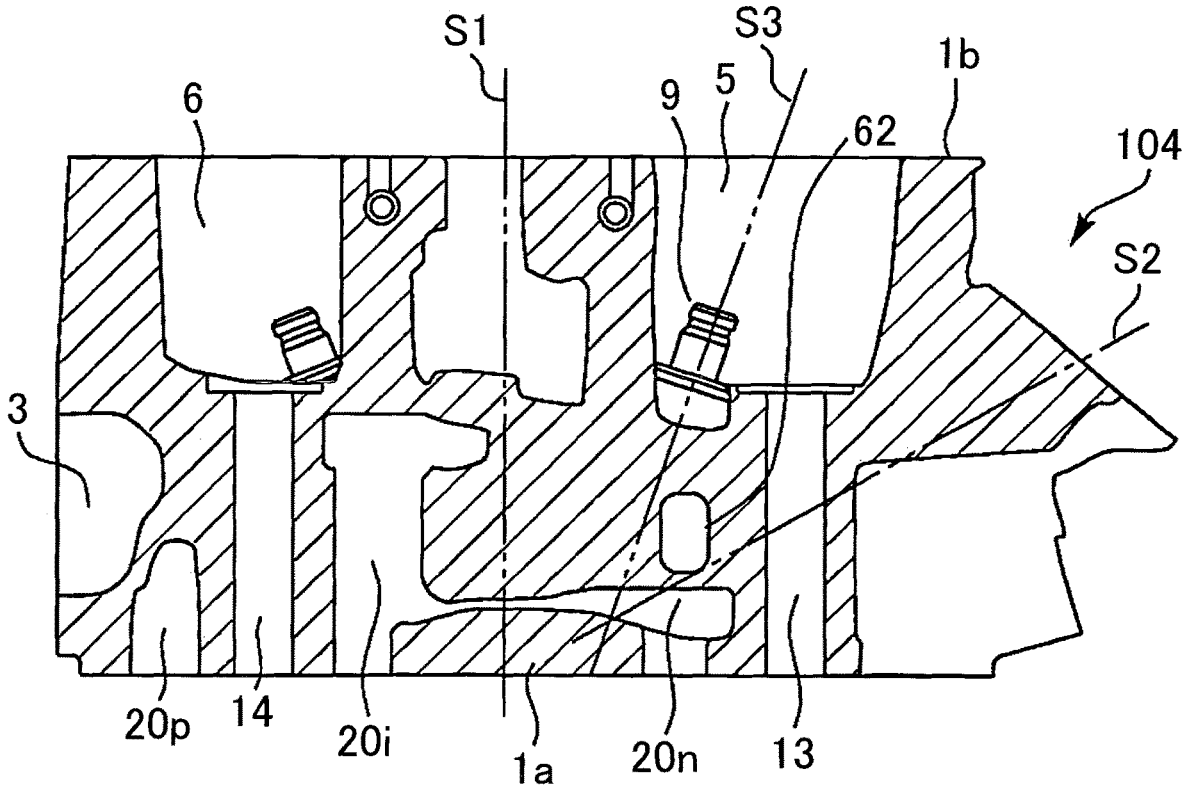
FIG. 26 is a cross-sectional view showing a cross section, passing between adjacent two combustion chambers and perpendicular to the longitudinal direction, of the cylinder head of the fourth embodiment of the invention, i.e. a cross section corresponding to the C-C cross section of FIG. 2.

Next, the configurations of the coolant flow passages of the cylinder head as seen in a cross section passing between the adjacent two combustion chambers and perpendicular to the longitudinal direction will be described. FIG. 26 is a cross-sectional view showing a cross section, passing between the adjacent two combustion chambers and perpendicular to the longitudinal direction, of the cylinder head of the fourth embodiment, specifically, a cross section including central axes of head bolt insertion holes 13 and 14 and perpendicular to the longitudinal direction. FIG. 26 shows the cross-sectional shapes of the first coolant flow passage and the second coolant flow passage in the cross section described above. Further, FIG. 26 shows the positional relationship between the first coolant flow passage and the other components, including the second coolant flow passage, of the cylinder head 104.

In the cross section shown in FIG. 26, a portion 20*n* of the second coolant flow passage is disposed between the cylinder head longitudinal direction central flat plane S1 and the intake-side head bolt insertion hole 13. The portion 20*n* of the second coolant flow passage is opened at a cylinder block mating surface 1*a* and communicates with a portion 20*i* of the second coolant flow passage in the middle of the cylinder head 104.

In the cross section shown in FIG. 26, the second connecting passage 62 of the first coolant flow passage is located between an intake port central line plane S2 and the intake valve insertion hole central axis plane S3 in a region closer to the middle of the cylinder head 104 with respect to the intake-side head bolt insertion hole 13. The second connecting passage 62 is located on the side opposite to the cylinder block mating surface 1*a* with the portion 20*n* of the second coolant flow passage interposed therebetween.

According to the above-described configuration shown in FIG. 26, the heat transferred from the cylinder block mating surface 1*a* is absorbed by the portion 20*n* of the second coolant flow passage located between the cylinder block mating surface 1*a* and the second connecting passage 62 of the first coolant flow passage. Therefore, it is suppressed that the heat is directly transferred to the second connecting passage 62 from the cylinder block mating surface 1*a*. Accordingly, it is avoided that the temperature of the coolant flowing in the first coolant flow passage increases to cause a reduction in cooling efficiency for the air flowing in the intake port 2.

Next, a fifth embodiment of the invention will be described with reference to the drawings. A cylinder head of the fifth embodiment is a modification of the cylinder head of the fourth embodiment. The cylinder head of the fifth embodiment differs from the cylinder head of the fourth embodiment in the configuration of a first coolant flow passage. Hereinbelow, the configuration of the first coolant flow passage of the cylinder head of the fifth embodiment will be described. The description will be made using a cross-sectional view showing a cross section, including a central axis of an intake valve insertion hole and perpendicular to a longitudinal direction, of the cylinder head. In the figure, components equivalent to those of the fourth embodiment are assigned the same symbols.

Figure 29:
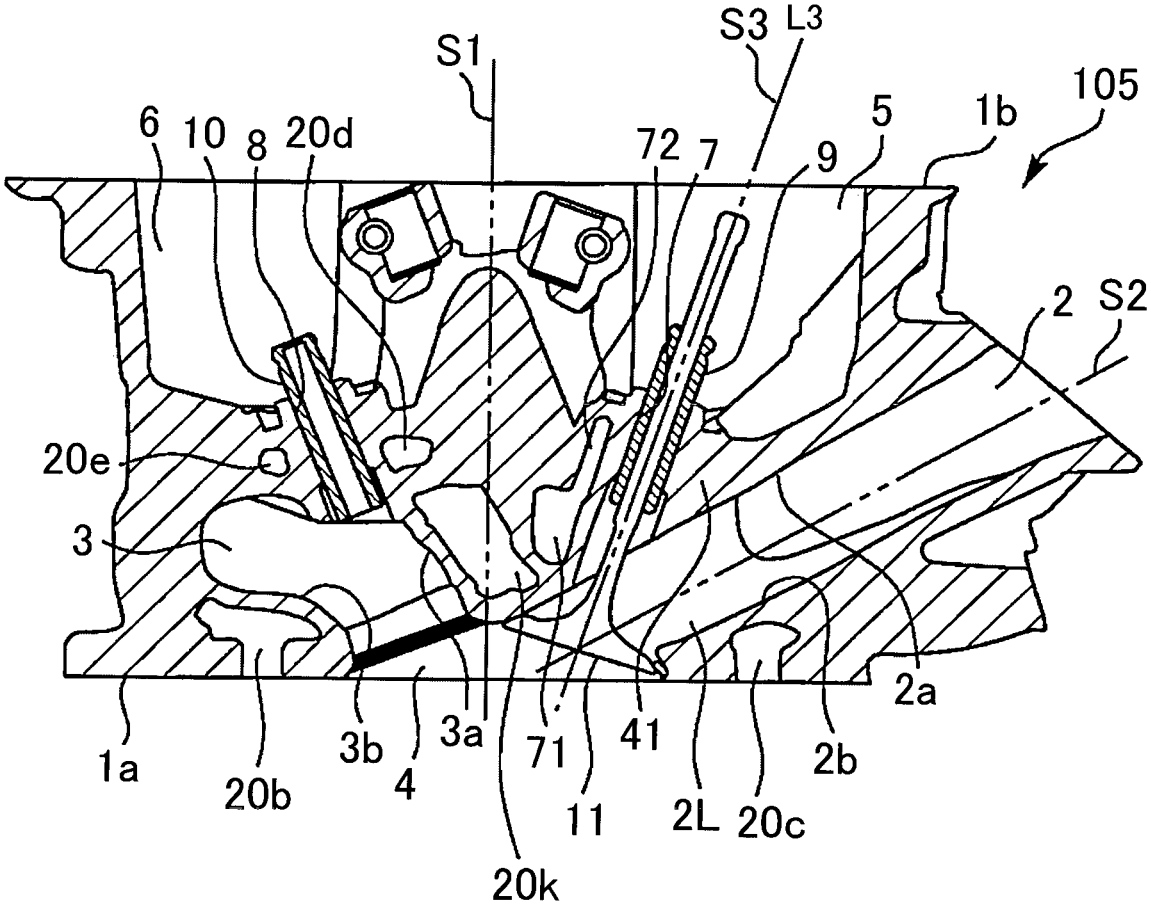
FIG. 29 is a cross-sectional view showing a cross section, including a central axis of an intake valve insertion hole and perpendicular to a longitudinal direction, of a cylinder head of a fifth embodiment of the invention, i.e. a cross section corresponding to the A-A cross section of FIG. 2.

Hereinbelow, the configurations of coolant flow passages of the cylinder head as seen in a cross section including a central axis of an intake valve insertion hole and perpendicular to the longitudinal direction will be described. FIG. 29 is a cross-sectional view showing a cross section, including a central axis L3 of an intake valve insertion hole 7 and perpendicular to the longitudinal direction, of the cylinder head of the fifth embodiment. FIG. 29 shows the cross-sectional shapes of a first coolant flow passage and a second coolant flow passage in the cross section described above. Further, FIG. 29 shows the positional relationship between the first coolant flow passage and the other components, including the second coolant flow passage, of the cylinder head 105.

In the cross section shown in FIG. 29, portions 71 and 72 of the first coolant flow passage are located in a region sandwiched between a cylinder head longitudinal direction central flat plane S1 and an intake valve insertion hole central axis plane S3. The portion 71 of the first coolant flow passage corresponds to the arc-shaped flow passage of the first coolant flow passage of the fourth embodiment, while the portion 72 of the first coolant flow passage corresponds to the arc-shaped flow passage of the first coolant flow passage of the third embodiment. The portions 71 and 72 of the first coolant flow passage are formed by integrating those arc-shaped flow passages.

According to the above-described configuration shown in FIG. 29, an upper surface 2*a* of an intake port 2, particularly the upper surface 2*a* downstream of the intake valve insertion hole 7, can be effectively cooled by the portion 71 of the first coolant flow passage. Further, the periphery of the intake valve insertion hole 7 connected to the upper surface 2*a* of the intake port 2 can be effectively cooled by the portion 72 of the first coolant flow passage.

Next, a sixth embodiment of the invention will be described with reference to the drawings. A cylinder head of the sixth embodiment is a cylinder head of a diesel engine. First, the basic configuration of the cylinder head of the sixth embodiment will be described. The description will be made using cross-sectional views of the cylinder head.

Figure 30:
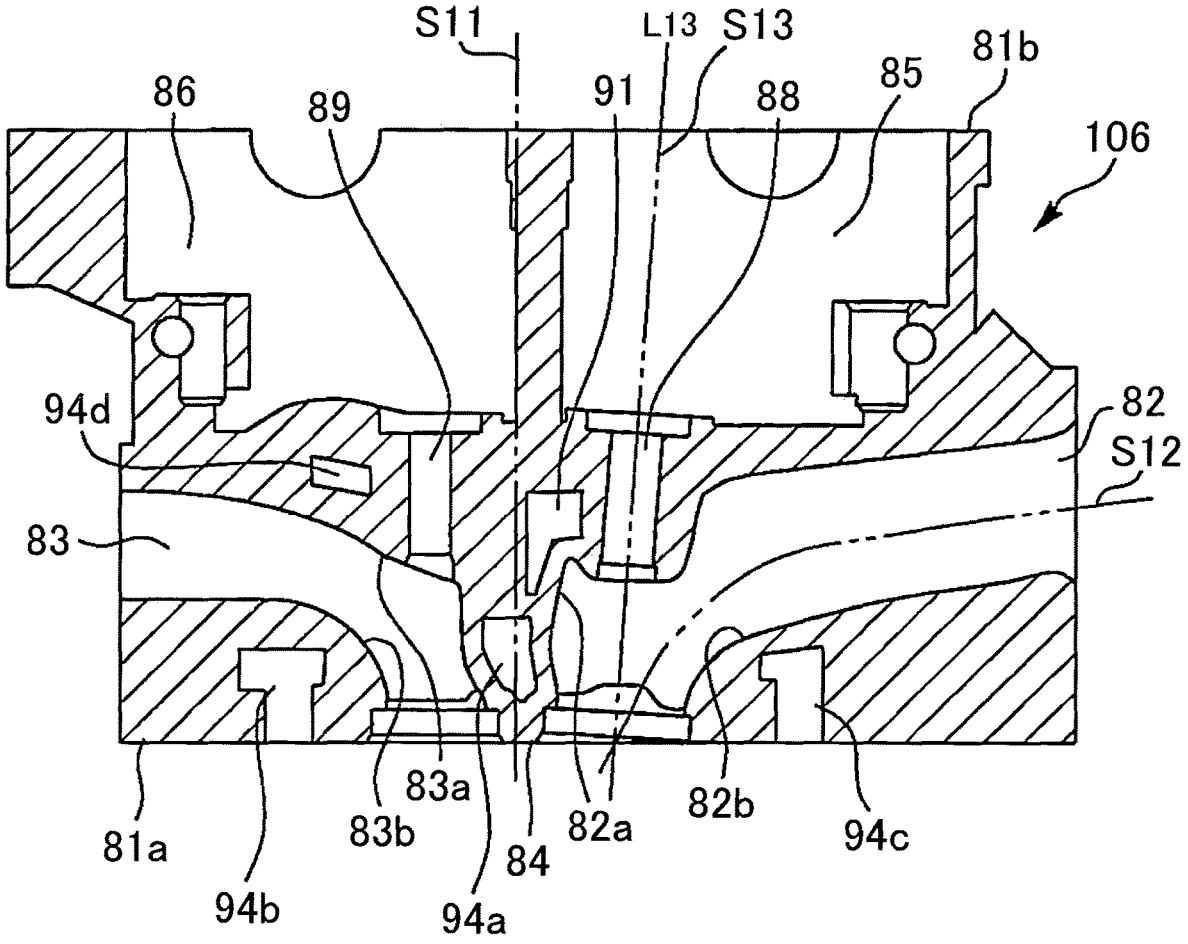
FIG. 30 is a cross-sectional view showing a cross section, including a central axis of an intake valve insertion hole and perpendicular to a longitudinal direction, of a cylinder head of a sixth embodiment of the invention.

Hereinbelow, the basic configuration of the cylinder head of the sixth embodiment will be described. FIG. 30 is a cross-sectional view showing a cross section, including a central axis L13 of an intake valve insertion hole 88 and perpendicular to a longitudinal direction, of a cylinder head 106 of the sixth embodiment. As shown in FIG. 30, a cylinder block mating surface 81*a* as a bottom surface of the cylinder head 106 is formed with a combustion chamber 84. When the cylinder head 106 is mounted on a cylinder block, the combustion chamber 84 closes a cylinder from above to form a closed space. However, this portion called the combustion chamber 84 is flush with the cylinder block mating surface 81*a* and is not recessed differently from the case of a spark-ignition engine. While the term "combustion chamber" has been customarily used in this technical field, when a closed space sandwiched between the cylinder head 106 and a piston is defined as a combustion chamber, the combustion chamber 84 can be called a combustion chamber ceiling surface.

An intake port 82 is opened to the combustion chamber 84 on the right side with respect to a cylinder head longitudinal direction central flat plane S11 as seen from the front end side of the cylinder head 106. A connecting portion between the intake port 82 and the combustion chamber 84, i.e. an open end on the combustion chamber side of the intake port 82, serves as an intake opening that is configured to be opened and closed by an intake valve. Since two intake valves are provided for each cylinder, each combustion chamber 84 is formed with two intake openings. The cylinder head 106 includes the independent intake port 82 for each intake opening. An inlet of the intake port 82 is opened in a right side surface of the cylinder head 106. The intake port 82 extends obliquely downward to the left from an opening of the inlet and then curves on the way to communicate with the intake opening formed in the combustion chamber 84.

The cylinder head 106 is formed with the intake valve insertion hole 88 for passing a stem of the intake valve therethrough. In the upper surface of the cylinder head 106 on the inner side of a head cover attaching surface 81*b*, there is provided an intake-side valve drive mechanism chamber 85 that receives therein a valve drive mechanism configured to drive the intake valves. The intake valve insertion hole 88 extends straight substantially upward from an upper surface 82*a*, near the combustion chamber 84, of the intake port 82 to the intake-side valve drive mechanism chamber 85. The central axis L13 of the intake valve insertion hole 88 is included in the cross section shown in FIG. 30, i.e. in a flat plane perpendicular to the longitudinal direction.

An exhaust port 83 is opened to the combustion chamber 84 on the left side as seen from the front end side of the cylinder head 106. A connecting portion between the exhaust port 83 and the combustion chamber 84, i.e. an open end on the combustion chamber side of the exhaust port 83, serves as an exhaust opening that is configured to be opened and closed by an exhaust valve. Since two exhaust valves are provided for each cylinder, each combustion chamber 84 is formed with two exhaust openings of the exhaust port 83. The exhaust port 83 extends from the exhaust openings formed in the combustion chambers 84 to an outlet opened in a left side surface of the cylinder head 106. The exhaust port 83 is not independently provided for each of the exhaust openings of the combustion chambers 84, but the single exhaust port 83 is provided for the exhaust openings of the combustion chambers 84. That is, the exhaust port 83 is composed of a plurality of branch ports respectively extending from the exhaust openings and a collective port into which the branch ports are joined.

The cylinder head 106 is formed with an exhaust valve insertion hole 89 for passing a stem of the exhaust valve therethrough. In the upper surface of the cylinder head. 106 on the inner side of the head cover attaching surface 81*b*, there is provided an exhaust-side valve drive mechanism chamber 86 that receives therein a valve drive mechanism configured to drive the exhaust valves. The exhaust valve insertion hole 89 extends straight substantially upward from an upper surface 83*a*, near the combustion chamber 84, of the exhaust port 83 to the exhaust-side valve drive mechanism chamber 86.

Figure 31:
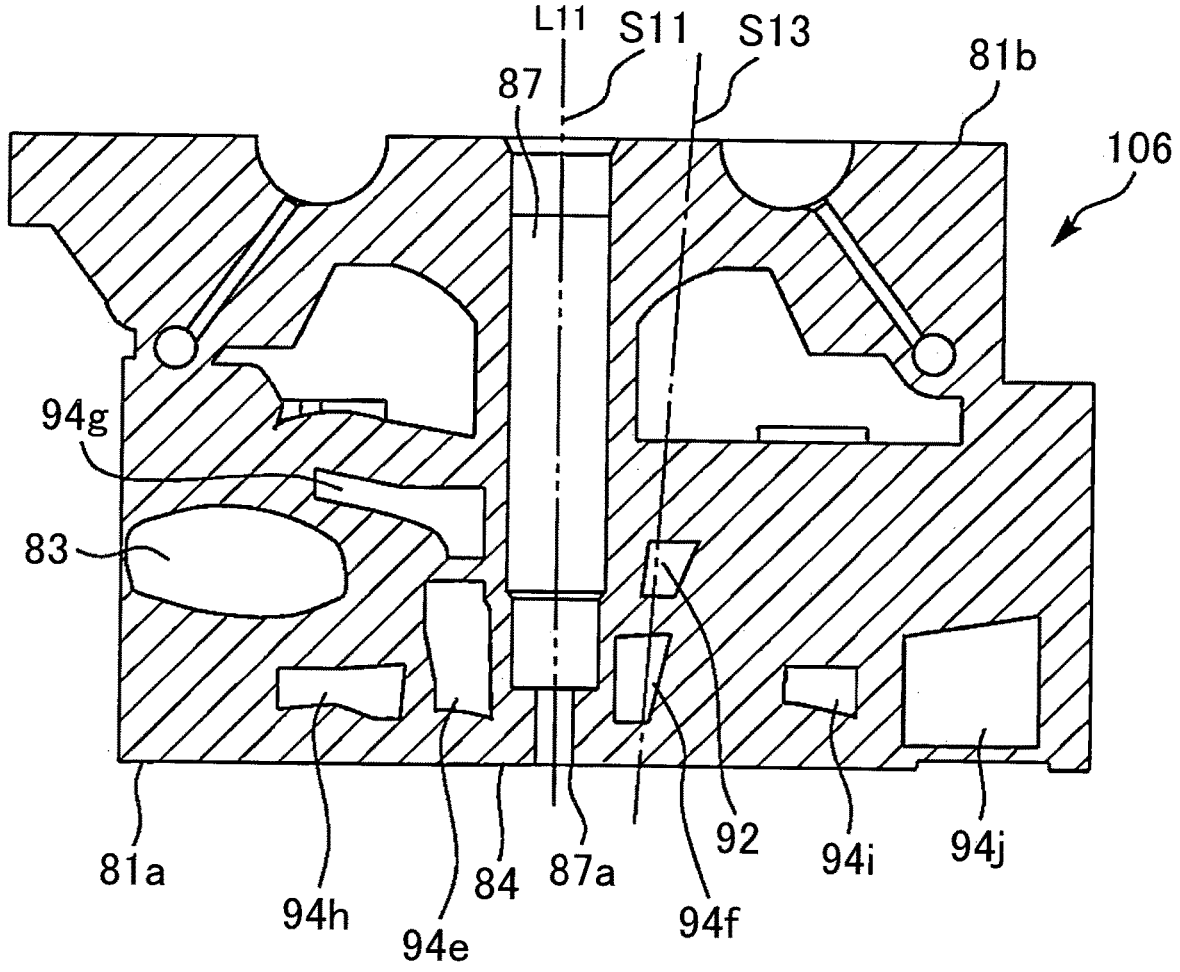
FIG. 31 is a cross-sectional view showing a cross section, including a central axis of a combustion chamber and perpendicular to the longitudinal direction, of the cylinder head of the sixth embodiment of the invention.

Next, the basic configuration of the cylinder head as seen in a cross section including a central axis of the combustion chamber and perpendicular to the longitudinal direction will be described. FIG. 31 is a cross-sectional view showing a cross section, including a central axis L11 of the combustion chamber 84 and perpendicular to the longitudinal direction, of the cylinder head 106. An injector insertion hole 87 for attaching an injector that injects fuel into the cylinder is formed in the upper surface of the cylinder head 106. The injector insertion hole 87 is formed vertically downward along the central axis L11 of the combustion chamber 84 from the upper surface of the cylinder head 106 and is opened to the planar combustion chamber 84 at the center thereof. The central axis L11 of the combustion chamber 84 coincides with a central axis of the cylinder when the cylinder head 106 is mounted on the cylinder block. In the cross section shown in FIG. 31, part of the exhaust port 83 having the manifold shape is seen.

Next, the configurations of coolant flow passages of the cylinder head 106 of the sixth embodiment will be described. The cylinder head of the sixth embodiment includes dual coolant flow passages connected to independent and separate circulation systems. In the first coolant flow passage, a coolant at a temperature lower than that of a coolant flowing in the second coolant flow passage flows.

Hereinbelow, the configurations of the coolant flow passages of the cylinder head of the sixth embodiment will be described. FIG. 30 shows the cross-sectional shapes of the first coolant flow passage and the second coolant flow passage of the cylinder head 106 in the cross section including the central axis L13 of the intake valve insertion hole 88 and perpendicular to the longitudinal direction. Further, FIG. 30 shows the positional relationship between the first coolant flow passage and the other components, including the second coolant flow passage, of the cylinder head 106. In the cross section shown in FIG. 30, regions denoted by symbols 94*a*, 94*b*, 94*c*, and 94*d* are cross sections of portions of the second coolant flow passage. Although the portions 94*a*, 94*b*, 94*c*, and 94*d* of the second coolant flow passage are separated from each other in the cross section shown in FIG. 30, these portions are joined into one inside the cylinder head 106.

In the cross section shown in FIG. 30, on the cylinder head longitudinal direction central flat plane S11, the portion 94*a* of the second coolant flow passage is disposed in a region sandwiched between the upper surface 83*a* near the exhaust opening of the exhaust port 83 and the upper surface 82*a* near the intake opening of the intake port 82. The cylinder head longitudinal direction central flat plane S11 is a virtual flat plane including the central axes L11 of the combustion chambers 84 and parallel to the longitudinal direction. The portion 94*b* of the second coolant flow passage is disposed between a lower surface 83*b* of the exhaust port 83 and the cylinder block mating surface 81*a*. The portion 94*b* of the second coolant flow passage is opened at the cylinder block mating surface 81*a* and communicates with a coolant flow passage on the cylinder block side. The portion 94*d* of the second coolant flow passage is disposed on the left side of the exhaust valve insertion hole 89 above the upper surface 83*a* of the exhaust port 83. The portions 94*a*, 94*b*, and 94*d* of the second coolant flow passage form a water jacket surrounding the exhaust port 83 so as to cool the exhaust port 83 and the exhaust valve. Further, the portion 94*a* of the second coolant flow passage cools the periphery of the combustion chamber 84 that rises to a high temperature.

In the cross section shown in FIG. 30, the portion 94*c* of the second coolant flow passage is disposed between an intake port central line plane S12 and the cylinder block mating surface 81*a*, more specifically, between a lower surface 82*b* of the intake port 82 and the cylinder block mating surface 81*a*. The intake port central line plane S12 is a virtual plane defined as a plane including central lines of the intake ports 82. The portion 94*c* of the second coolant flow passage is opened at the cylinder block mating surface 81*a*. This opening of the cylinder block mating surface 81*a* communicates with the coolant flow passage on the cylinder block side. A coolant having passed through the inside of the cylinder block is introduced into the portion 94*c* of the second coolant flow passage via the opening of the cylinder block mating surface 81*a*.

In the cross section shown in FIG. 30, a first coolant flow passage 91 is located between an intake valve insertion hole central axis plane S13 and the cylinder head longitudinal direction central flat plane S11. The intake valve insertion hole central axis plane S13 is a virtual flat plane including the central axes L13 of the intake valve insertion holes 88 and parallel to the longitudinal direction. The portion 94*a* of the second coolant flow passage is located between the first coolant flow passage 91 and the combustion chamber 84.

According to the above-described configuration shown in FIG. 30, the upper surface 82*a* of the intake port 82, particularly the upper surface 82*a* downstream of the intake valve insertion hole 88, can be effectively cooled by the first coolant flow passage 91 in which the coolant at a temperature lower than that of the coolant cooling the exhaust port 83 flows. By cooling the upper surface 82*a* of the intake port 82 with the low-temperature coolant flowing, it is possible to efficiently cool the air flowing in the intake port 82.

The portion 94*a* of the second coolant flow passage is located between the combustion chamber 84 and the first coolant flow passage 91. Since the heat generated from the combustion chamber 84 is absorbed by the portion 94*a* of the second coolant flow passage, it is suppressed that the heat is directly transferred to the first coolant flow passage 91 from the combustion chamber 84. Accordingly, it is avoided that the coolant in the first coolant flow passage 91 is heated by the heat generated from the combustion chamber 84, resulting in a reduction in cooling efficiency for the air flowing in the intake port 82. Heat transfer from the cylinder block mating surface 81*a* to the lower surface 82*b* of the intake port 82 can be suppressed by the portion 94*c* of the second coolant flow passage.

Next, the configurations of the coolant flow passages of the cylinder head as seen in the cross section including the central axis of the combustion chamber and perpendicular to the longitudinal direction will be described. FIG. 31 shows the cross-sectional shapes of the first coolant flow passage and the second coolant flow passage of the cylinder head 106 in the cross section including the central axis L11 of the combustion chamber 84 and perpendicular to the longitudinal direction. Further, FIG. 31 shows the positional relationship between the first coolant flow passage and the other components, including the second coolant flow passage, of the cylinder head 106. In the cross section shown in FIG. 31, regions denoted by symbols 94*e*, 94*f*, 94*g*, 94*h*, 94*i*, and 94*j* are cross sections of portions of the second coolant flow passage. Although the portions 94*e*, 94*f*, 94*g*, 94*h*, 94*i*, and 94*j* of the second coolant flow passage are separated from each other in the cross section shown in FIG. 31, these portions are joined into one with the portions 94*a*, 94*b*, 94*c*, and 94*d* shown in FIG. 30 inside the cylinder head 106.

In the cross section shown in FIG. 31, the portions 94*f*, 94*i*, and 94*j* of the second coolant flow passage are disposed on the intake side with respect to the cylinder head longitudinal direction central flat plane S11. The portion 94*f* of the second coolant flow passage is disposed close to an intake-side wall surface of a forward end portion of the injector insertion hole 87 between the cylinder head longitudinal direction central flat plane S11 and the intake valve insertion hole central axis plane S13.

Near an open end 87*a* of the injector insertion hole 87, the portion 94*e* of the second coolant flow passage is disposed on the exhaust side with respect to the cylinder head longitudinal direction central flat plane S11. The portion 94*e* of the second coolant flow passage is disposed along an exhaust-side wall surface of the forward end portion of the injector insertion hole 87. The portion 94*g* of the second coolant flow passage is disposed above the portion 94*e* of the second coolant flow passage, while the portion 94*h* of the second coolant flow passage is disposed on the left side of the portion 94*e* of the second coolant flow passage. The portions 94*e*, 94*g*, and 94*h* of the second coolant flow passage form a water jacket surrounding the exhaust port 83 jointly with the portions 94*a*, 94*b*, and 94*d* shown in FIG. 30.

In the cross section shown in FIG. 31, a first coolant flow passage 92 is located between the cylinder head longitudinal direction central flat plane S11 and the intake port central line plane S12. The first coolant flow passage 92 is located on the side opposite to the open end 87*a* of the injector insertion hole 87 with the portion 94*f* of the second coolant flow passage interposed therebetween.

According to the above-described configuration shown in FIG. 31, the heat generated from the combustion chamber 84 is absorbed by the portion 94*f* of the second coolant flow passage located between the first coolant flow passage 92 and the combustion chamber 84. Therefore, it is suppressed that the heat is directly transferred to the first coolant flow passage 92 from the combustion chamber 84. Accordingly, it is avoided that the temperature of the coolant flowing in the first coolant flow passage 92 increases to cause a reduction in cooling efficiency for the air flowing in the intake port 82.

Next, a seventh embodiment of the invention will be described with reference to the drawings. The seventh embodiment has a feature in the configuration of an engine cooling system. The engine cooling system of the seventh embodiment can be combined with any of the cylinder heads of the first to sixth embodiments. However, herein, a description will be given of an example combined with the cylinder head of the first embodiment.

Figure 32:
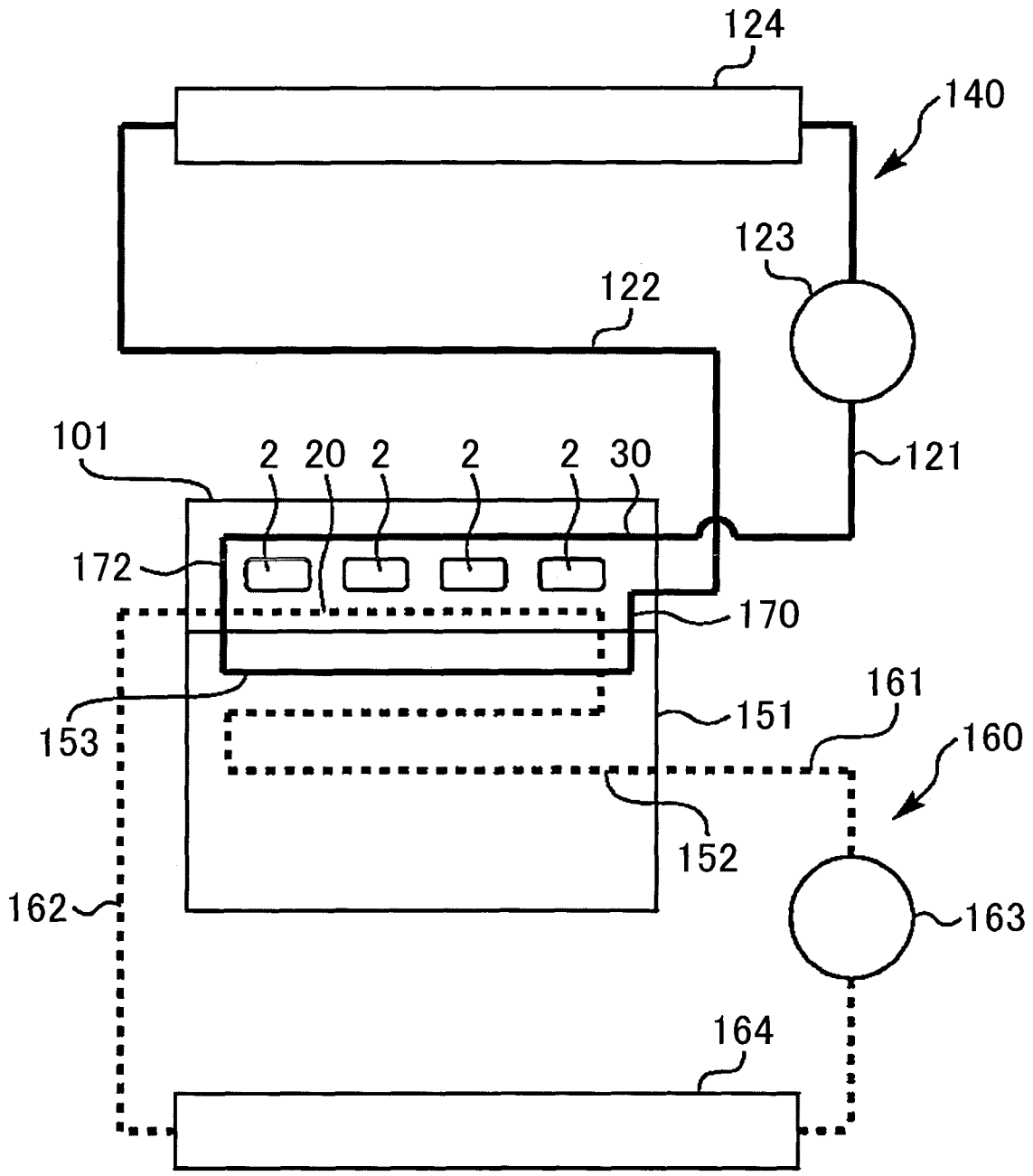
FIG. 32 is a diagram showing a configuration of an engine cooling system of a seventh embodiment of the invention.

Hereinbelow, referring to FIG. 32, the configuration of the engine cooling system of the seventh embodiment of the invention will be described. In FIG. 32, components equivalent to those of the engine cooling system of the first embodiment shown in FIG. 1 are assigned the same symbols. An overlapping description of those equivalent components will be omitted or simplified.

The engine cooling system of the seventh embodiment includes dual circulation systems 140 and 160. The configuration of the second circulation system 160 is the same as that of the first embodiment, while the configuration of the first circulation system 140 differs from that of the first embodiment. Hereinbelow, the configuration of the first circulation system 140 of the seventh embodiment will be described.

The configuration of the first circulation system will be described hereinbelow. The first circulation system 140 forms a closed loop independent of the second circulation system 160 and includes a radiator 124 and a water pump 123. A cylinder head 101 is formed with a coolant inlet to which a coolant introducing pipe 121 of the first circulation system 140 is connected, and with a coolant outlet to which a coolant discharge pipe 122 of the first circulation system 140 is connected. The coolant inlet of the cylinder head 101 is connected to a coolant outlet of the radiator 124 via the coolant introducing pipe 121, while the coolant outlet of the cylinder head 101 is connected to a coolant inlet of the radiator 124 via the coolant discharge pipe 122. The coolant introducing pipe 121 is provided with the water pump 123. The first circulation system 140 may further include a liquid temperature sensor and a thermostat for liquid temperature adjustment (neither shown).

The first circulation system 140 includes a first coolant flow passage 30 formed in the cylinder head 101 and a fourth coolant flow passage 153 formed in a cylinder block 151. The first coolant flow passage 30 communicates with the coolant inlet. Like a third coolant flow passage 152, the fourth coolant flow passage 153 includes a water jacket surrounding cylinders. The cylinder head 101 is formed therein with an intermediate communication passage 172 communicating the first coolant flow passage 30 with the fourth coolant flow passage 153. The intermediate communication passage 172 and the fourth coolant flow passage 153 are connected to each other via an opening formed in a mating surface between the cylinder head 101 and the cylinder block 151. Further, the cylinder head 101 is formed therein with an outlet communication passage 170 communicating the fourth coolant flow passage 153 with the coolant outlet. The outlet communication passage 170 and the fourth coolant flow passage 153 are connected to each other via an opening formed in the mating surface between the cylinder head 101 and the cylinder block 151.

A coolant circulating in the first circulation system 140 is introduced into the coolant inlet formed in the cylinder head 101 and flows in the first coolant flow passage 30 of the cylinder head 101, thereby cooling intake ports 2. The coolant used for cooling the intake ports 2 then flows in the fourth coolant flow passage 153 of the cylinder block 151 to cool the cylinders and then is discharged from the coolant outlet formed in the cylinder head 101.

According to the configuration shown in FIG. 32, the coolant having passed through the first coolant flow passage 30 is configured to flow in the cylinder block 151 and can be used for cooling the cylinders.

Figure 33:
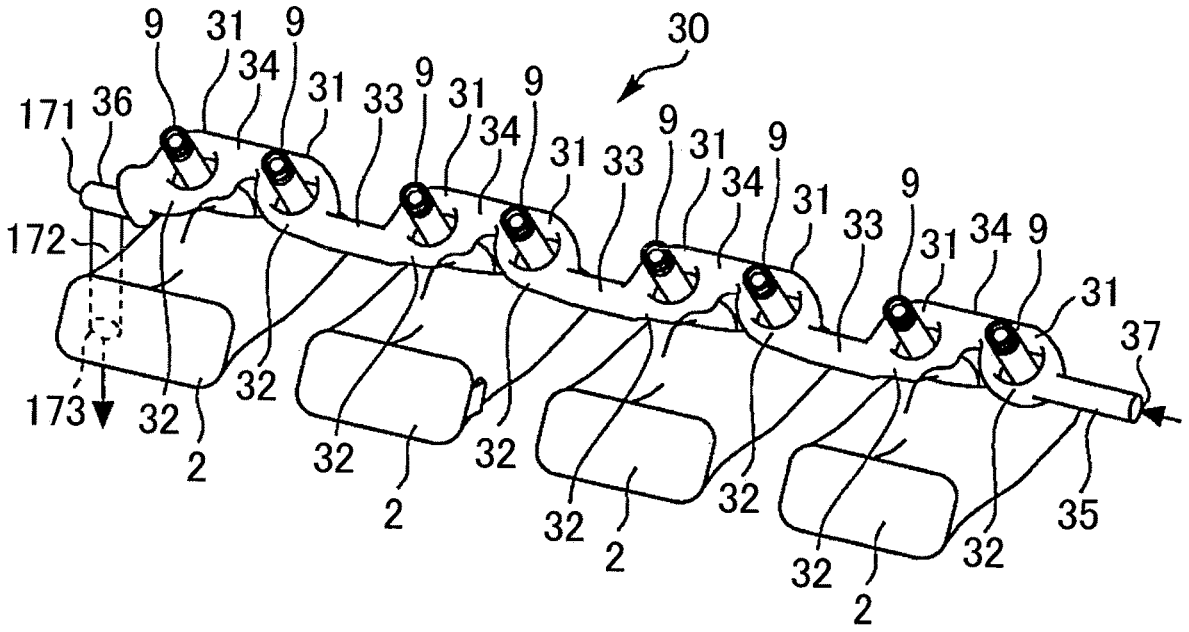
FIG. 33 is a perspective view showing a configuration of an intermediate communication passage in the engine cooling system of the seventh embodiment of the invention.

Next, the configuration of the intermediate communication passage will be described. FIG. 33 is a perspective view showing, in a see-through manner, the intake ports 2 and the first coolant flow passage 30 of the cylinder head 101 in the engine cooling system of the seventh embodiment. In FIG. 33, components equivalent to those of the first coolant flow passage of the first embodiment shown in FIG. 6 are assigned the same symbols. As shown in FIG. 33, the intermediate communication passage 172 connects an outlet flow passage 36 of the first coolant flow passage 30 to an outlet hole 173 opened in the cylinder block mating surface. The intermediate communication passage 172 is formed between a front end face of the cylinder head and the intake port 2 closest thereto. In the seventh embodiment, an open end (a hole opened in the front end face of the cylinder head) 171 of the outlet flow passage 36 is sealed. The coolant having passed through the first coolant flow passage 30 passes, from the outlet flow passage 36, through the intermediate communication passage 172 and flows to the outlet hole 173 of the cylinder block mating surface. Alternatively, the outlet hole 173 may be used as a coolant inlet, while a first hole 37 may be used as a coolant outlet.

Figure 34:
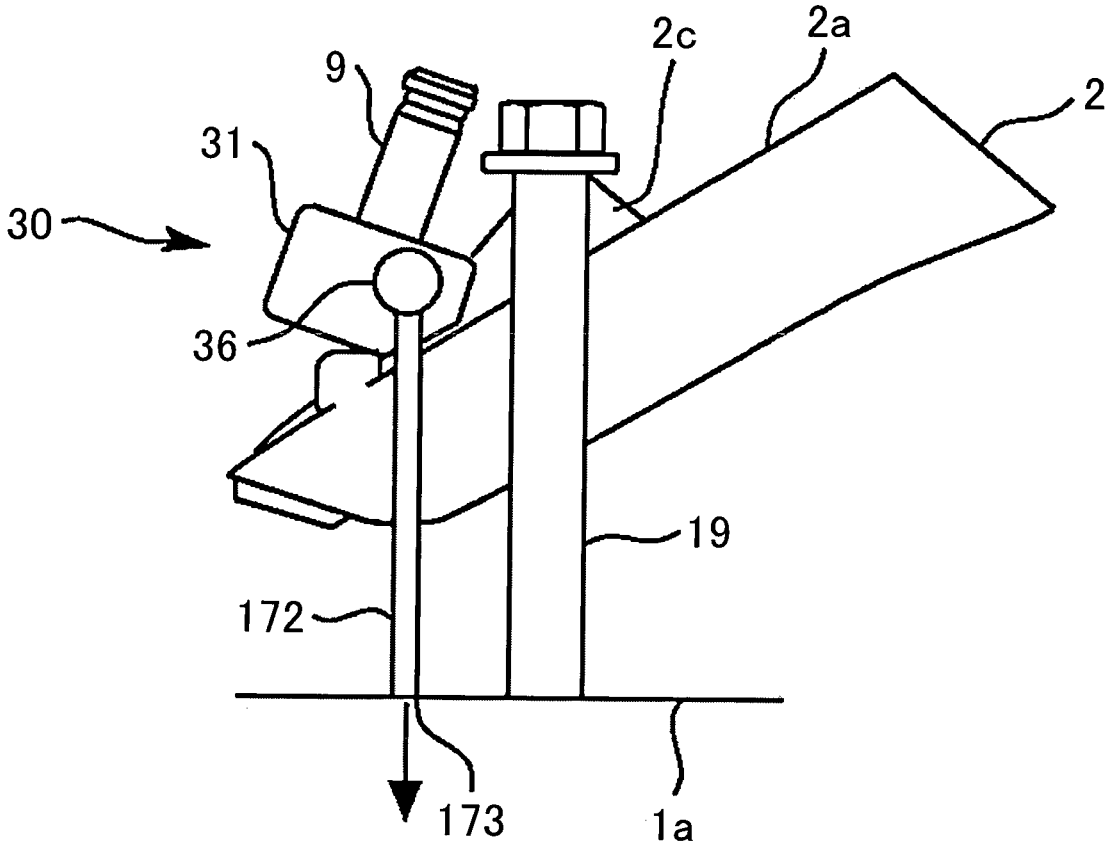
FIG. 34 is a diagram showing the positional relationship between the intermediate communication passage shown in FIG. 33 and a head bolt.

FIG. 34 is a diagram showing the positional relationship between the intermediate communication passage 172 and a head bolt 19 when seen from the front end side of the cylinder head assuming the inside of the cylinder head to be transparent. The intermediate communication passage 172 is formed toward the outlet flow passage 36 from the outlet hole 173 at a position on the middle side of the cylinder head with respect to the head bolt 19. The intermediate communication passage 172 may be formed by drilling.

Figure 35:
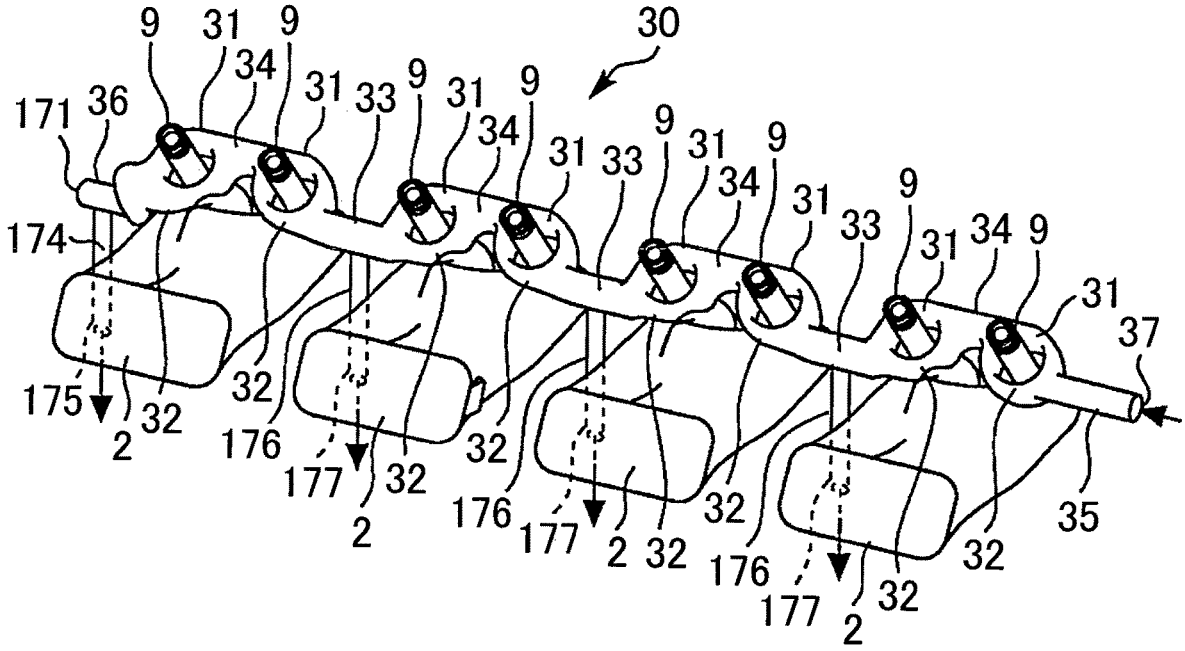
FIG. 35 is a diagram showing a modification of the intermediate communication passage of the engine cooling system of the seventh embodiment of the invention.

Hereinbelow, a modification of the intermediate communication passage will be described. FIG. 35 is a diagram showing the configuration of the modification of the intermediate communication passage. In FIG. 35, components equivalent to those of the first coolant flow passage of the first embodiment shown in FIG. 6 are assigned the same symbols. This modification includes an intermediate communication passage 174 extending from an outlet flow passage 36 and intermediate communication passages 176 respectively extending from second connecting passages 33. The intermediate communication passage 174 is formed between a front end face of a cylinder head and an intake port 2 closest thereto and connects the outlet flow passage 36 to an outlet hole 175 opened in a cylinder block mating surface. Each intermediate communication passage 176 is formed between adjacent two intake ports 2 and connects the second connecting passage 33 to an outlet hole 177 opened in the cylinder block mating surface. A cylinder block is formed with coolant flow passages corresponding to the intermediate communication passages 174 and 176. The outlet hole 175 may be used as a coolant inlet, while a first hole 37 may be used as a coolant outlet.

Figure 36:
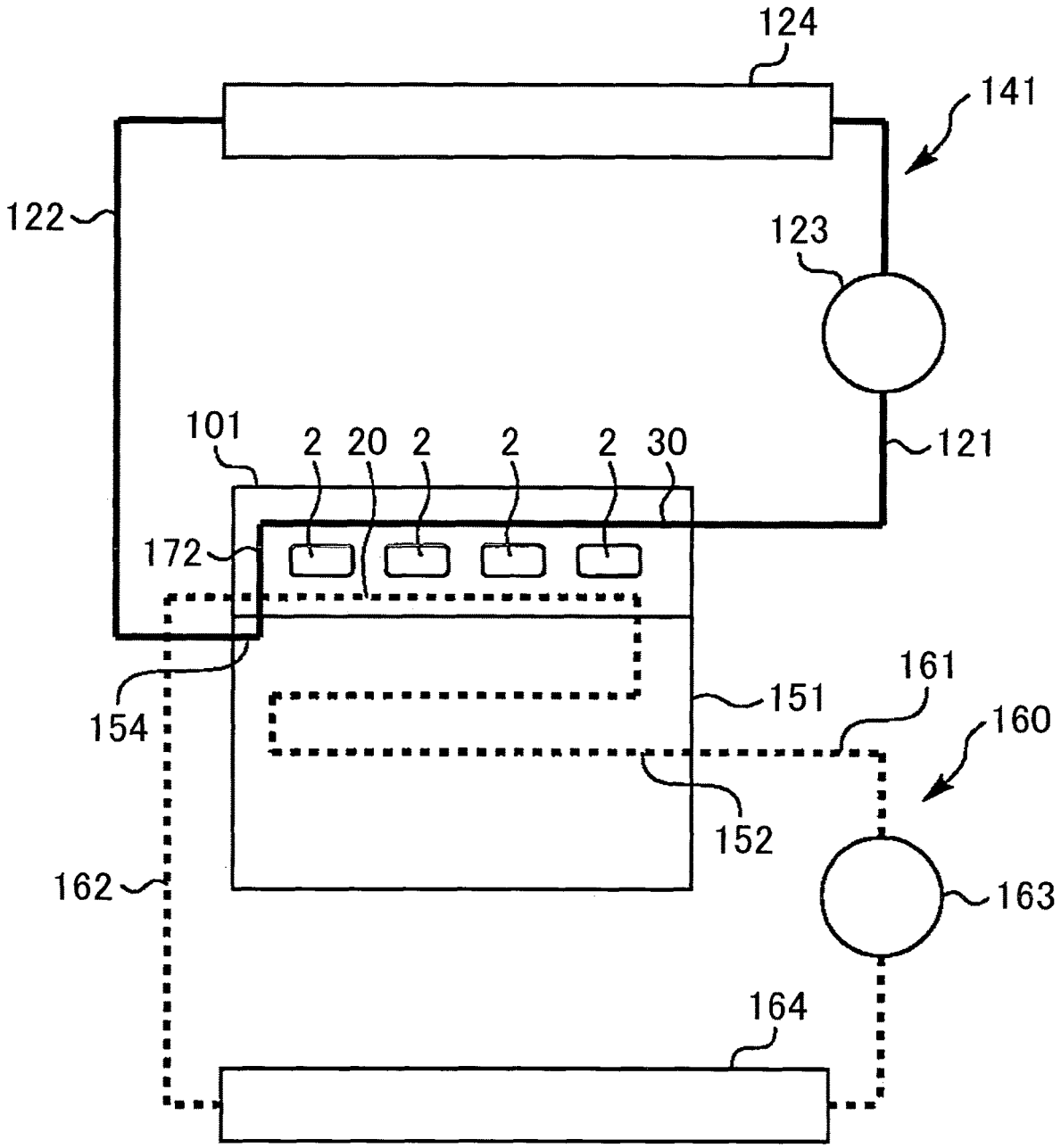
FIG. 36 is a diagram showing a modification of a first circulation system of the engine cooling system of the seventh embodiment of the invention.

Hereinbelow, a modification of the first circulation system will be described. FIG. 36 is a diagram showing the modification of the first circulation system. In this modification, a first circulation system 141 includes a first coolant flow passage 30 formed in a cylinder head 101 and an intermediate communication passage 172. The cylinder head 101 is formed with a coolant inlet to which a coolant introducing pipe 121 of the first circulation system 141 is connected, while a cylinder block 151 is formed with a coolant outlet to which a coolant discharge pipe 122 of the first circulation system 141 is connected. The cylinder block 151 is formed therein with an outlet communication passage 154 communicating the intermediate communication passage 172 with the coolant outlet. The intermediate communication passage 172 and the outlet communication passage 154 are connected to each other via an opening formed in a mating surface between the cylinder head 101 and the cylinder block 151.

A coolant circulating in the first circulation system 141 is introduced into the coolant inlet formed in the cylinder head 101 and flows in the first coolant flow passage 30 of the cylinder head 101, thereby cooling intake ports 2. The coolant used for cooling the intake ports 2 then flows into the cylinder block 151 through the intermediate communication passage 172 and is discharged from the coolant outlet formed in the cylinder block 151. When the coolant having passed through the first coolant flow passage 30 is not used for cooling cylinders, the configuration of this modification can be employed.

Next, an eighth embodiment of the invention will be described with reference to the drawings. The eighth embodiment has a feature in the configuration of an engine cooling system. The engine cooling system of the eighth embodiment can be combined with any of the cylinder heads of the first to sixth embodiments. However, herein, a description will be given of an example combined with the cylinder head of the first embodiment.

Figure 37:
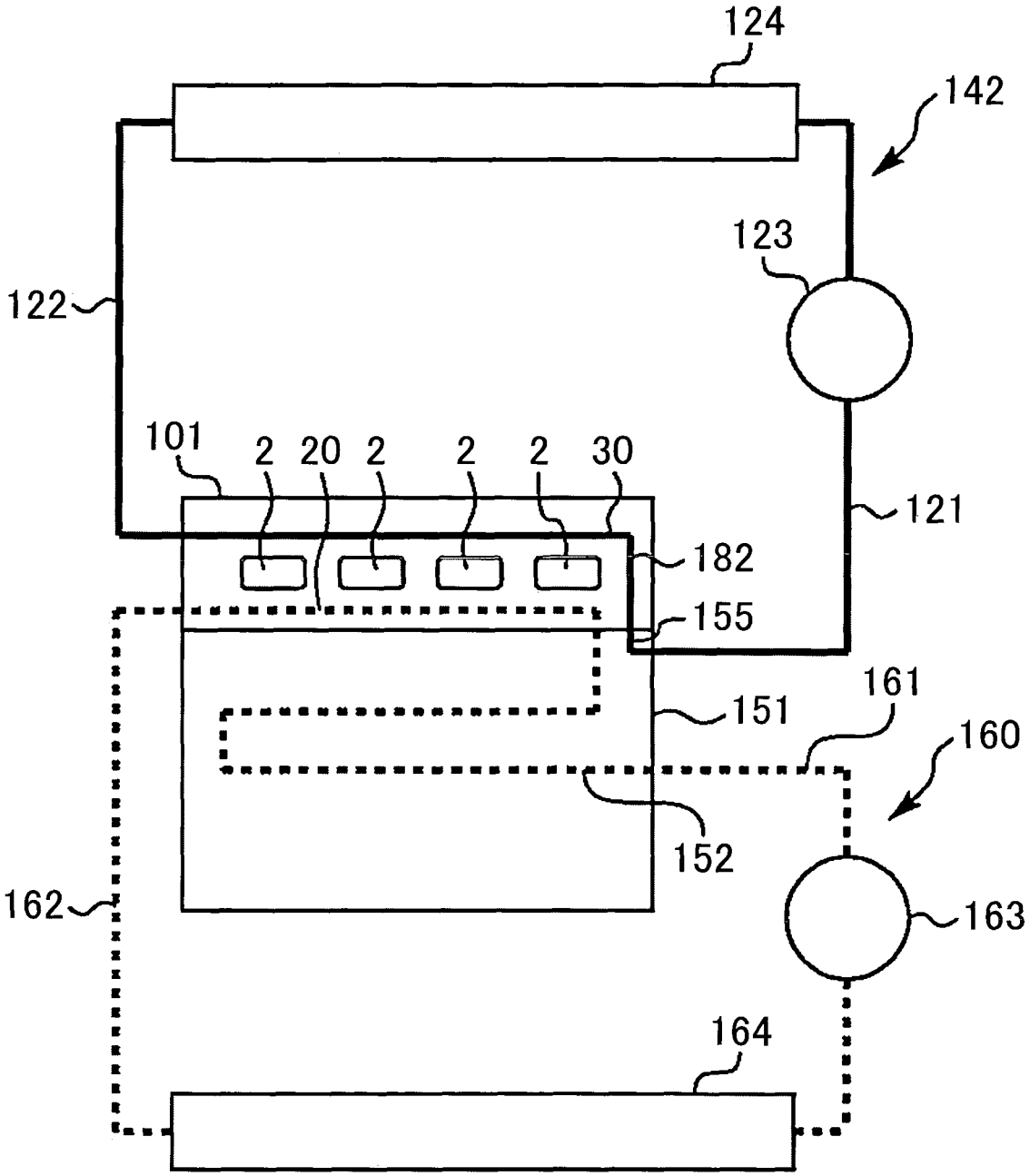
FIG. 37 is a diagram showing a configuration of an engine cooling system of an eighth embodiment of the invention.

Hereinbelow, referring to FIG. 37, the configuration of the engine cooling system of the eighth embodiment of the invention will be described. In FIG. 37, components equivalent to those of the engine cooling system of the first embodiment shown in FIG. 1 are assigned the same symbols. An overlapping description of those equivalent components will be omitted or simplified.

The engine cooling system of the eighth embodiment includes dual circulation systems 142 and 160. The configuration of the second circulation system 160 is the same as that of the first embodiment, while the configuration of the first circulation system 142 differs from that of the first embodiment. Hereinbelow, the configuration of the first circulation system 142 of the eighth embodiment will be described.

The configuration of the first circulation system will be described hereinbelow. The first circulation system 142 forms a closed loop independent of the second circulation system 160 and includes a radiator 124 and a water pump 123. A coolant inlet to which a coolant introducing pipe 121 of the first circulation system 142 is connected is formed in a cylinder block 151. A cylinder head 101 is formed with a coolant outlet to which a coolant discharge pipe 122 of the first circulation system 142 is connected. The coolant inlet of the cylinder block 151 is connected to a coolant outlet of the radiator 124 via the coolant introducing pipe 121, while the coolant outlet of the cylinder head 101 is connected to a coolant inlet of the radiator 124 via the coolant discharge pipe 122. The coolant introducing pipe 121 is provided with the water pump 123. The first circulation system 142 may further include a liquid temperature sensor and a thermostat for liquid temperature adjustment (neither shown).

The first circulation system 142 includes a first coolant flow passage 30 formed in the cylinder head 101. The first coolant flow passage 30 communicates with the coolant outlet. The cylinder block 151 is formed therein with an inlet communication passage 155 connecting the coolant inlet to the cylinder head 101. The cylinder head 101 is formed therein with an intermediate communication passage 182 communicating the first coolant flow passage 30 with the inlet communication passage 155. The inlet communication passage 155 and the intermediate communication passage 182 are connected to each other via an opening formed in a mating surface between the cylinder head 101 and the cylinder block 151.

A coolant circulating in the first circulation system 142 enters the coolant inlet formed in the cylinder block 151, then flows into the cylinder head 101 through the inlet communication passage 155, and then is introduced into the first coolant flow passage 30 through the intermediate communication passage 182. The coolant flows in the first coolant flow passage 30 to cool intake ports 2 and is discharged from the coolant outlet formed in the cylinder head 101.

According to the configuration shown in FIG. 37, the coolant which is to flow in the first coolant flow passage 30 can be introduced from the cylinder block 151. When it is not possible to form a coolant inlet in the cylinder head 101, the configuration shown in FIG. 37 is useful.

Figure 38:
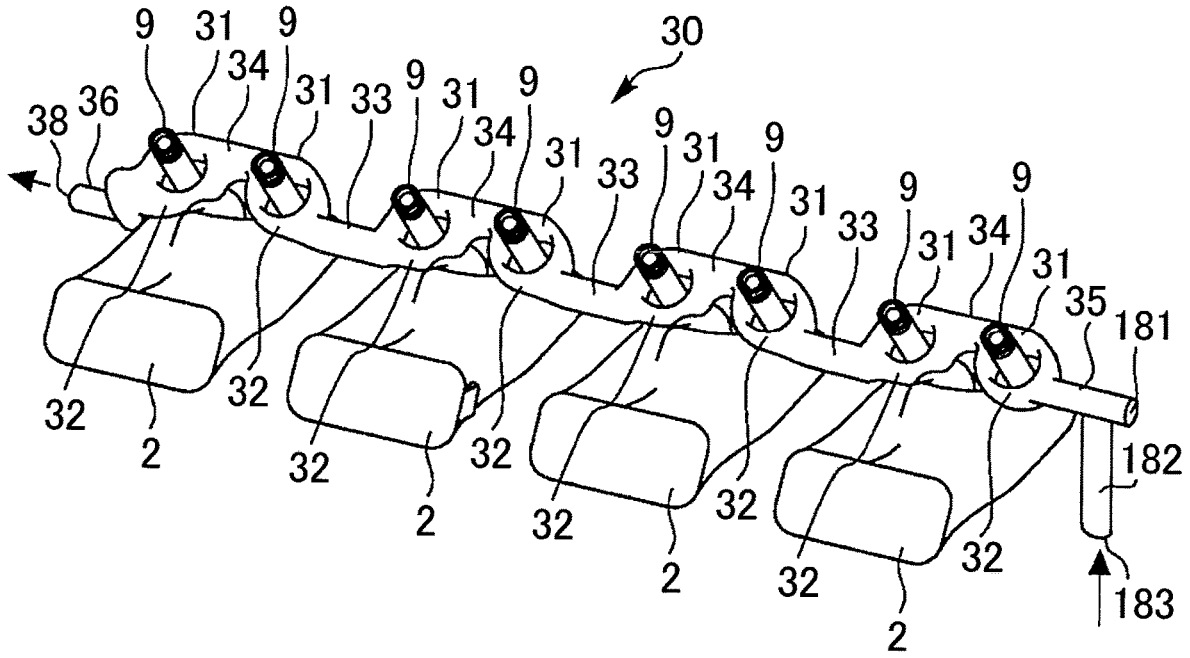
FIG. 38 is a perspective view showing, in a see-through manner, intake ports and a first coolant flow passage of a cylinder head in the engine cooling system of the eighth embodiment of the invention.

Next, the configuration of the intermediate communication passage will be described. FIG. 38 is a perspective view showing, in a see-through manner, the intake ports 2 and the first coolant flow passage 30 of the cylinder head 101 in the engine cooling system of the eighth embodiment. In FIG. 38, components equivalent to those of the first coolant flow passage of the first embodiment shown in FIG. 6 are assigned the same symbols. As shown in FIG. 38, the intermediate communication passage 182 connects an inlet flow passage 35 of the first coolant flow passage 30 to an inlet hole 183 opened in the cylinder block mating surface. The intermediate communication passage 182 is formed between a rear end face of the cylinder head and the intake port 2 closest thereto. In the eighth embodiment, an open end (a hole opened in the rear end face of the cylinder head) 181 of the inlet flow passage 35 is sealed. The coolant for cooling the intake ports 2 is introduced from the inlet hole 183 of the cylinder block mating surface into the first coolant flow passage 30 through the intermediate communication passage 182. Alternatively, a second hole 38 may be used as a coolant inlet, while the inlet hole 183 may be used as a coolant outlet.

Next, a ninth embodiment of the invention will be described with reference to the drawings. The ninth embodiment has a feature in the configuration of an engine cooling system. The engine cooling system of the ninth embodiment can be combined with any of the cylinder heads of the first to sixth embodiments. However, herein, a description will be given of an example combined with the cylinder head of the first embodiment.

Figure 39:
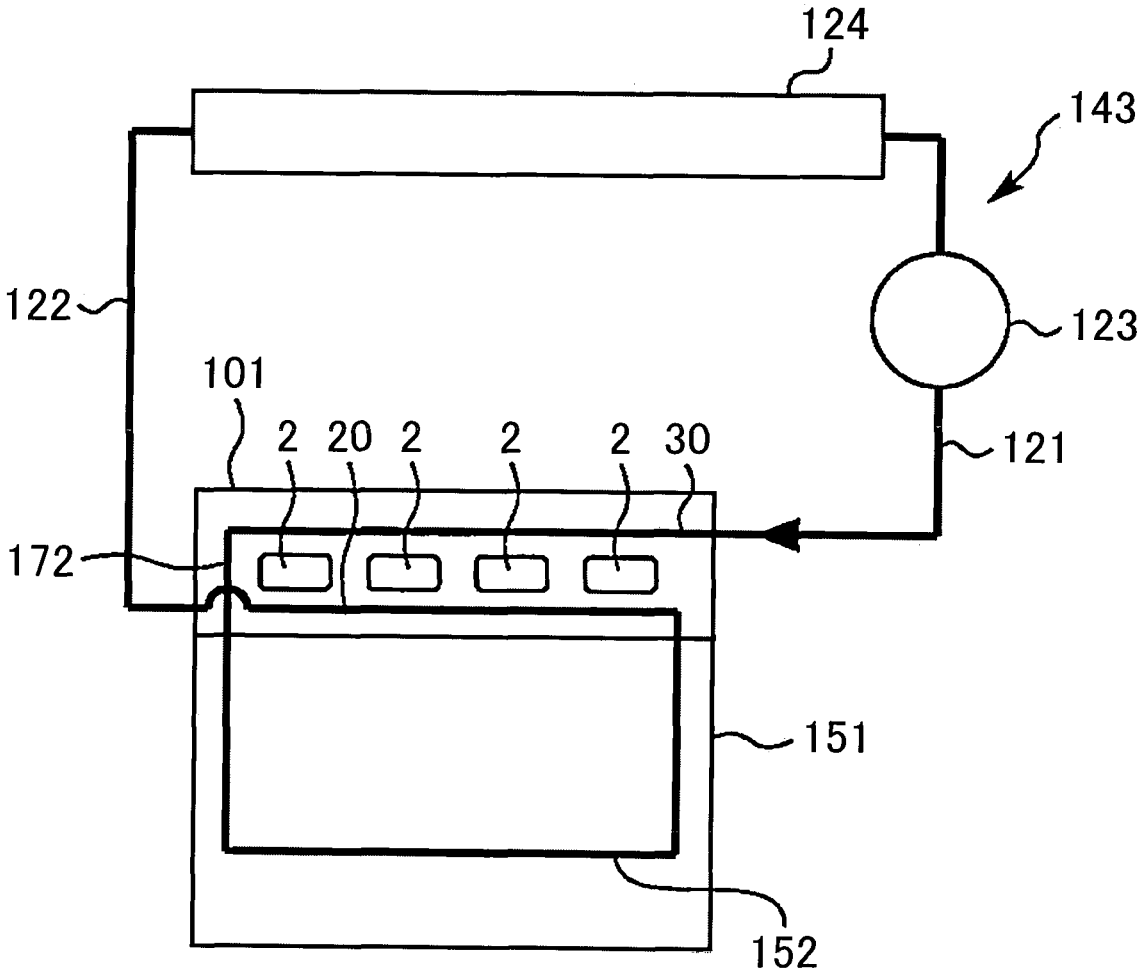
FIG. 39 is a diagram showing a configuration of an engine cooling system of a ninth embodiment of the invention.

Hereinbelow, referring to FIG. 39, the configuration of the engine cooling system of the ninth embodiment of the invention will be described. In FIG. 39, components equivalent to those of the engine cooling system of the first embodiment shown in FIG. 1 are assigned the same symbols. An overlapping description of those equivalent components will be omitted or simplified.

Hereinbelow, the configuration of a circulation system will be described. The engine cooling system of the ninth embodiment includes a single circulation system 143. The circulation system 143 includes a radiator 124 and a water pump 123. A cylinder head 101 is formed with a coolant inlet to which a coolant introducing pipe 121 of the circulation system 143 is connected, and with a coolant outlet to which a coolant discharge pipe 122 of the circulation system 143 is connected. The coolant inlet is connected to a coolant outlet of the radiator 124 via the coolant introducing pipe 121, while the coolant outlet is connected to a coolant inlet of the radiator 124 via the coolant discharge pipe 122. The coolant introducing pipe 121 is provided with the water pump 123. The circulation system 143 may further include a liquid temperature sensor and a thermostat for liquid temperature adjustment (neither shown).

The circulation system 143 includes a first coolant flow passage 30 and a second coolant flow passage 20 formed in the cylinder head 101 and a third coolant flow passage 152 formed in a cylinder block 151. The first coolant flow passage 30 communicates with the coolant inlet. The cylinder head 101 is formed therein with an intermediate communication passage 172 communicating the first coolant flow passage 30 with the third coolant flow passage 152. The intermediate communication passage 172 and the third coolant flow passage 152 are connected to each other via an opening formed in a mating surface between the cylinder head 101 and the cylinder block 151. The third coolant flow passage 152 of the cylinder block 151 and the second coolant flow passage 20 of the cylinder head 101 communicate with each other via openings formed at a plurality of portions of the mating surface between the cylinder head 101 and the cylinder block 151. The second coolant flow passage 20 communicates with the coolant outlet.

A coolant circulating in the circulation system 143 is introduced into the coolant inlet formed in the cylinder head 101 and flows in the first coolant flow passage 30 of the cylinder head 101, thereby cooling intake ports 2 from upper surface sides thereof. The coolant used for cooling the intake ports 2 then flows in the third coolant flow passage 152 of the cylinder block 151 to cool cylinders. The coolant used for cooling the cylinders returns to the cylinder head 101 and flows in the second coolant flow passage 20 of the cylinder head 101 to cool lower surfaces of exhaust ports and the intake ports 2, and then is discharged from the coolant outlet formed in the cylinder head 101.

According to the configuration shown in FIG. 39, while cooling those portions, required to be cooled, of the cylinder head 101 and the cylinder block 151 by the single circulation system 143, it is possible to achieve that the temperature of the coolant flowing in the first coolant flow passage 30 is made lower than that of the coolant flowing in the second coolant flow passage 20.

Next, a tenth embodiment of the invention will be described with reference to the drawings. The tenth embodiment has a feature in the configuration of an engine cooling system. The engine cooling system of the tenth embodiment can be combined with any of the cylinder heads of the first to sixth embodiments. However, herein, a description will be given of an example combined with the cylinder head of the first embodiment.

Figure 40:
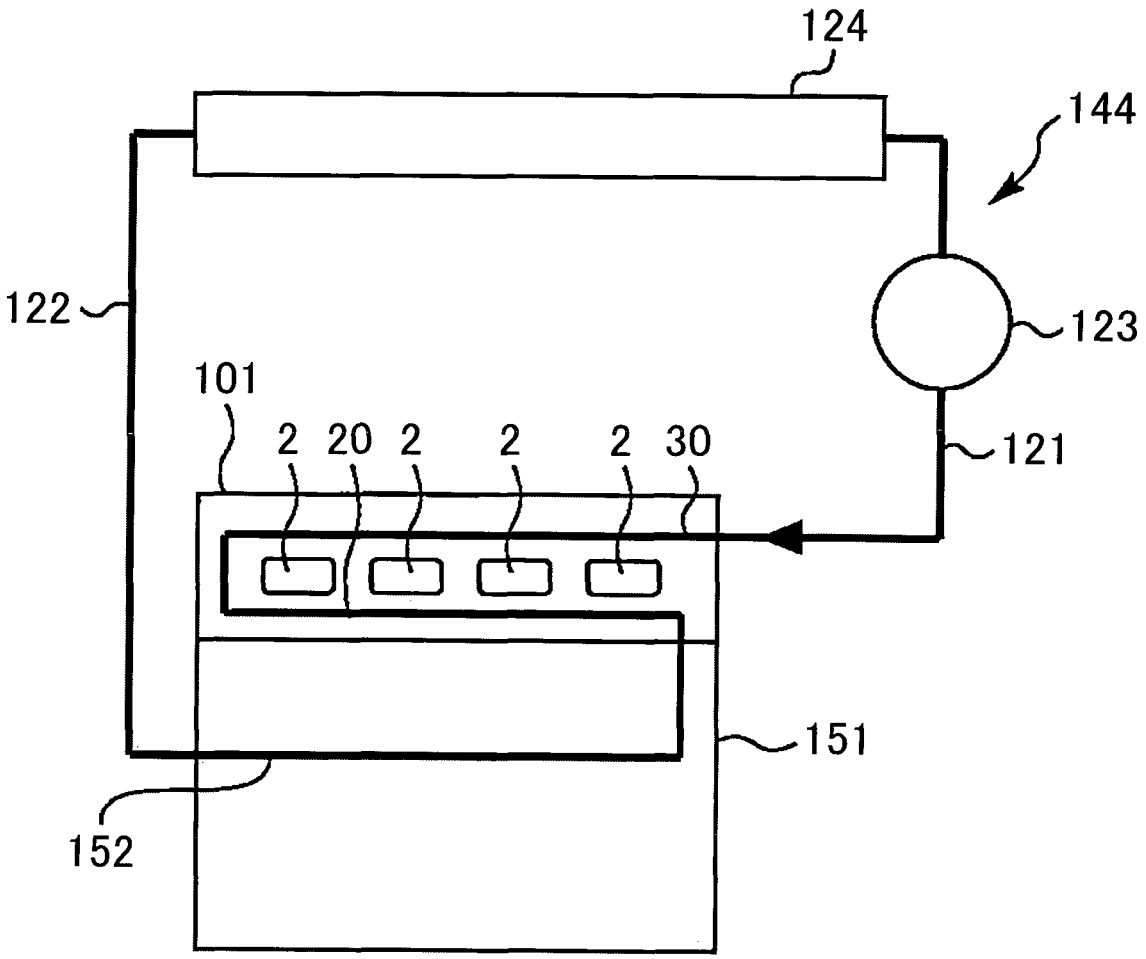
FIG. 40 is a diagram showing a configuration of an engine cooling system of a tenth embodiment of the invention.

Hereinbelow, referring to FIG. 40, the configuration of the engine cooling system of the tenth embodiment of the invention will be described. In FIG. 40, components equivalent to those of the engine cooling system of the first embodiment shown in FIG. 1 are assigned the same symbols. An overlapping description of those equivalent components will be omitted or simplified.

Hereinbelow, the configuration of a circulation system will be described. The engine cooling system of the tenth embodiment includes a single circulation system 144. The circulation system 144 includes a radiator 124 and a water pump 123. A cylinder head 101 is formed with a coolant inlet to which a coolant introducing pipe 121 of the circulation system 144 is connected, while a cylinder block 151 is formed with a coolant outlet to which a coolant discharge pipe 122 of the circulation system 144 is connected. The coolant inlet is connected to a coolant outlet of the radiator 124 via the coolant introducing pipe 121, while the coolant outlet is connected to a coolant inlet of the radiator 124 via the coolant discharge pipe 122. The coolant introducing pipe 121 is provided with the water pump 123. The circulation system 144 may further include a liquid temperature sensor and a thermostat for liquid temperature adjustment (neither shown).

The circulation system 144 includes a first coolant flow passage 30 and a second coolant flow passage 20 formed in the cylinder head 101 and a third coolant flow passage 152 formed in the cylinder block 151. The first coolant flow passage 30 communicates with the coolant inlet. The first coolant flow passage 30 communicates with the second coolant flow passage 20 inside the cylinder head 101. The second coolant flow passage 20 and the third coolant flow passage 152 of the cylinder block 151 communicate with each other via openings formed at a plurality of portions of a mating surface between the cylinder head 101 and the cylinder block 151. The third coolant flow passage 152 communicates with the coolant outlet.

A coolant circulating in the circulation system 144 is introduced into the coolant inlet formed in the cylinder head 101 and flows in the first coolant flow passage 30 of the cylinder head 101, thereby cooling intake ports 2 from upper surface sides thereof. The coolant used for cooling the intake ports 2 advances from the first coolant flow passage 30 into the second coolant flow passage 20 and flows in the second coolant flow passage 20 to cool lower surfaces of exhaust ports and the intake ports 2. The coolant having passed through the inside of the cylinder head 101 then flows in the third coolant flow passage 152 of the cylinder block 151 to cool cylinders and then is discharged from the coolant outlet formed in the cylinder block 151.

According to the configuration shown in FIG. 40, while cooling those portions, required to be cooled, of the cylinder head 101 and the cylinder block 151 by the single circulation system 144, it is possible to achieve that the temperature of the coolant flowing in the first coolant flow passage 30 is made lower than that of the coolant flowing in the second coolant flow passage 20.

Next, an eleventh embodiment of the invention will be described with reference to the drawings. The eleventh embodiment has a feature in the configuration of an engine cooling system. The engine cooling system of the eleventh embodiment can be combined with any of the cylinder heads of the first to sixth embodiments. However, herein, a description will be given of an example combined with the cylinder head of the first embodiment.

Figure 41:
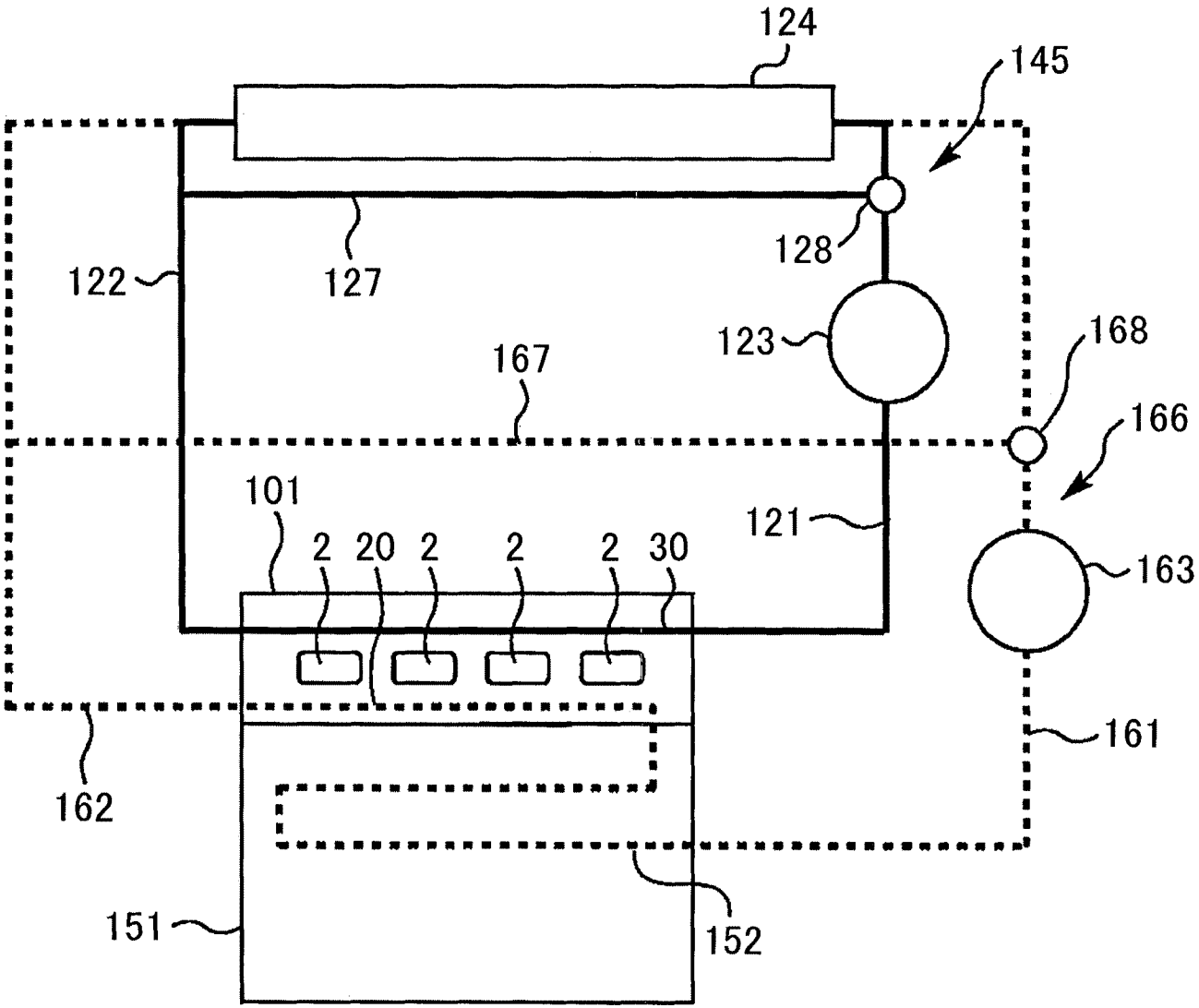
FIG. 41 is a diagram showing a configuration of an engine cooling system of an eleventh embodiment of the invention.

Hereinbelow, referring to FIG. 41, the configuration of the engine cooling system of the eleventh embodiment of the invention will be described. In FIG. 41, components equivalent to those of the engine cooling system of the first embodiment shown in FIG. 1 are assigned the same symbols. An overlapping description of those equivalent components will be omitted or simplified.

Hereinbelow, the configuration of a circulation system will be described. The engine cooling system of the eleventh embodiment includes dual circulation systems 145 and 166. The duel circulation systems 145 and 166 respectively form closed loops, but are not completely independent of each other and share a single radiator 124. Water pumps 123 and 163 each for circulating a coolant are respectively provided in the duel circulation systems 145 and 166. The coolant cooled by the radiator 124 is distributed to the circulation systems 145 and 166 and the coolants circulated in the circulation systems 145 and 166 are collected into the radiator 124 so as to be cooled.

The first circulation system 145 includes a first coolant flow passage 30 formed in a cylinder head 101. The cylinder head 101 is formed with a coolant inlet and a coolant outlet each communicating with the first coolant flow passage 30. The coolant inlet of the cylinder head 101 is connected to a coolant outlet of the radiator 124 via a coolant introducing pipe 121, while the coolant outlet of the cylinder head 101 is connected to a coolant inlet of the radiator 124 via a coolant discharge pipe 122. The coolant discharge pipe 122 and the coolant introducing pipe 121 are connected to each other via a bypass pipe 127 bypassing the radiator 124. A thermostat 128 is provided at a joint portion between the coolant introducing pipe 121 and the bypass pipe 127. The water pump 123 is provided downstream of the thermostat 128 in the coolant introducing pipe 121.

In the first circulation system 145, the coolant heated by passing through the cylinder head 101 and the coolant cooled by the radiator 124 are mixed together by the thermostat 128. Then, the coolant at a temperature adjusted by the thermostat 128 is supplied to the first coolant flow passage 30 formed in the cylinder head 101.

The second circulation system 166 includes a second coolant flow passage 20 formed in the cylinder head 101 and a third coolant flow passage 152 formed in a cylinder block 151. The second coolant flow passage 20 of the cylinder head 101 and the third coolant flow passage 152 of the cylinder block 151 are connected to each other via an opening formed in a mating surface between the cylinder head 101 and the cylinder block 151. The cylinder block 151 is formed with a coolant inlet communicating with the third coolant flow passage 152, while the cylinder head 101 is formed with a coolant outlet communicating with the second coolant flow passage 20. The coolant inlet of the cylinder block 151 is connected to the coolant outlet of the radiator 124 via a coolant introducing pipe 161, while the coolant outlet of the cylinder head 101 is connected to the coolant inlet of the radiator 124 via a coolant discharge pipe 162. The coolant discharge pipe 162 and the coolant introducing pipe 161 are connected to each other via a bypass pipe 167 bypassing the radiator 124. A thermostat 168 is provided at a joint portion between the coolant introducing pipe 161 and the bypass pipe 167. The preset temperature of the thermostat 168 is set higher than that of the thermostat 128 of the first circulation system 145. The water pump 163 is provided downstream of the thermostat 168 in the coolant introducing pipe 161.

In the second circulation system 166, the coolant heated by passing through the cylinder block 151 and the cylinder head 101 and the coolant cooled by the radiator 124 are mixed together by the thermostat 168. Then, the coolant at a temperature adjusted by the thermostat 168 is supplied to the third coolant flow passage 152 of the cylinder block 151 via the water pump 163 and the coolant having passed through the third coolant flow passage 152 is supplied to the second coolant flow passage 20 formed in the cylinder head 101.

According to the configuration shown in FIG. 41, by the temperature setting of the thermostats 128 and 168, it is possible to provide a distinct difference between the temperature of the coolant flowing in the first coolant flow passage 30 and the temperature of the coolant flowing in the second coolant flow passage 20. The bypass pipe 127 and the thermostat 128 of the first circulation system 145 are not necessarily required.

Other than the embodiments described above, the following mode may be employed as another embodiment. In the first embodiment, the coolant inlet and the coolant outlet are provided in the rear end face and the front end face of the cylinder head. However, if the coolant inlet cannot be provided in the rear end face or the front end face of the cylinder head, a coolant inlet may be provided in the side surface of the cylinder head. Specifically, the sand removing hole formed when forming the first coolant flow passage by the sand core may be sealed and a communication passage that communicates with the first coolant flow passage may be formed by drilling from the side surface of the cylinder head. This also applies to the coolant outlet.

The invention claimed is:

1. A multi-cylinder engine comprising:

a cylinder head including a plurality of combustion chambers, a plurality of intake ports, a first coolant flow passage, and a second coolant flow passage, wherein the plurality of combustion chambers is provided side by side in a longitudinal direction of the cylinder head, the plurality of intake ports is provided side by side in the longitudinal direction of the cylinder head and respectively communicate with the plurality of combustion chambers, the first coolant flow passage extends along upper surfaces of the plurality of intake ports in the longitudinal direction of the cylinder head and, wherein each of a plurality of cross sections that are perpendicular to the longitudinal direction includes a corresponding one of the plurality of intake ports, the first coolant flow passage is located between a flat plane and a central line plane, the flat plane including central axes of the plurality of combustion chambers and parallel to the longitudinal direction, the central line plane including central lines of the plurality of intake ports, and at least a portion of the second coolant flow passage is located between a cylinder block mating surface of the cylinder head and the central line plane, in at least one of the plurality of cross sections perpendicular to the longitudinal direction, and the second coolant flow passage includes a water jacket surrounding exhaust port, and wherein a temperature of a coolant flowing in the first coolant flow passage is lower than a temperature of the coolant flowing in the second coolant flow passage.

2. The multi-cylinder engine according to claim 1, wherein the cylinder head includes intake valve insertion holes and, in a cross section including a central axis of the intake valve insertion hole and perpendicular to the longitudinal direction, the first coolant flow passage is provided to pass through a region sandwiched between the intake valve insertion hole and the intake port.

3. The multi-cylinder engine according to claim 1, wherein the cylinder head includes intake valve insertion holes and, in a cross section including a central axis of the intake valve insertion hole and perpendicular to the longitudinal direction, the first coolant flow passage is provided to pass through a region on a side opposite to a region sandwiched between the intake valve insertion hole and the intake port with respect to the intake valve insertion hole.

4. The multi-cylinder engine according to claim 1, wherein the cylinder head includes intake valve insertion holes and, in a cross section including a central axis of the intake valve insertion hole and perpendicular to the longitudinal direction, the first coolant flow passage is provided to pass on both sides of the central axis of the intake valve insertion hole.

5. The multi-cylinder engine according to claim 4, wherein the first coolant flow passage includes annular passages respectively surrounding the intake valve insertion holes and connecting passages each connecting the adjacent two annular passages to each other.

6. The multi-cylinder engine according to claim 5, wherein the connecting passages include a first connecting passage and a second connecting passage, the first connecting passage passing through a cross section including the central axis of the combustion chamber and perpendicular to the longitudinal direction, the second connecting passage passing through a cross section passing between the adjacent two combustion chambers and perpendicular to the longitudinal direction, with respect to a flat plane including the central axes of the intake valve insertion holes and parallel to the longitudinal direction, the first connecting passage is disposed on one side of the flat plane, while the second connecting passage is disposed on the other side of the flat plane, and the first and second connecting passages are disposed alternately in the longitudinal direction in a manner to sandwich the annular passage between the first and second connecting passages.

7. The multi-cylinder engine according to claim 1, wherein the cylinder head includes a head bolt insertion hole that passes between the two intake ports communicating with the adjacent two combustion chambers and that is perpendicular to the cylinder block mating surface, and in a cross section including a central axis of the head bolt insertion hole and perpendicular to the longitudinal direction, the first coolant flow passage is provided to pass through a region closer to a middle of the cylinder head with respect to the head bolt insertion hole.

8. The multi-cylinder engine according to claim 1, wherein the first coolant flow passage and the second coolant flow passage are independent of each other in the cylinder head.

9. The multi-cylinder engine according to claim 8, wherein the first coolant flow passage communicates with a first hole opened in one end face in the longitudinal direction of the cylinder head, and the first coolant flow passage communicates with a second hole opened in the other end face in the longitudinal direction of the cylinder head.

10. The multi-cylinder engine according to claim 8, wherein the first coolant flow passage communicates with a first hole opened in an end face in the longitudinal direction of the cylinder head, and the first coolant flow passage communicates with a second hole opened in an end face in a width direction of the cylinder head.

11. The multi-cylinder engine according to claim 8, wherein the first coolant flow passage communicates with a first hole opened in an end face in the longitudinal direction of the cylinder head, and the first coolant flow passage communicates with a second hole opened in the cylinder block mating surface.

12. The multi-cylinder engine according to claim 11, wherein the first coolant flow passage is connected to the second hole via a communication passage provided between the two intake ports communicating with the adjacent two combustion chambers.

13. The multi-cylinder engine according to claim 11, wherein the first coolant flow passage is connected to the second hole via a communication passage provided between at least one of end faces in the longitudinal direction of the cylinder head and the intake port closest to the at least one of end faces.

14. The multi-cylinder engine according to claim 10, wherein the first coolant flow passage passes through the cylinder head in the longitudinal direction and wherein a hole opened in one end face in the longitudinal direction of the cylinder head is the first hole and a hole opened in the other end face in the longitudinal direction of the cylinder head is sealed.

15. The multi-cylinder engine according to claim 1, wherein the first coolant flow passage communicates with the second coolant flow passage in the cylinder head and the coolant having passed through the first coolant flow passage flows into the second coolant flow passage.

16. The multi-cylinder engine according to claim 1, wherein a portion of the second coolant flow passage is opened at the cylinder block mating surface, and the portion is located between the cylinder block mating surface and the central line plane.

17. The multi-cylinder engine according to claim 1, wherein the cylinder head includes a plurality of exhaust ports respectively communicating with the plurality of combustion chambers, and the second coolant flow passage extends to peripheries of the plurality of exhaust ports.

18. The multi-cylinder engine according to claim 11, wherein the first coolant flow passage passes through the cylinder head in the longitudinal direction and wherein a hole opened in one end face in the longitudinal direction of the cylinder head is the first hole and a hole opened in the other end face in the longitudinal direction of the cylinder head is sealed.

* * * * *